US011459201B2

(12) United States Patent
Rodriguez et al.

(10) Patent No.: US 11,459,201 B2
(45) Date of Patent: Oct. 4, 2022

(54) HIGH SPEED PAPER WEB TURN-UP SYSTEM WITH A PREPARED LENGTH PAPER BAND COIL

(71) Applicant: Sandar Industries, Inc., Atlantic Beach, FL (US)

(72) Inventors: Peter A. Rodriguez, Jacksonville, FL (US); Jason Rodriguez, Jacksonville, FL (US); Victor Rodriguez, Jacksonville, FL (US); Craig Austin, Jacksonville, FL (US)

(73) Assignee: Sandar Industries, Inc., Atlantic Beach, FL (US)

( * ) Notice: Subject to any disclaimer, the term of this patent is extended or adjusted under 35 U.S.C. 154(b) by 0 days.

(21) Appl. No.: 17/407,664

(22) Filed: Aug. 20, 2021

(65) Prior Publication Data

US 2021/0380361 A1 Dec. 9, 2021

Related U.S. Application Data

(63) Continuation-in-part of application No. 16/849,297, filed on Apr. 15, 2020, now Pat. No. 11,124,377.

(60) Provisional application No. 62/972,969, filed on Feb. 11, 2020, provisional application No. 62/833,848, filed on Apr. 15, 2019.

(51) Int. Cl.

| | |
|---|---|
| ***B65H 19/22*** | (2006.01) |
| ***B65H 19/10*** | (2006.01) |
| ***B65H 19/28*** | (2006.01) |

(52) U.S. Cl.
CPC ..... *B65H 19/102* (2013.01); *B65H 19/107* (2013.01); *B65H 19/286* (2013.01)

(58) Field of Classification Search
CPC ..... B65H 19/10; B65H 19/22; B65H 19/102; B65H 19/107; B65H 19/286; B65H 16/021; B65H 67/02
See application file for complete search history.

(56) References Cited

U.S. PATENT DOCUMENTS

| | | | | |
|---|---|---|---|---|
| 5,046,675 | A * | 9/1991 | Rodriguez | B65H 19/28 242/526.2 |
| 5,299,407 | A | 4/1994 | Schuttler et al. | |
| 5,417,383 | A | 5/1995 | Rodriguez et al. | |
| 6,578,788 | B2 | 6/2003 | Rodriguez et al. | |
| 7,290,732 | B2 * | 11/2007 | Wilmoth | B65H 19/26 242/394 |
| 7,875,152 | B2 | 1/2011 | Rodriguez | |
| 8,124,209 | B2 | 2/2012 | Rodriguez | |

(Continued)

*Primary Examiner* — Sang K Kim
(74) *Attorney, Agent, or Firm* — Tracnik Law PLLC

(57) ABSTRACT

An improved paper band delivery assembly for reliable high speed delivery of a turn-up paper band across a moving web of paper being wound onto a spool. The turn-up paper band is made ready for a turn up procedure by coiling a predetermined length of paper band suitable for a particular machine and retaining the coiled paper band in a reservoir pending deployment across a spool for a turn up procedure. The paper band may be coiled via manual operation or via automated operation. Coiling apparatus may be modularly replaced on a paper making machine. The coiled paper band may be supported within the reservoir on rollers, pins, or other items conducive to fast and reliable uncoiling.

1 Claim, 47 Drawing Sheets

(56) References Cited

U.S. PATENT DOCUMENTS

2017/0341894 A1* 11/2017 Muller ..... B65H 19/102
2018/0312368 A1 11/2018 Harris et al.

* cited by examiner

HIGH SPEED PAPER WEB TURN-UP SYSTEM WITH A PREPARED LENGTH PAPER BAND COIL

CROSS-REFERENCE TO RELATED APPLICATIONS

This application claims the benefit of U.S. Non-Provisional application Ser. No. 16/849,297, filed on Apr. 15, 2020, as a divisional application; and to U.S. Provisional Application No. 62/833,848, filed Apr. 15, 2019, and U.S. Provisional Application No. 62/972,969, filed Feb. 11, 2020, the contents of each of which are incorporated herein by reference in their entirety.

FIELD OF THE INVENTION

The invention relates to methods and apparatus for the use of a prepared length of coiled paper band specific to the dynamics of a particular paper machine enabling more efficient and reliable deployment of paper band tape in severing and transferring a paper web from a rotating full spool onto a rotating empty spool during industrial paper making processes.

BACKGROUND OF THE INVENTION

The modern industrial paper machine includes a continuous manufacturing process that forms a sheet of paper and winds the newly formed sheet of paper on a steel spindle or spool sometimes coated with a rubber or fibrous sheath and drum spinning with significant force as the paper roll reaches a desired maximum diameter. In order to transfer the collection of the newly formed sheet of paper from a first spool with full roll of paper to an empty spool that will continue to wind the paper requires a turn up process. The turn up process severs the moving paper and transfers it to the empty spool. Typically, a transfer turn up tape is extended across a width of the newly formed paper roll and used to sever the paper.

It has been known to contain the transfer paper band in a loop box and extend a portion of the transfer paper band across a moving paper prior to a turn up procedure. In general, it is desirable to extract the paper band from a loop box as quickly and reliably as possible and extend the paper band across a moving paper roll in an equally fast and reliable manner. Failure in a turn up process may result in converting moving paper to scrap and halting of the paper machine involved.

Deployment of paper band from a loop box has constraints on how fast the paper band may be deployed without jamming, and even if deployed slowly paper band known to jam in the loop box. Consequently, known turn up processes have inherent risks that diminish efficiency using the paper making machine.

A failure of an apparatus or system used to dispense transfer turn-up tapes often results in prolonged failure of transfer of paper product produced by a running paper machine to a new spool, which in turn results in one or more of: decreased production, inconsistent winding of the paper product, inconsistent roll sizes, excessive waste, shorter service life of equipment, and unsafe operating conditions. What is needed therefore is a more reliable and efficient method for supplying turn up paper during a turn up process.

SUMMARY OF THE INVENTION

Accordingly, the present invention provides apparatus and methods eliminate the loop box during deployment of a paper band in an industrial paper machine and thereby enables faster and more reliable turn up process times and more consistent transfer of a moving paper sheet from being gathered on a full paper machine spool to being rolled onto an empty paper machine spool.

The present invention provides for methods and apparatus to create a coil of paper band of a predetermined length required for a single turn up on a paper machine, based upon the specific parameters of the paper machine on which the coil will be deployed.

According to various embodiments of the present invention, a coil of paper band may be wound via operation of an automated coiler or hand wound by an operator.

In some embodiments, a combination paper band dispenser may incorporate a primary tape dispensing module and a secondary tape dispensing module, each tape dispensing module sans a loop box. The primary and secondary tape dispensing modules may combine one or both of an automated module and a manual module, wherein each of the automated module and the manual module is capable of dispensing paper band in a paper web turn-up system without the need for a loop box.

Primary and secondary coiled tape dispensing modules may be programmed to operate independently of each other and, in some embodiments may be arranged to act as a failsafe such that a secondary coiled tape dispensing module is held in reserve during a turn up process and only called upon to deploy paper band in the event that turn up process involving a primary coiled paper band dispensing module fails.

In some embodiments, operation of primary and secondary coiled paper band dispensing units allows for replacement of a malfunctioning paper band dispensing module (either manual or automated) without interference in the operation of a complimentary (and redundant) paper band dispensing module.

In another aspect, the present invention provides for methods and apparatus that allow for repair of malfunctioning portions of a paper band dispenser without inhibiting the operation of a paper spooling machine. In some embodiments, the tape dispensing apparatus includes an automated dispensing module and a manual dispensing module, thereby providing the benefits of an automated device while maintaining the dependability and functionality of the manual device. A paper machine operator has a choice to use either the automated dispensing module and a manual dispensing module during a particular turn up process as primary and secondary dispensing modules.

In still another aspect, the present invention provides apparatus and methods for rapid change out of sub-components of a primary or secondary module while maintaining functionality of the other module.

DETAILED DESCRIPTION OF THE INVENTION

Figure 1:
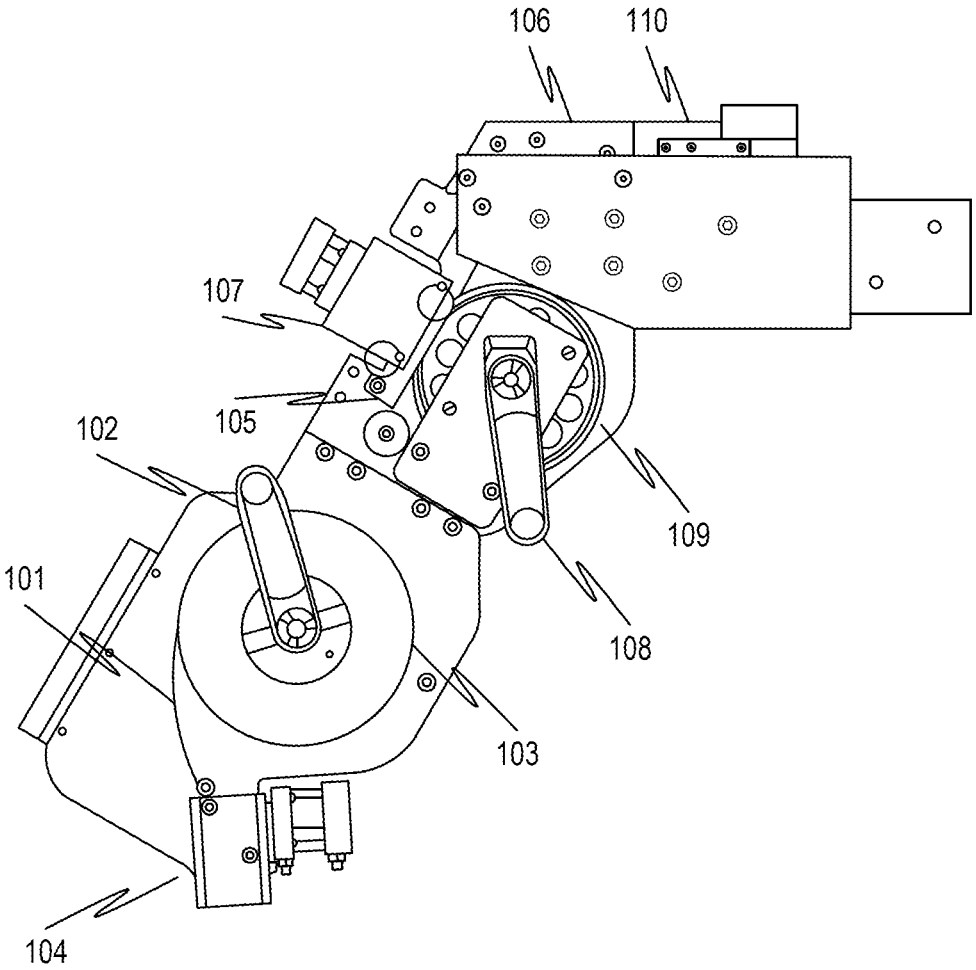
FIG. 1 illustrates a manual tape dispensing module of a paper band dispenser according to some embodiments the present invention.

The present invention relates generally in a first sense to the field of devices, apparatus, systems, and methods of effecting paper machine turn up process involving high-speed severing and transfer of a rapidly advancing paper web from a rotating spool fully wound with paper onto an empty rotating spool. More particularly the present invention includes an improved paper band delivery assembly for reliable high speed delivery of a turn-up paper band across a moving web of paper being manufactured on a paper machine and wound onto a spool. The turn-up paper band is made ready for a turn up procedure by coiling a predetermined length of paper band suitable for a particular machine and retaining the coiled paper band in a reservoir pending deployment across a spool for a turn up procedure. The paper band may be coiled via manual operation or via automated operation. The coiled paper band may be supported within the reservoir on rollers, pins, or other items conducive to fast and reliable uncoiling.

In general, the present invention includes apparatus and methods for dispensing a paper band suitable for a commercial paper machine turn up process. The term "paper web," as used herein, encompasses any paper and/or wood pulpbased product or other non-woven material in which turn-up procedures are used. In a paper web turn-up operation, a continuous paper web being rolled onto a first spool is severed and transferred to an empty spool when the first spool has reached a suitable stage to cease winding paper upon it, such as when the first spool is fully wound. A transfer occurs without requiring a flow of the paper web to be temporarily altered, slowed, or stopped.

Multiple embodiments of the apparatus and methods which dispense paper bands are illustrated and described. It is to be understood that disclosure of the apparatus and methods in relation to a paper web turn-up operation is not meant to be limiting, as the dispenser structure as described is suitable for dispensing different types of paper band for different industrial applications.

As used herein, "paper band," and "paper tape" may be used interchangeably. These terms refer to a band or repulpable material used in a paper web turn up operation for severing and transferring a continuous paper web onto an empty spool. Any suitable paper band may be used, and there may be numerous designs of paper bands, including but not limited to woven repulpable paper bands. Other forms of paper band may also be possible with more complicated modular device configurations. In some examples, as will be discussed with respect to the automated and manual paper band dispensing modules, a single coiled piece of paper band may be formed or contained in a turn-up paper band dispensing module for use in a single turn up operation. Additionally, while dispensers and modules are described herein with respect to paper band, such apparatus and methods may be used to dispense other types of bands and/or tapes known to those of skill in the art.

As used herein, the terms "tape dispenser," "paper band dispenser," or "tape dispensing apparatus" refer to the apparatus that includes, or is configured to include (such that a module of the dispenser may be removed as needed for repair or replacement), a primary tape dispensing module and a secondary tape dispensing module (and additional modules if desired).

In some particular embodiments, a paper band dispenser includes an automated module as the primary band dispensing module and the manual module as the secondary paper band dispensing module, however a paper machine paper band dispenser may include a second automated module instead. In the apparatus described herein, each paper band dispensing module includes (or is configured to include) at least two paper band dispensing module.

The paper band turn up system may include additional apparatus supports, structures, crossbeams, or connectors. For example, the dispenser may further include a track adapter block that coordinates the outputs of the primary and secondary modules, such as by merging the output tracks or by creating multiple output tracks from two or more paper band dispensing modules. The track adapter block may be attached to an apparatus support separate from the modules or may be attached or integrated with the primary or secondary module. For the turn up process, the track adapter output may seamlessly integrate with the cross-machine track of the paper web turn-up system. The paper band dispensing apparatus is part of a paper web turn-up system which includes other features, including the cross-machine track, brakes, electronic controls, and other features known to those of skill in the art. It will be understood that the paper band dispensers described herein may be used with any suitable paper web turn-up system.

As used herein, the terms "manual module" or "manual paper band dispensing module" refer to a paper band dispensing device wherein the means for actuating the paper band drive mechanism is manual, such as by use of a hand crank, and performed by an operator. While the manual drive system may in some cases use powered means including electronic, pneumatic, hydraulic, or magnetic devices, in a manual module, an operator actuates such power by use of a switch, button, or the like. The manual module is configured to connect with a second (or more) paper band dispensing module(s) but may operate independently and in the absence of the other module(s). In general, the manual module in the paper band dispensers described herein include a reservoir or holder for paper band; a track body that is adapted to receive and hold the paper band as it moves through to a discharge end of the paper band dispensing module; and a drive mechanism (typically with a manual method of actuating the mechanism such as a hand crank and/or pneumatic device) such as a nip mechanism (also referred to herein as a nip cylinder) and drive wheel, pinch wheel, or other device to secure and move the paper band to the discharge end of the manual paper band dispensing module and through a cross-machine track of a paper web turn-up system. The manual module also includes a means of connecting to or integrating with an additional module such as an automated module. Such means include, but are not limited to, hinges, brackets, holes, or protrusions that are configured to attached to another module or a paper band dispenser apparatus support. The manual modules may further include other housing, structures, and/or support. There are further several optional features that may be added to provide further functionality or ease of use for the manual module, including, but not limited to, a reservoir for the paper band, unicharger and paper band coil keeper, cutter, mechanical counter, view port, retractable stop, an overrunning clutch between the drive wheel and hand crank, and holder for a single use paper band dispensing box. Each of these features will be described in further detail below.

As used herein, the terms "automated module" and "automated paper band dispensing module" refer to a paper band dispensing device wherein the means for actuating the paper band drive mechanism include a motor or other powered drive mechanism. The motor or powered drive mechanism is connected to a programmable logic controller that actuates the mechanism. The automated module is configured to connect with a second (or more) paper band dispensing module(s) but may operate independently and in the absence of the other module(s). In general, the automated module includes a reservoir or other holder of coiled paper band; a track body that is adapted to receive and hold the paper band as it moves through to a discharge end of the paper band dispensing module; a motor; and a drive mechanism such as a nip mechanism (also referred to herein as a nip cylinder) and drive wheel, pinch wheel, or other device actuated by the motor to move the paper band to the discharge end of the paper band dispensing module and through a cross-machine track of a paper web turn-up system. The automated module may also include a mechanical apparatus to integrate with another paper band module, such as a manual paper band module, including but not limited to hinges, brackets, holes, or protrusions that are configured to attached to another module or a paper band dispenser apparatus support. Automatic modules may further include other housing, structures, and/or support. There are further several optional features that may be added to provide further functionality or ease of use for the automated module, including, but not limited to, a unicharger (e.g., a motorized unicharger) with a paper band coil keeper, a cutting mechanism, retractable stop, counter, view port, and holder for a single use paper band dispensing box. Each of these features will be described in further detail below.

As used herein, the term "unicharger" refers to an optional feature of both the manual and automated modules. The unicharger is an automated or manual device that includes a winding hub and a mechanism for spooling paper band into a paper band coil. The coiled paper band is then cut at the appropriate length for a single turn up on a particular paper making machine. The paper band is typically spooled in the opposite direction as it was spooled in a paper band supply. A leading end may then be fed into a drive mechanism of a paper band dispensing module. An automated unicharger (sometimes also referred to as a powered winder) spools paper band into a coil via a motor. A manual unicharger (sometimes also referred to as a hand winder or manual paper band module) spools a paper band into coil by use of a manual device such as a hand crank.

While an automated module typically has an automated unicharger, some configurations may include a manual unicharger in an automated paper band dispensing module. Furthermore, in some embodiments, one or more paper band dispensers may only have one unicharger, which may then be used to create paper band coils for each module. For example, if an automated paper band dispensing module spools a paper band coil with an automated unicharger, the paper band coil may then be removed from the automated unicharger and transferred to a reservoir in the manual paper band dispending module. The automated module can then spool another length of paper band for use in the automated paper band dispensing module.

As used herein, the term "unicharger" includes both manual and automated unichargers, unless otherwise specified. Benefits of using a unicharger include, as non-limiting examples: avoidance of paper band tangling in a loop box or free loop; 2) more uniform resistance to rapid movement of the paper band in the turn-up, reducing band breakage and failed turn-ups; and 3) reduction of snagging of paper band in a track caused by paper band curl since curl imparted into paper band counteraction to curl imparted by paper band being coiled in one direction on a supply coil is counteracted by winding the paper band in an opposite direction to the supply coil (wherein curl contributes to the paper band snagging in the dispenser or track when pushed across the paper machine).

The term "coil," as used herein, encompasses any wound length of paper band, including a generally circular winding, but also oval or other shape winding, and the like. Additionally, the coil of paper band, but does not preclude the presence of other minor elements including, but not limited to, a hub on which the paper band may be coiled, support structures to maintain the position of the paper band coil in the box, lubricant, an adhesive applicator, and instructions or other documentation. Furthermore, when the paper band is said to be fed through a "slot," this term is meant to encompass any element of egress from the box, including a hole, slit, spout, exit, outlet, and the like.

Paper band and paper tape may be used interchangeably. Any suitable paper band may be used in the coils described herein, however repulpable paper bands are preferred. The length of paper band needed for a single-use coil will depend on parameters of a particular turn-up machine, paper web machine, and the paper web.

As described above, in some embodiments, the present invention provides a combination paper band dispenser that includes a primary paper band dispensing module and a secondary paper band dispensing module. The modular design of the paper band dispenser allows for facile replacement of a malfunctioning manual or automated module to minimize loss of paper web production. For example, in some cases, an automated turn-up paper dispensing module may be regularly used in performing turn up procedures on a paper making machine. However, during the course of use, various events (e.g., malfunction of the paper band dispenser, breakage of a component of the paper band dispenser, or reaching of a level of usage mandating a preventative maintenance activity) may require a shutdown of the automated module. During such "down-time" events, an operator may keep the paper production machinery functioning through use of a secondary paper band module that is a manual paper band dispensing module that is also included in the paper band dispenser.

In some events, the nature of the issue with the automated module may be serious enough to require significant maintenance activity, such activity which may be better performed with the module removed from its position proximate to the paper production machinery. A malfunctional automated module may be simply, effectively, and quickly removed from the dispenser and replaced with a functional automated module, all the while using the manual module to keep the paper machinery functioning. The removed malfunctioning automated module may be repaired at the paper plant location or sent out to another facility for repair. The modular design enables of the present invention thereby significantly improves the efficiency of paper machine operations.

While the above process is the typical use of the combination paper band dispenser, other configurations are possible. For example, an apparatus of the invention may include more than one manual dispensing module, more than one automated dispensing module, or both. The general use for more than one module is to act as a backup module, and a second manual module or a second automated module may perform that function. In addition, while particular manual and automated modules may be described herein, any type of dispensing modules (manual, automated, or both) now known, or later invented, may be combined in the modular dispenser of the invention. Furthermore, additional features now known or later invented may be added or used in the manual and/or automated modules of the inventive dispenser.

Referring now to FIG. 1 an exemplary configuration of a manual module 100 is illustrated with a protective cover removed. This manual module 100 includes a paper band 101 and a firsthand crank 102 to wind the paper band 101 into a coil of paper band 103 prepared for paper band dispensing cycles of the machine. The first hand crank 102 and its winding hub may also be referred to as a manual unicharger. The coil of paper band 103 is complete once it has enough paper band for one turn up. In some examples, the manual module 100 may include a cutter mechanism 104. The module includes a manual machine track inlet 105 to feed paper band 101, a nip cylinder 107, and manual drive wheel 109. In this example, the module includes a view port 106 to position the end of the paper band in the track. This manual module further includes a second hand crank 108 to actuate the manual drive wheel 109.

In some embodiments, the manual module 100 may be used to perform a turn up process for changing paper web spools. For example, referring again to FIG. 1, an operator may apply a length of adhesive to the end of the paper band 101 and feed it into the machine track inlet 105. The paper band 101 may be advanced until it is visible at the view port 106. The operator may next activate the nip cylinder 107 while turning the second hand crank 108. The turning of the second hand crank 108 may cause the manual drive wheel 109 to turn until the paper band is loaded in the staging position in the cross machine track (not present in the illustration). When the empty spool is lowered onto the paper in the paper machine, an operator may feed the paper band into the nip between the empty spool and the drum, which initiates the turn up. In a timed sequence, a brake (not shown) may be engaged to apply the necessary tension to effect the turn up by tearing the paper and binding it to the new spool.

The system of the present invention may be configured to respond to one or more signals from a mechanism of the paper machine or a dispenser control system to initiate a feed of paper band with adhesive applied to a leading portion of the paper band to into a nip point. In a timed sequence, a brake mounted along the cross-machine track may be actuated by the paper machine or control system to facilitate the turn-up. In some embodiments, a pneumatic feed mechanism in the manual dispenser module is triggered by the paper machine and in turn actuates the brake. In some embodiments, an over-running clutch between the hand crank and the drive wheel may prevent the handle from spinning rapidly in a hazardous manner during a turn-up. By way of non-limiting example, spinning rapidly in a hazardous manner may include rotating in a manner that may strike an operator. Prior to the next desired turn-up, an operator may reset switches on the control panel to prepare the system for the next turn-up cycle.

Figure 2:
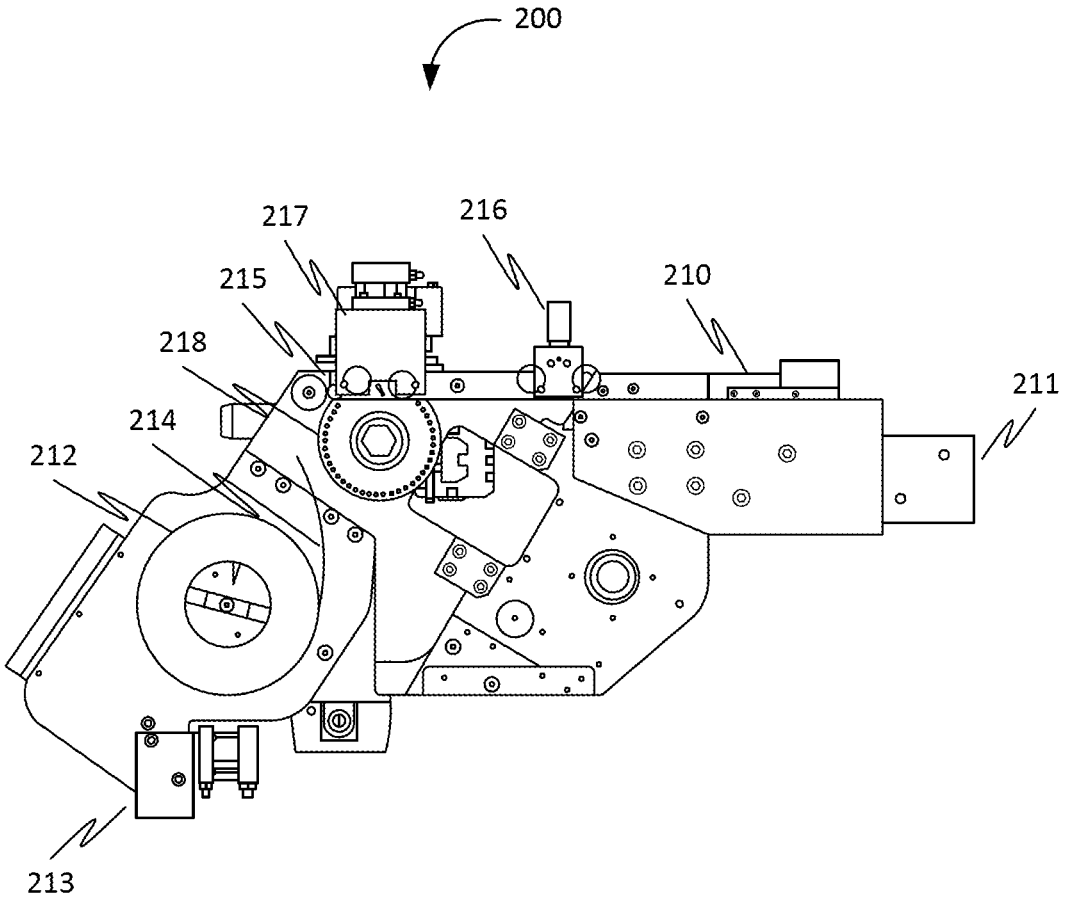
FIG. 2 illustrates an automated tape dispensing module of a paper band dispenser according to some embodiments of the invention. Such an automated tape dispensing module may be combined, in some embodiments, with the manual tape dispensing module of FIG. 1.

Referring now to FIG. 2 possible configurations of an automated module 200 is illustrated with the cover removed. As may be observed, the automated module is designed to be modular and can readily be integrated with another paper band dispensing module such as the manual module of FIG. 1. In this embodiment, the automated module 200 includes a cross machine beam adapter 211 which may be used to support the apparatus. In this module, the paper band stock may be spooled into a coil of paper band 212 via an automated unicharger. This automated module further includes a cutter mechanism 213. The end of the paper band 214 after cutting with the cutter mechanism 213 is shown; this is the portion to which adhesive may be applied by an operator. After applying adhesive, the coil of paper band 212 is fed into a machine track inlet 215 until it reaches a retractable stop 216. The retractable stop 216 is useful to indicate a correct starting position for the coil of paper band 212. The automated module 200 may further includes nip cylinder 217. The coil of paper band 212 may be pushed by the automated drive wheel 218, which may be powered by a motor (not shown) and may rotate to push the coil of paper band 212 through the cross-machine track to a staging position (not shown).

In some embodiments, the automated module 200 may be used to perform a turn up process for changing paper web spools. In performing the automated turn-up, in some embodiments, the automated module may act as follows (referring again to FIG. 2). A paper band may be inserted into a winding hub, and a motor may wind paper band to create a coil of paper band sufficient for one cycle of the machine. If so equipped, the cutter mechanism 213 may be cycled to cut the paper band. Otherwise, the operator may cut the paper band by hand. Sometime before the spool on the paper machine is full, the operator may apply a length of adhesive to the end of the paper band 214. The operator may also feed the end of the paper band 214 into the machine track inlet 215 until it is stopped by the retractable stop 216. In some examples, at this point, the machine is put under automatic control and retracts the retractable stop 216. The machine closes the nip cylinder 217 and an automated drive wheel 218 may rotate to load the paper band through the cross-machine track to the staging position (not shown). When a signal is received from the paper machine or a control system (or an operator), the automated drive wheel may rotate further, feeding the adhesive-laden end of the paper band into a nip between the paper machine's empty spool and its drum, which initiates the turn-up. In a timed sequence, a brake (not shown) may be engaged to apply the necessary tension to affect the turn up by tearing the paper and binding it to the new spool. Finally, the system may be reset for the next turn-up cycle by, for example, pressing a sequencing button on a control panel.

Figure 3:
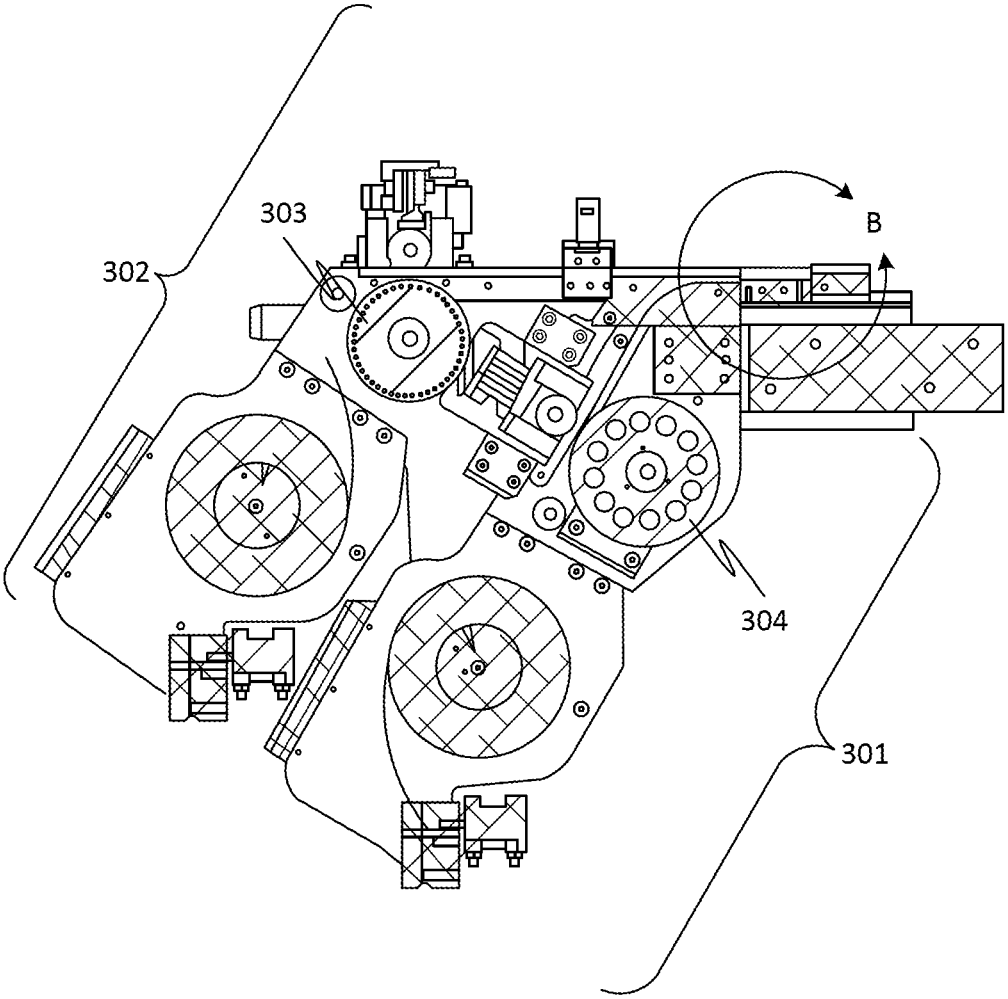
FIG. 3 illustrates a paper band dispenser having a manual tape dispensing module, an automated tape dispensing module, and a track adapter block.

Referring now to FIG. 3, a side view of a combination paper band dispenser is illustrated with cover plates removed is illustrated. In this example, the manual module 301 and the automated module 302 are stacked and their outputs connect via a track adapter block 303 shown in the inset circle.

Figure 4:
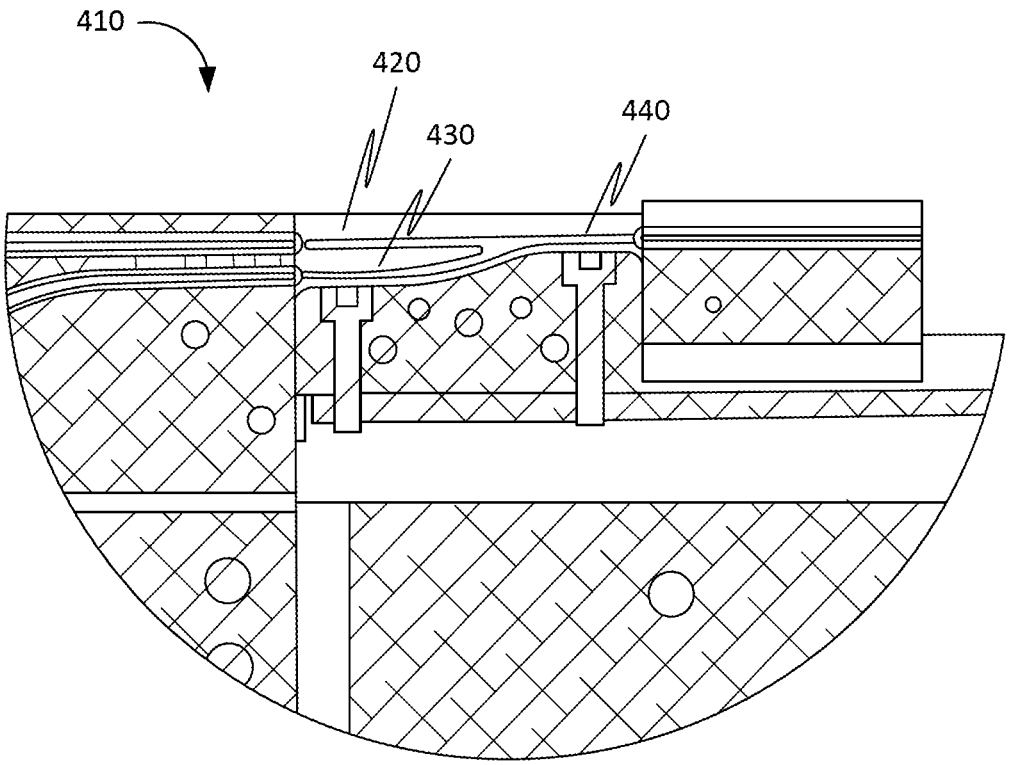
FIG. 4 illustrates a track adapter block according to an embodiment of the invention. This track adapter block merges the output tracks of the manual and automated tape dispensing modules to form a single output track.

Referring to FIG. 4, a track adapter block 410 is illustrated. The track adapter block 410 may be removeable and replaced with various adapter blocks of disparate designs and functionalities. For example, in some embodiments, an adapter block may include a confluence of two outputs: e.g., one each of the manual and automated modules (or the outputs of any two or more paper band dispensing modules).

Some applications of the machine include a cross machine track with only one path through which the paper band is guided. A close examination of the track adapter block 410 illustrated in FIG. 4 reveals that the adapter block merges two input tracks; e.g.; a lower manual module 430 band path with an upper automated band path 420 such that both input tracks use a same, single output path 440 that feeds a single path cross-machine track.

Figure 7:
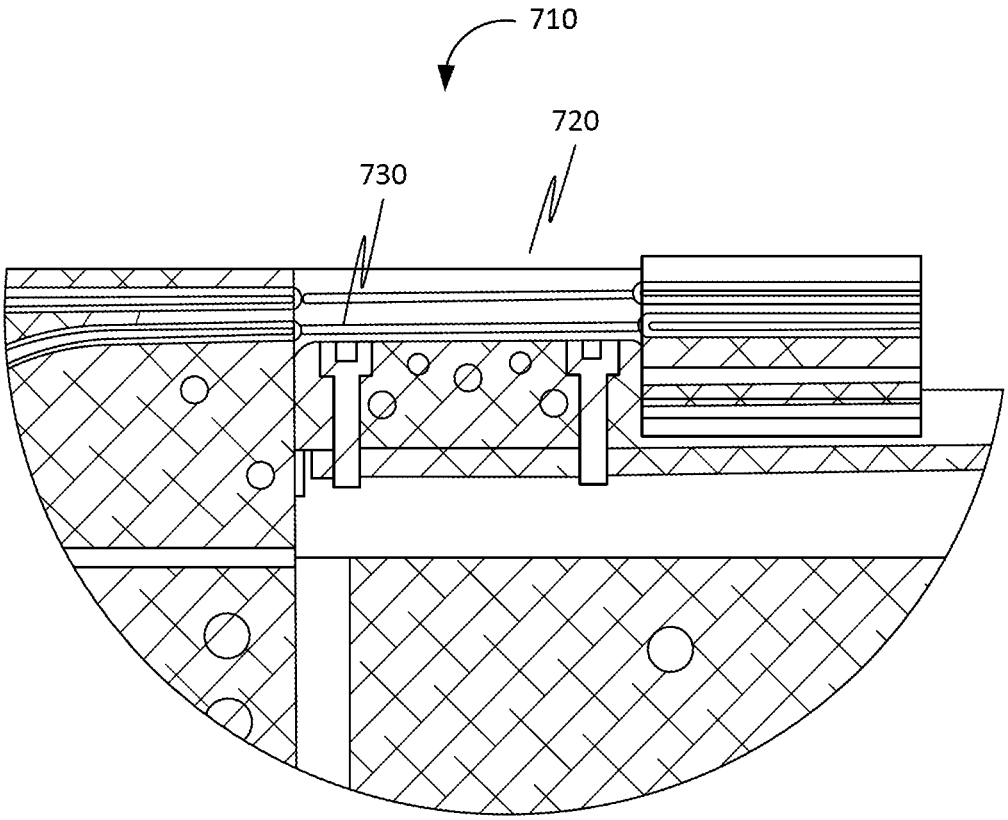
FIG. 7 illustrates a track adapter block according to an embodiment of the invention. In this track adapter block, the manual and automated tape dispensing modules have separate output tracks, in this case, in an over/under configuration.

In other embodiments, such as those illustrated in FIG. 7, an track adapter block 710 includes two input tracks that do not converge into a single track output and instead includes dual output tracks. The dual output tracks can feed a dual path cross-machine track. The two track configuration, which may be called a stacked configuration, or an over/under configuration, may, in some cases, have substantially parallel paths as shown. The lower manual track 730 is parallel to and beneath the upper automated track 720. In some cases, non-parallel, curving, and/or other configurations could be used provided that each module has a separate track for its paper band. Still further embodiments include the method steps of replacing a track adapter block 710 with two input tracks and a single output track with a track adapter block 710 with two input tracks and a dual output tracks.

In some embodiments using this configuration, a secondary module may be staged with a secondary paper band element 101 prepared with adhesive applied and pushed to a view port (see 806 and/or 1006), while a primary paper band in the primary module can be staged, with adhesive applied and positioned in the cross machine track 304 (as shown in FIG. 3) and ready to perform a turn up. In the event that the primary module turn up process fails to effect a turn-up, the secondary paper band is prepared ready to be deployed quickly such that an operator and/or an automation may feed the paper band across the paper machine and insert it into the nip point and perform a turn up process with no interruption to the paper machine. For embodiments that include a single cross machine track 304, the primary paper band should be removed from the cross-machine track 304 and the nip prior to deploying the secondary paper band into the cross-machine track 304.

Figure 5:
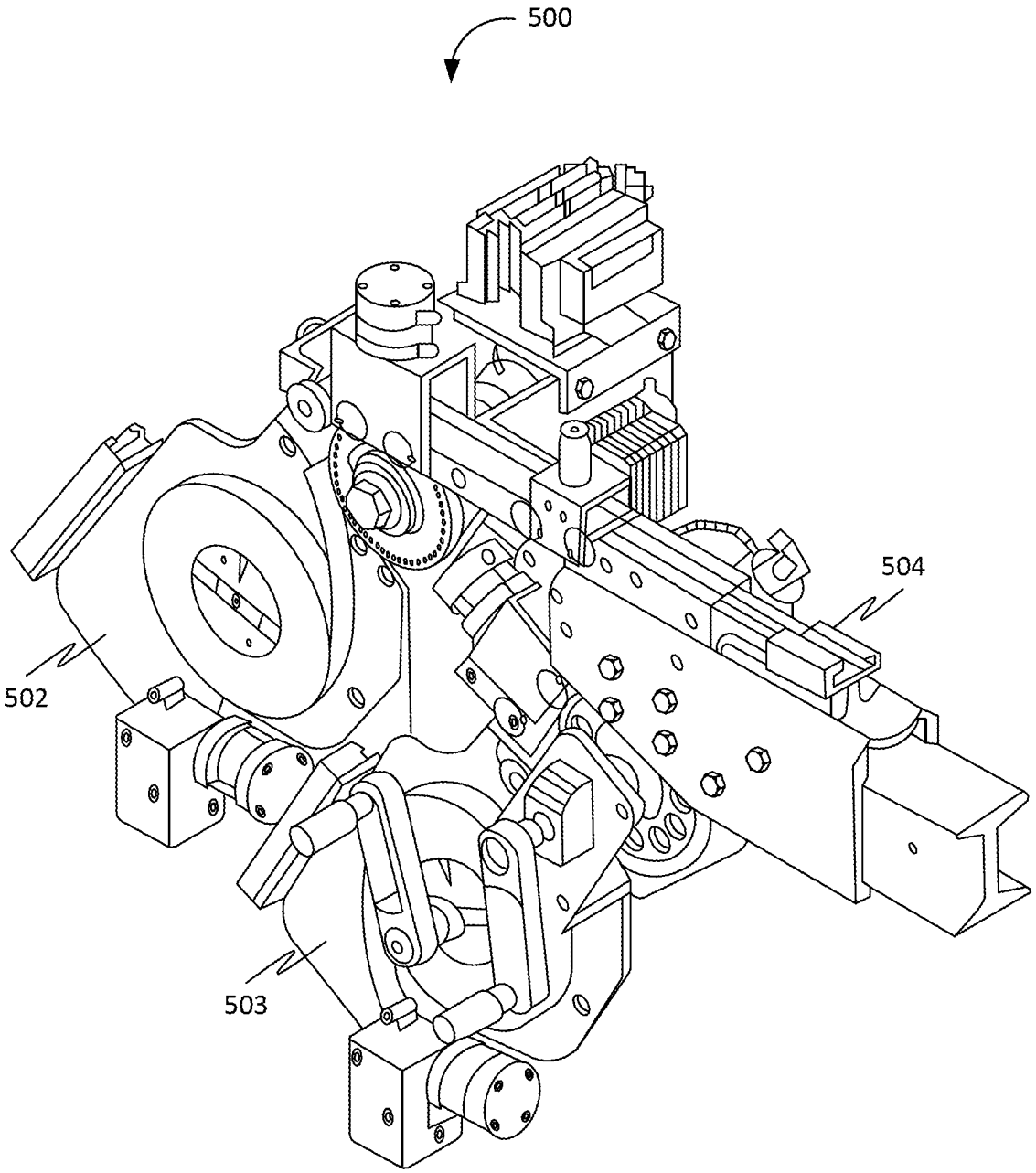
FIG. 5 illustrates an elevation perspective view of an assembled paper band dispenser according to an embodiment of the invention.

Referring to FIG. 5, an elevation perspective view of a combination dispenser 500 with a coil of paper band 501 of a specific length suitable for a single turn up procedure on an associated paper machine is illustrated. The combination dispenser is illustrated with an automated module 502 and a manual module 503 and a track adapter block 504.

In some instances, operations may be better served by a cross machine track with two paths for the paper band. This may allow both the automated and manual modules to be fully staged simultaneously, with paper band fed across the paper machine. Such staging may significantly reduce recovery time after a missed turn up and allow for a second turn up process to be initiated more quickly.

Figure 6:
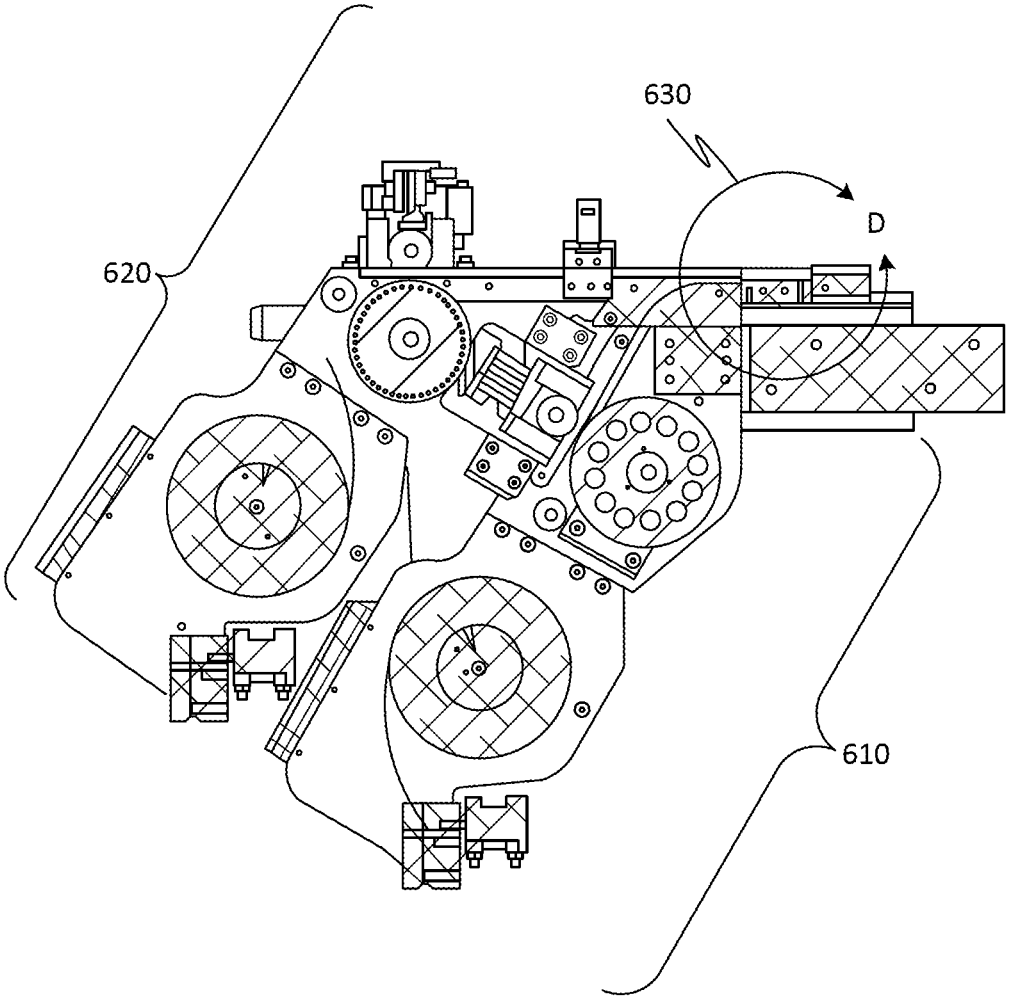
FIG. 6 illustrates a paper band dispenser having a manual tape dispensing module, an automated tape dispensing module, and a track adapter block.

Proceeding to FIG. 6, a combination turn-up paper band dispenser that includes a manual module 610 and an automated module 620 is illustrated with another track adapter block 630.

In paper band dispensing apparatus that include primary and secondary paper band dispensing modules, many functions may be performed without one or more of the modules being in place. In some examples, as have been described, the entire primary paper band dispensing module of the apparatus can be removed for servicing and/or replacement in such a manner that it does not compromise the function of the secondary paper band dispensing modules and therefore the functioning of the apparatus. Likewise, the entire secondary paper band dispensing modules of the apparatus can be removed for servicing and/or replacement in such a manner that it does not compromise the function of primary paper band dispensing module, and therefore the functioning of the apparatus. The same can be said regarding the components of each of the modules. The removal of one, some, or all of the secondary paper band dispensing modules components can be effected without compromising the operation of the primary paper band dispensing module. Likewise, the removal of one, some, or all of the primary paper band dispensing module components can be effected without compromising the operation of the secondary paper band dispensing modules. Furthermore, due to this modularity, additional features (upgrades) to the primary paper band dispensing module may be added without compromising the operation of the secondary paper band dispensing modules, and additional features (upgrades) to the secondary paper band dispensing modules may be added without compromising the operation of the primary paper band dispensing module. This modularity and adaptability allow the apparatus to 1) fit a wide range of budget considerations, 2) be upgraded in the field, and 3) be serviced and repaired without compromising ongoing mill operations.

As described above, the manual module, the automated module, and the combined dispenser may have a number of different configurations. FIGS. 8-24B show various permutations of manual, automated, and combined dispensers according to embodiments of the invention. The below chart summarizes some of the differences between each permutation. One skilled in the art will understand that many more permutations are possible; this list is meant to be illustrative and not exhaustive.

| FIGS. | Automated and/or Manual Module | Representative Module Elements |
|---|---|---|
| 8-9 | Manual | Reservoir, view port, drive wheel, nip cylinder |
| 10-11 | Manual | Manual unicharger, view port, drive wheel, nip cylinder |
| 12-13 | Manual | Manual unicharger, cutter, view port, drive wheel, nip cylinder |
| 14-15 | Manual | Manual unicharger, cutter, view port, nip cylinder, counter |
| 16A-16B | Automated | Automated unicharger, view port, drive wheel, nip cylinder |
| 17A-17B | Automated | Automated unicharger, cutter, view port, drive wheel, nip cylinder |
| 18A-18B | Automated | Automated unicharger, cutter, retractable stop, drive wheel, nip cylinder |
| 19A-19B | Automated/ Manual | Manual: reservoir, view port, drive wheel, nip cylinder; Automated: automated unicharger, drive wheel, nip cylinder |
| 20A-20B | Automated/ Manual | Manual: reservoir, retractable stop, drive wheel, nip cylinder; Automated: automated unicharger, cutter, drive wheel, nip cylinder |
| 21A-21B | Automated/ Manual | Manual: reservoir, retractable stop, drive wheel, nip cylinder; Automated: automatic unicharger, cutter, drive wheel, nip cylinder |
| 22A-22B | Automated/ Manual | Manual: reservoir, retractable stop, drive wheel, nip cylinder, counter; Automated: automated unicharger, cutter, drive wheel, nip cylinder |
| 23A-23B | Automated/ Manual | Manual: manual unicharger, retractable stop, drive wheel, nip cylinder, counter; Automated: automatic unicharger, cutter, drive wheel, nip cylinder |
| 24A-24B | Automated/ Manual | Manual: manual unicharger, cutter, tractable stop, drive wheel, nip cylinder, counter; Automated: automatic unicharger, cutter, drive wheel, nip cylinder |

Figure 8:
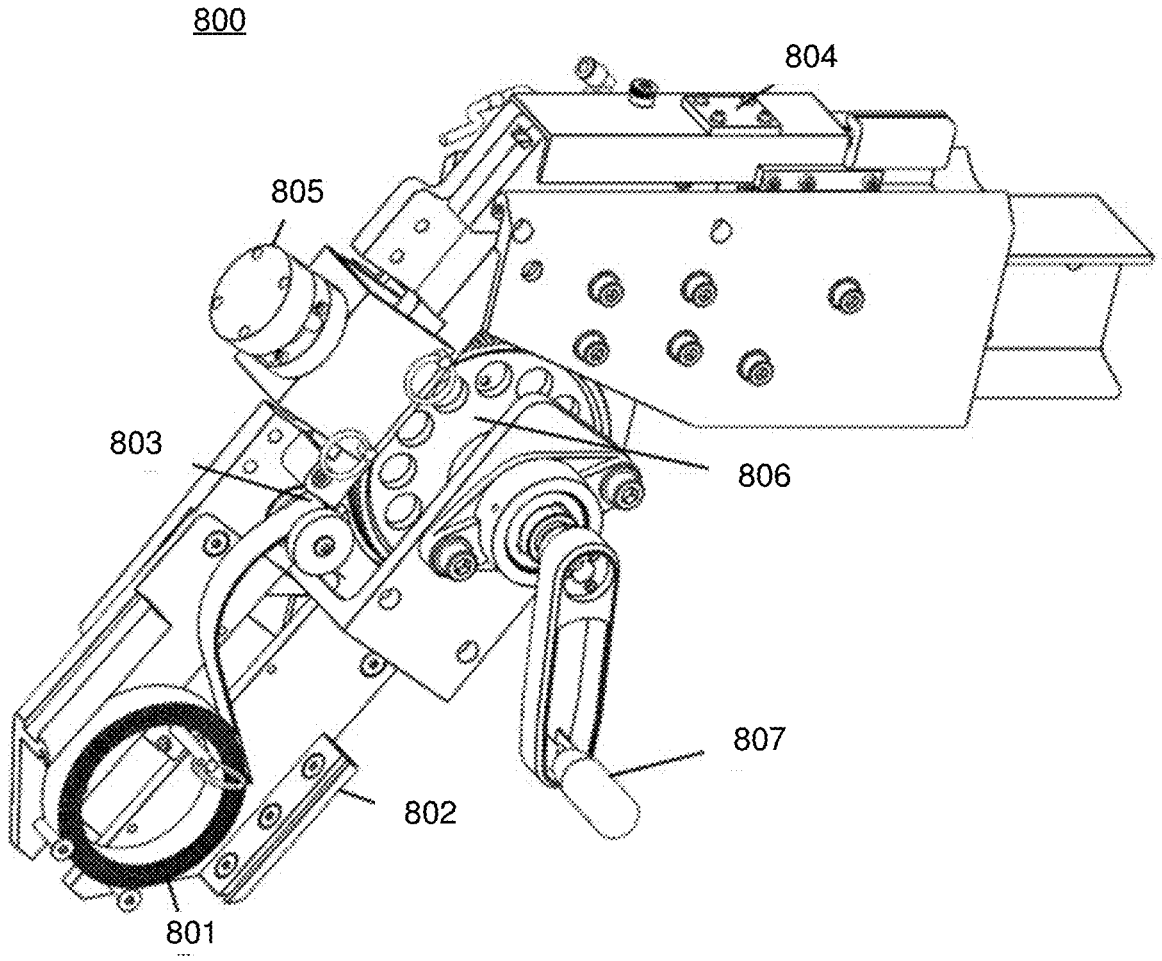
FIG. 8 illustrates a side perspective view of a manual tape dispensing module according to a particular embodiment of the invention.
Figure 9:
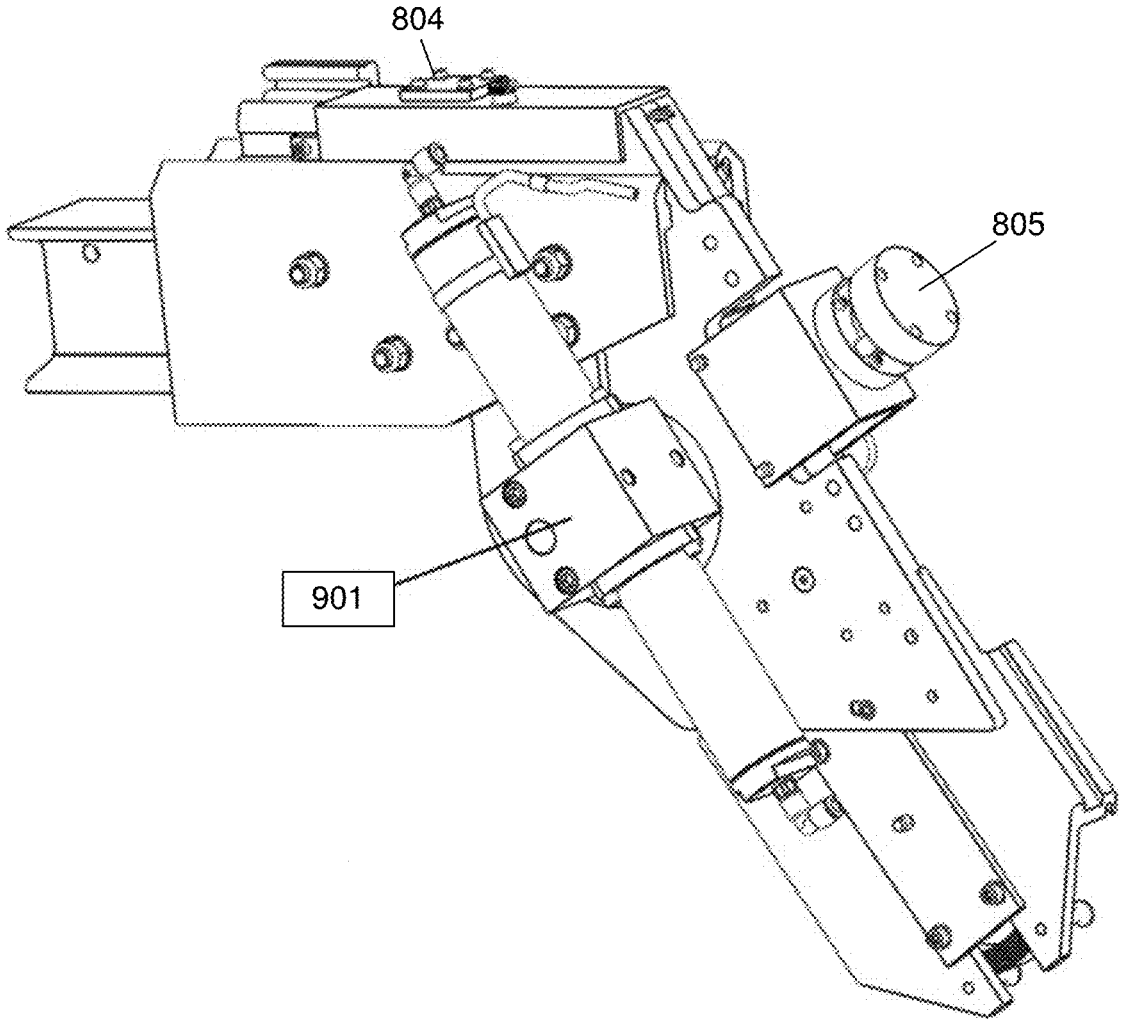
FIG. 9 illustrates a different side perspective view of the manual tape dispensing module in FIG. 8.

Referring now to FIG. 8, a manual module 800 (cover plates removed) with reservoir 802 and hand-cranked drive wheel 806 is illustrated. Generally, the present invention provides for the manual module paper band coil 801 may be hand-coiled separately from the manual module 800 and placed into a reservoir 802 (outer portion of reservoir not shown due to removal of cover plates). Alternatively, a paper band coil 801 may be created by a unicharger in another module, or a single use paper band dispenser box, described in further detail below, may be secured in the reservoir 802. Adhesive may be applied to the free end of paper band 803. An operator may push the end of paper band 803 as far as view port 804 to establish a reliable starting point for subsequent length-based functions related to a paper machine turn up procedure. Nip cylinder 805 may be enabled by a switch on a control panel (not illustrated) to pinch paper band 801 against drive wheel 806, which may allow paper band 801 to reliably be advanced. An operator may turn the hand-cranked drive wheel 806 with crank 807 to push the paper band 801 across the paper machine through a cross-machine track, until the end of the paper band 801 is desirably staged for a subsequent turn-up. To perform the turn-up, the operator may activate feed mechanism 901 (See FIG. 9) by actuating a switch on a control panel that causes hand-cranked drive wheel 806 to push paper band 801 into a nip point between the drum and empty spool. Alternatively, the paper web turn-up system may initiate turn-up automatically based on a signal from the paper machine.

Figure 10:
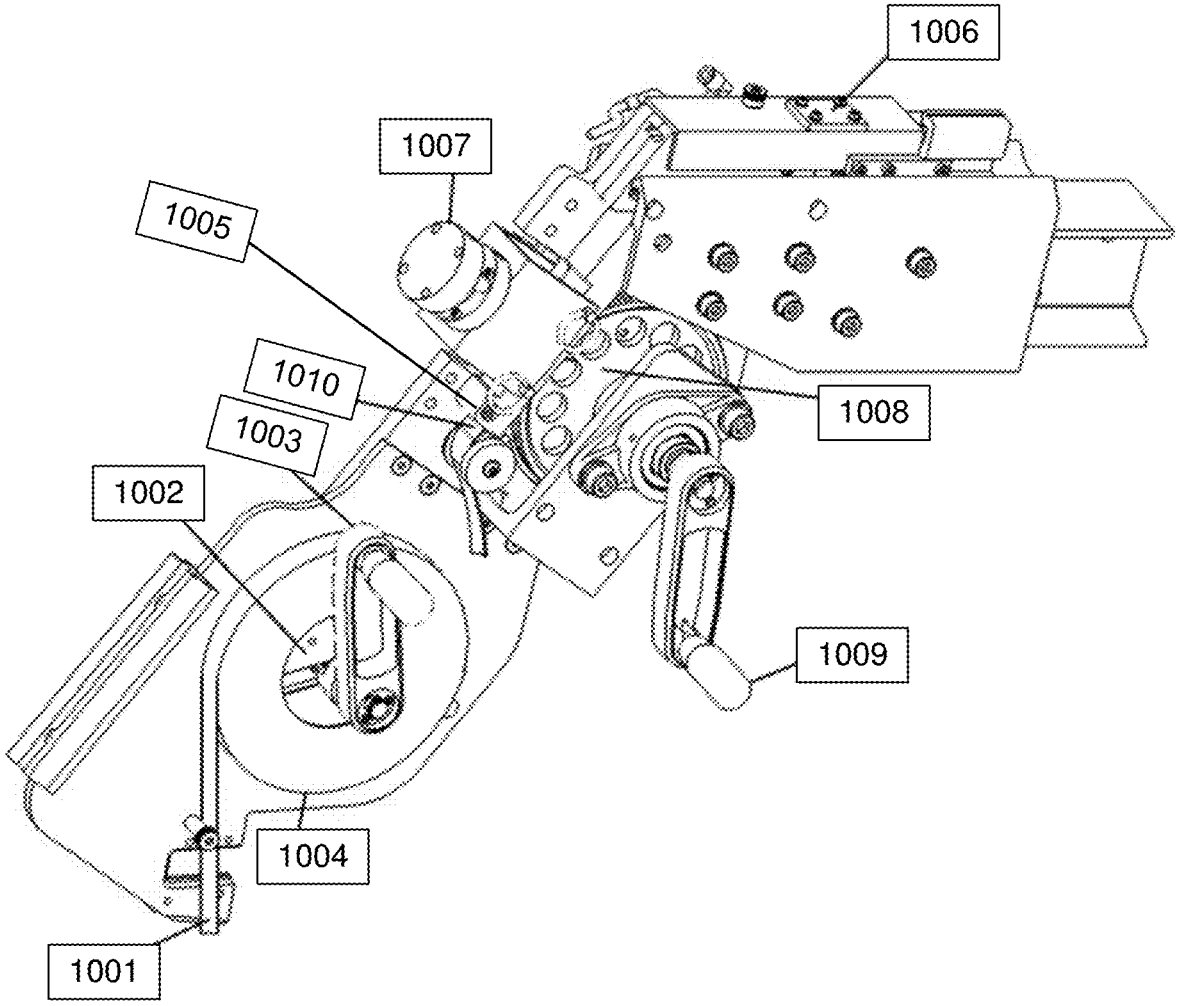
FIG. 10 illustrates a side perspective view of a manual tape dispensing module according to a particular embodiment of the invention.
Figure 11:
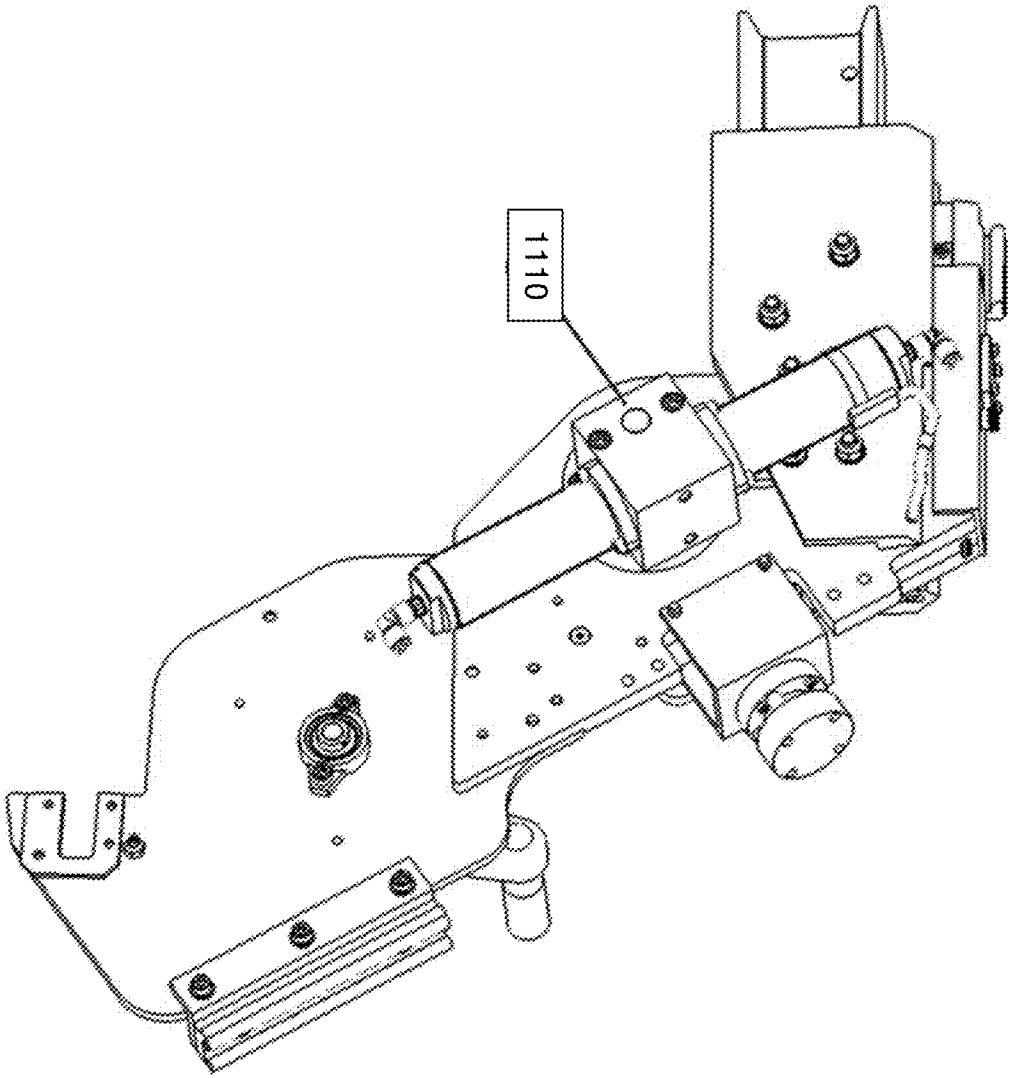
FIG. 11 illustrates a different side perspective view of the manual tape dispensing module in FIG. 10.

In FIGS. 10 and 11, aspects of a manual module with an optional unicharger and aspects of its use are illustrated. The end of paper band 1001 may be inserted into a slot in winding hub 1002 of the manual unicharger. Hand crank 1003 may be engaged into the winding hub and turned to wind a desired length of paper band 1001 into coil 1004; the paper band 1001 may then be cut with a hand tool. The unicharger is thus charged with enough length of paper band 1001 for one turn up. In some embodiments, a length of adhesive may be applied to the free end 1010 of paper band 1001. The paper band 1001 may then be inserted into the module's track through an inlet 1005.

An operator may also advance the paper band to a predetermined position, such as to view port 1006, in the track to establish a reliable starting point for subsequent length-based functions. A nip cylinder 1007 may be operative (such as via activation by a switch on a control panel) to pinch paper band 1001 against drive wheel 1008. Drive wheel 1008 may be turned with crank 1009 to push paper band 1001 across the paper machine through the cross-machine track until the end is properly staged for a subsequent turn-up.

A turn-up may be performed by activating feed mechanism 1110 (See FIG. 11) (such as via operation of a switch on a control panel) to cause causes drive wheel 1008 to push paper band 1001 into a nip point between a drum with paper web wound on it and an empty spool.

In some embodiments, a timed sequence may be used to cause a brake to be operative (not shown) to be engaged and apply necessary tension to effect the turn up by tearing the paper web and binding it to the new spool. The system may also be configured to respond to signals from a mechanism of the paper machine or a dispenser control system to initiate the feed to the paper band into the nip point. In a timed sequence, a brake mounted along the cross-machine track may be actuated and made operative by the paper machine or control system to facilitate the turn-up. In some embodiments, a feed mechanism (e.g., a pneumatic, hydraulic, or magnetic feed mechanism) in the manual dispenser module is triggered by the paper machine and in turn actuates the brake.

Figure 12:
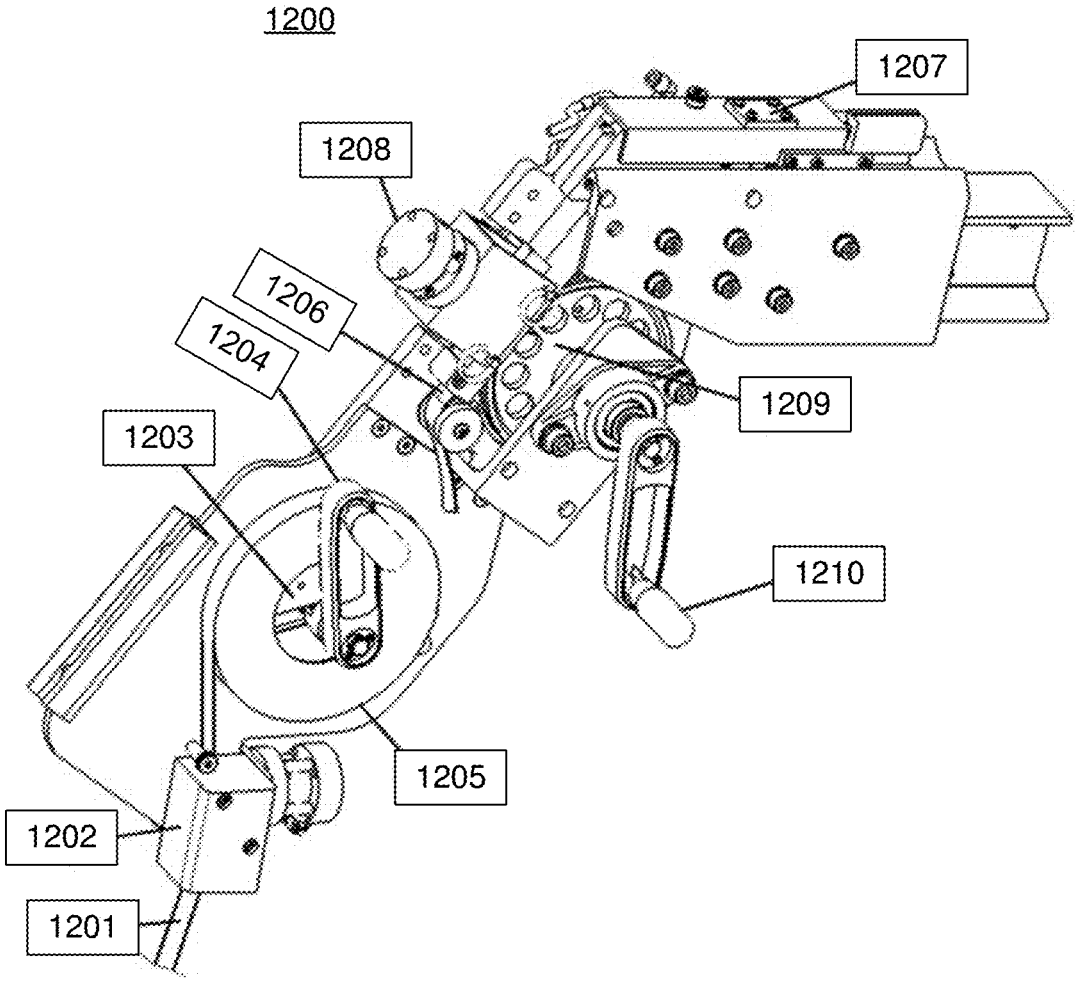
FIGS. 12, 12A-B illustrate side perspective views of paper band dispensing modules according to a particular embodiment of the invention.
Figure 12A:
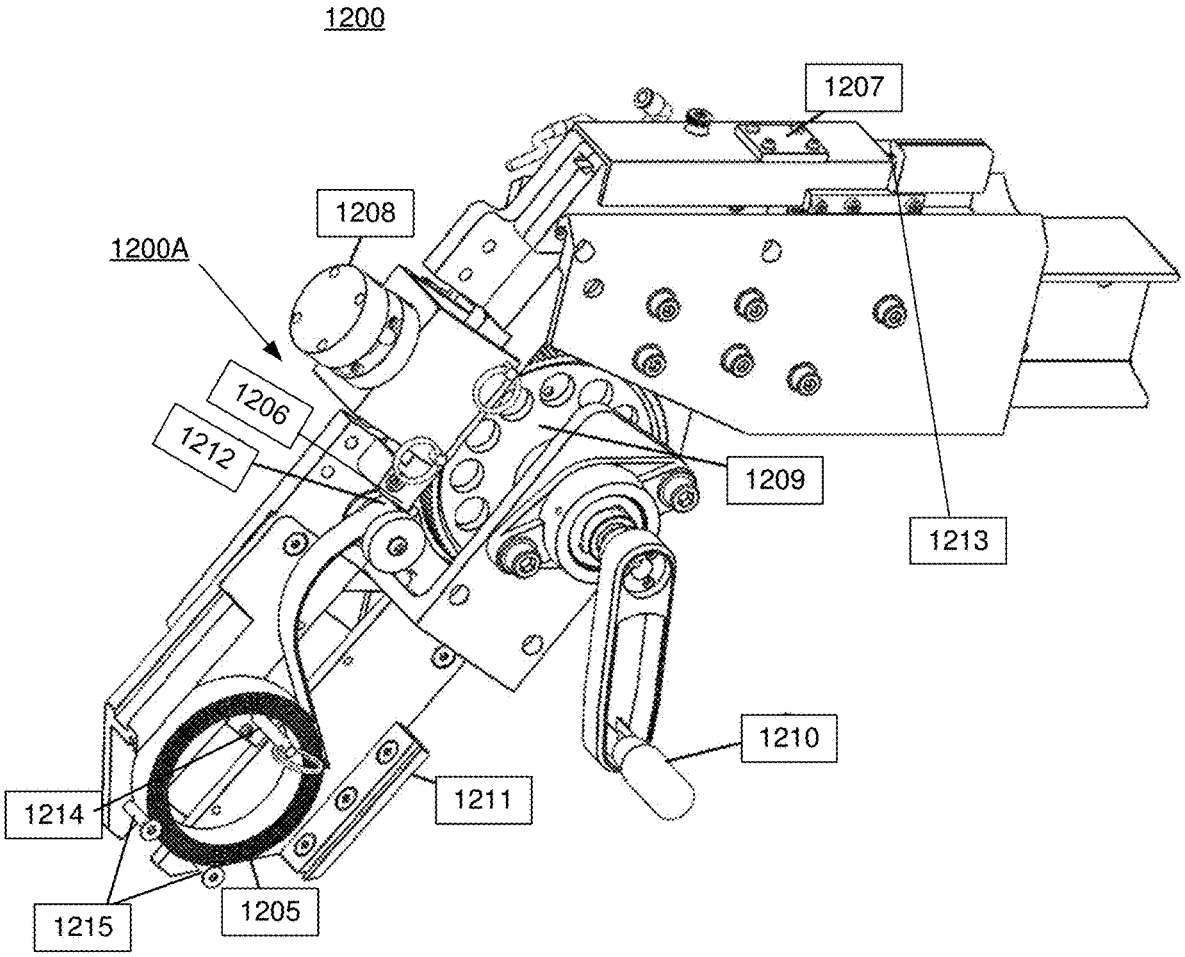
Figure 13:
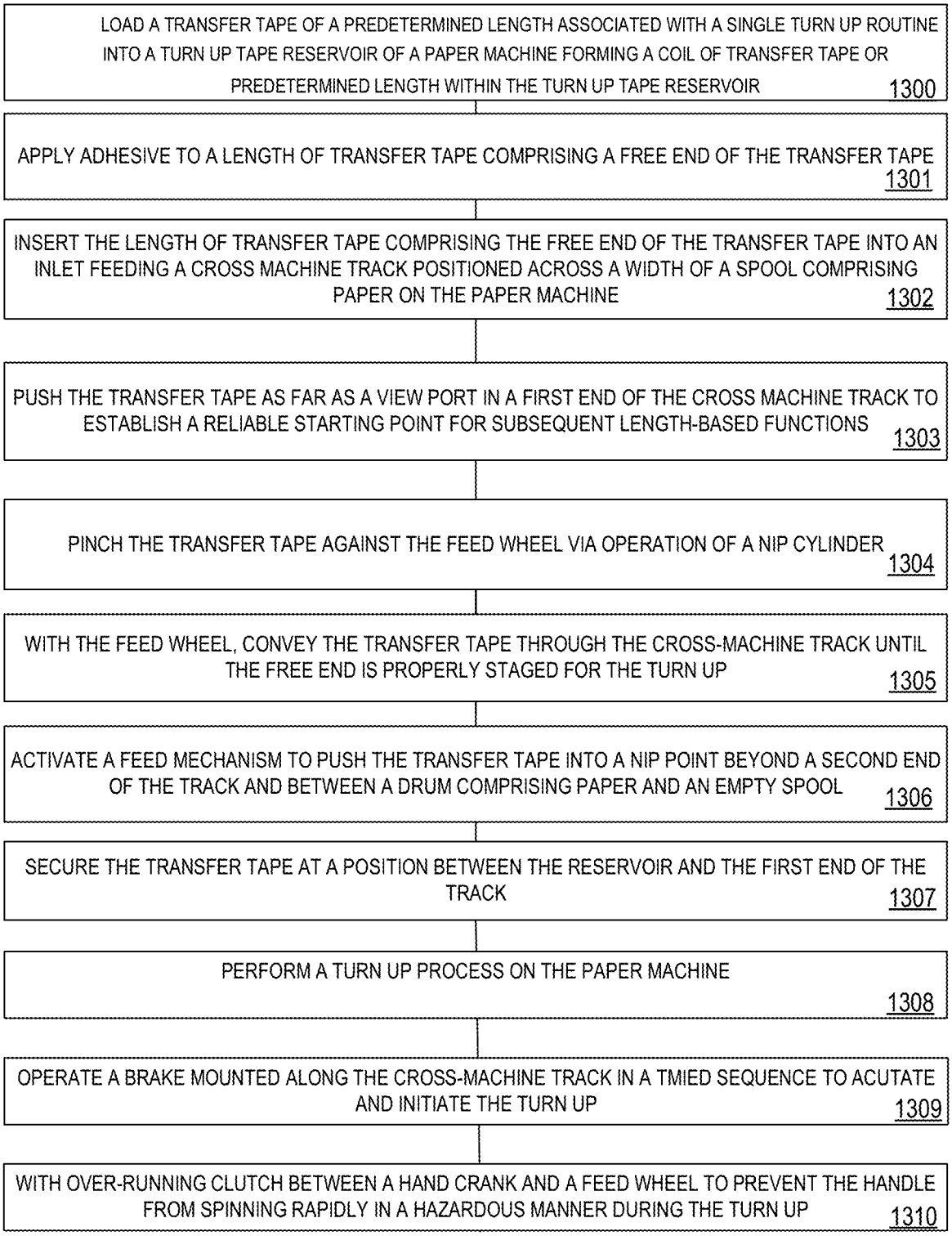
FIGS. 13 and 13A illustrates method steps that may be implemented in some embodiments of the present invention.

Referring now to FIGS. 12, 12A and 13, aspects of a turn up apparatus 1200 with a mechanical cutter and a manual unicharger are illustrated. It should be noted that many of the aspects of a manual module 1200A are also applicable to an automated module. Paper band 1201 may be threaded through cutting mechanism 1202 and inserted into in winding hub 1203. Hand crank 1204 may be engaged into the winding hub 1203 of the unicharger and turned to wind a desired length of paper band 1201 into coil 1205, and the cutting mechanism 1202 may be cycled by a switch on a control panel. A length of adhesive may be applied to a free end of paper band 1201. The paper band 1201 may then be inserted into the manual module's track through inlet 1206. Paper band 1201 may be pushed back as far as view port 1207 in the track to establish a reliable starting point for subsequent length-based functions. An operator may enable nip cylinder 1208 by a switch on a control panel to pinch the paper band against drive wheel 1209. Drive wheel 1209 may then be turned by crank 1210 to push the paper band across the paper machine through the cross-machine track until the end is properly staged for a subsequent turn-up.

Referring now to FIG. 12A, In some embodiments, a reservoir 1211 is used to hold a coil of paper band and crank 1210 may be used to implement method steps including loading a paper band coil 1205 (which may be hand-coiled or automatically coiled separately from the turn up apparatus 1200 and placed into the reservoir 1211, hand coiled on the turn up apparatus 1200 into a reservoir 1211, or coiled via automation into the reservoir 1211). Reservoir 1211 may be further defined via a housing that encloses the paper band coil 1205 in a corral.

The paper band coil 1205 may be maintained in place within the reservoir via an arrangement of one or more paper band coil rests 1215. In some preferred embodiments, the coil rests 1215 are comprised of rollers to facilitate free rotational movement of the paper band coil 12-5 within the reservoir 1211. As illustrated, the paper band coil rests 1215 may be positioned on an outside diameter of the paper band coil 1205, however, in various embodiments, the rests may be positioned on one or both of inside and outside diameters of the paper band coil 1205.

In another aspect, a coil support pin 1214 may be inserted into a pin receptacle (not shown). A paper band module, whether manual or automatic may include multiple coil support pin receptacles to receive the coil support pin 1214. Placement of the coil support pin 1214 into an appropriate coil support pin receptacle may be according to a diameter of the paper band coil 1205.

An adhesive may be applied to a length of paper band at a leading end 1212. The paper band may then be inserted in the system's track through an inlet 1206. The operator may also push a paper band as far as a view port 1207 accessing an associated track 1213 to establish a reliable starting point for subsequent length-based functions.

In some embodiments, an operator may also enable a nip cylinder 1208 (such as, by way of non-limiting example, a switch on a control panel), to pinch the paper band 1212 against the drive wheel 1209, wherein without the pinching action, the paper band 1212 is free to pass through longitudinally. In some embodiments, the drive wheel 1209 may be turned via automation such as a motor or via operation of the crank 1210 to push the paper band 1201 across the paper machine through the cross-machine track (not shown) until a leading end 1212 (sometimes referred to as a free end of the paper band) of the paper band 1201 is properly staged for a subsequent turn up. When a turn up is to be performed, feed mechanism 1110 may be actuated (such as via operation of a switch on a control panel) to cause the drive wheel 1209 to push the paper band 1201 into a nip point between the drum and empty spool (not illustrated in FIG. 12A).

In response to a signal from one or more of: a paper machine's mechanisms; a control system; and an operator command; a feed may be initiated into a nip point. In a timed sequence, a brake mounted along the cross-machine track (not shown) may actuate to facilitate the turn up. An over-running clutch between the hand crank and the feed wheel may be operative to prevent the hand crank 1204 from spinning rapidly in a hazardous manner during the turn up. Prior to the next turn up, switches on a control panel may be reset to prepare the turn up apparatus 1200 for the next turn up cycle.

Figure 12B:
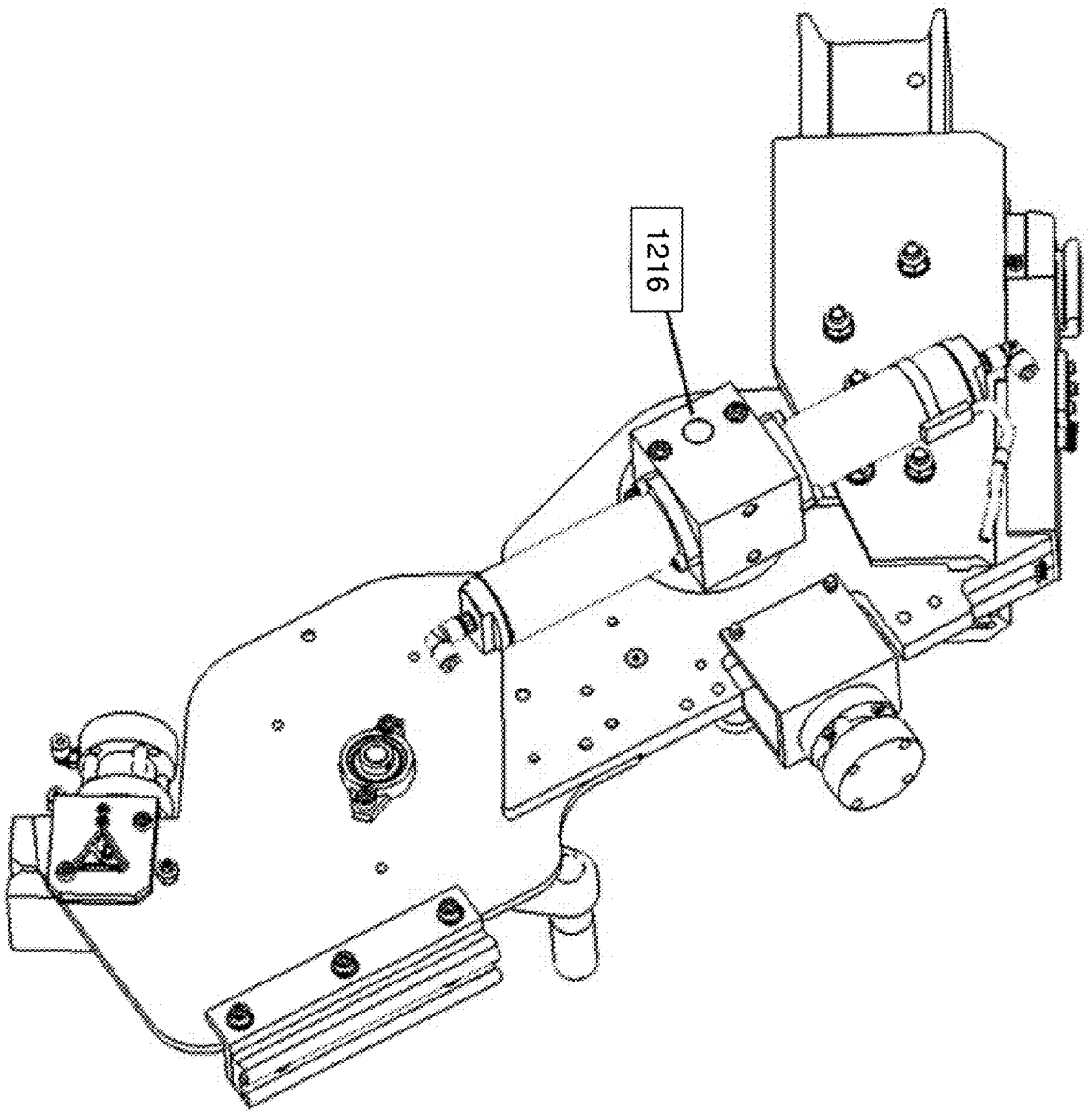

To perform a turn-up, feed mechanism 1216 (FIG. 12B) may be activated via electrical current, such as, for example in response to a switch on a control panel that causes drive wheel 1209 to push the paper band 1201 into the nip point between the drum and empty spool.

Referring now to FIG. 13, method steps that may be implemented in practicing some embodiments of the present invention are illustrated. At step 1300, a paper band is loaded of a predetermined length associated with a single turn up routine. The paper band is loaded into a paper band reservoir of a paper machine and forms a coil of paper band of predetermined length within the paper band reservoir. The paper band reservoir may include rollers into which the paper band coil is situated. The rollers facilitate consistent rotational movement of the paper band coil while the paper band is deployed into a track for performing a turn up routine.

At step 1301 an adhesive may be applied to a length of paper band comprising a free end of the paper band, and at step 1302 a length of paper band that includes the free end of the paper band may be inserted into an inlet feeding a cross machine track positioned across a width of a spool comprising paper on the paper machine.

At step 1303 the paper band may be pushed as far as a view port in a first end of the cross machine track to establish a reliable starting point for subsequent length-based functions. At step 1304, the paper band may be pinched against a feed wheel via operation of a nip cylinder, and at step 1305, the feed wheel may be turned to convey the paper band through the cross-machine track until the free end is properly staged for the turn up.

At step 1306, a feed mechanism may be activated to push the paper band into a nip point beyond a second end of the track and between a drum comprising paper and an empty spool; and at step 1307 the paper band may be secured at a position between the reservoir and the first end of the track.

At step 1308, a turn up process may be performed to transfer paper from a spool filled with paper to an empty spool.

At step 1309 an optional step may include operating a brake in a timed sequence to actuate and/or initiate a turn up process sequence. Step 1310 includes another optional step that includes over-running a clutch between a hand crank and a feed wheel to prevent the hand crank handle from spinning rapidly in a hazardous manner during a turn up procedure. In addition, prior to the next desired turn up, an operator may reset the switches on the control panel to prepare the system for the next cycle.

The system may also be configured to respond to signals from a mechanism of the paper machine or a dispenser control system to initiate the feed into the nip point. In a timed sequence, a brake mounted along the cross-machine track may be actuated by the paper machine or control system to facilitate the turn-up. In some embodiments, a feed mechanism (e.g., a pneumatic, hydraulic, or magnetic feed mechanism) in the manual dispenser module is triggered by the paper machine and in turn actuates the brake.

Figure 13A:
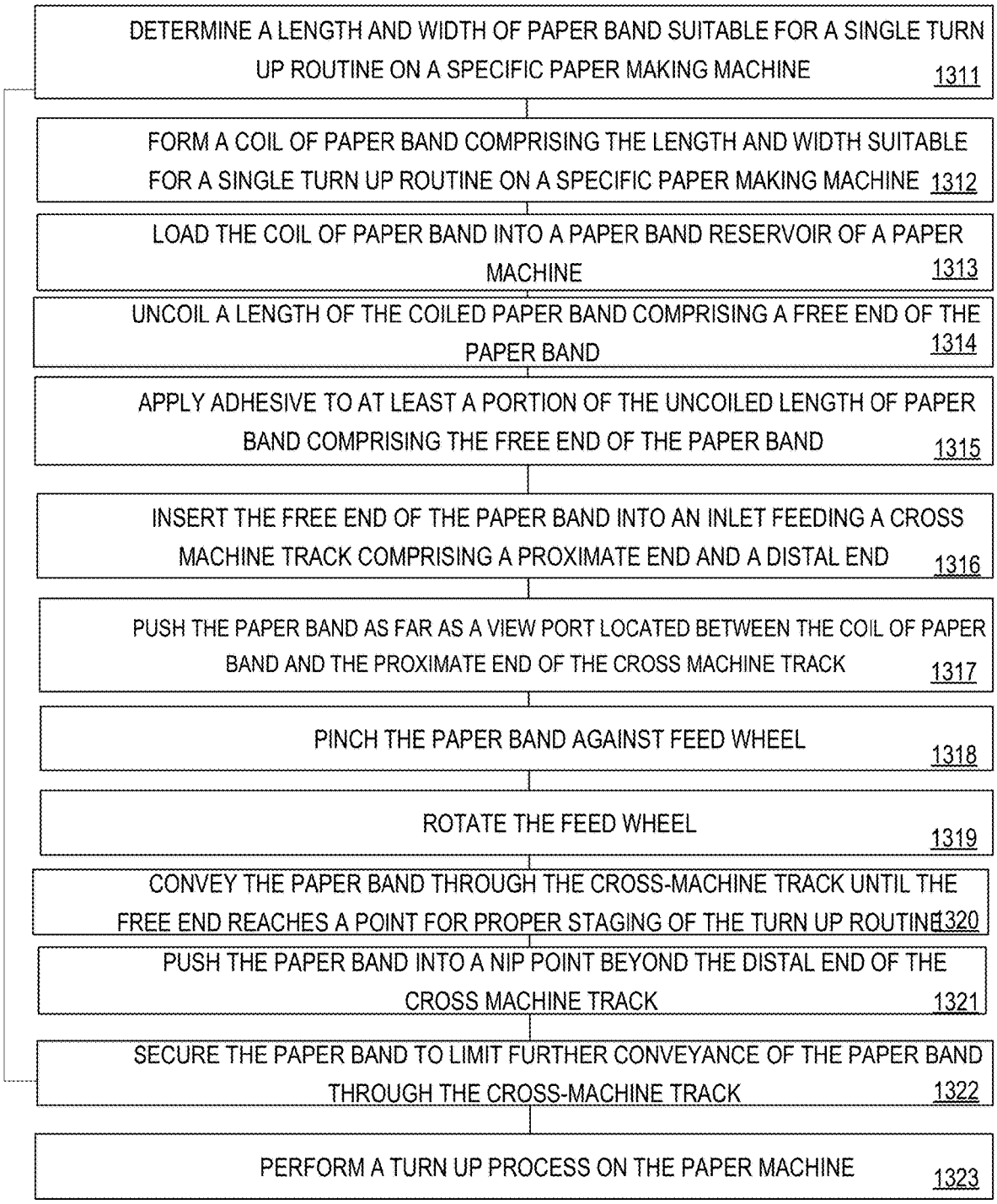

Referring now to FIG. 13A, method steps that may be implemented in a method of performing a turn up routine on a paper machine. At step 1311, a length and width of paper band suitable for a single turn up routine on a specific paper making machine is determined. At step 1312, a coil of paper band comprising the length and width suitable for a single turn up routine on a specific paper making machine is formed. At step 1313, the coil of paper band is loaded into a paper band reservoir of a paper machine. At step 1314, a length of the coiled paper band including a free end of the paper band is uncoiled. At step 1315, an adhesive is applied to at least a portion of the uncoiled length of paper band comprising the free end of the paper band. At step 1316, the free end of the paper band is inserted into an inlet feeding a cross machine track comprising a proximate end and a distal end. At step 1317, a reliable starting point for paper band length-based functions is established by pushing the paper band as far as a view port located between the coil of paper band and the proximate end of the cross machine track. At step 1318, the paper band may be moved against a feed wheel via operation of a nip cylinder, such as via a pinching action. At step 1319, the feed wheel may be rotated. At step 1320, via the rotating of the feed wheel, the paper band may be conveyed through the cross-machine track until the free end reaches a point for proper staging of the turn up routine. At step 1321, a feed mechanism is activated to push the paper band into a nip point beyond the distal end of the cross machine track and between a drum comprising paper and an empty spool. At step 1322, the paper band is secured to limit further conveyance of the paper band through the cross-machine track; and at step 1323 performing a turn up process on the paper machine.

Figure 14:
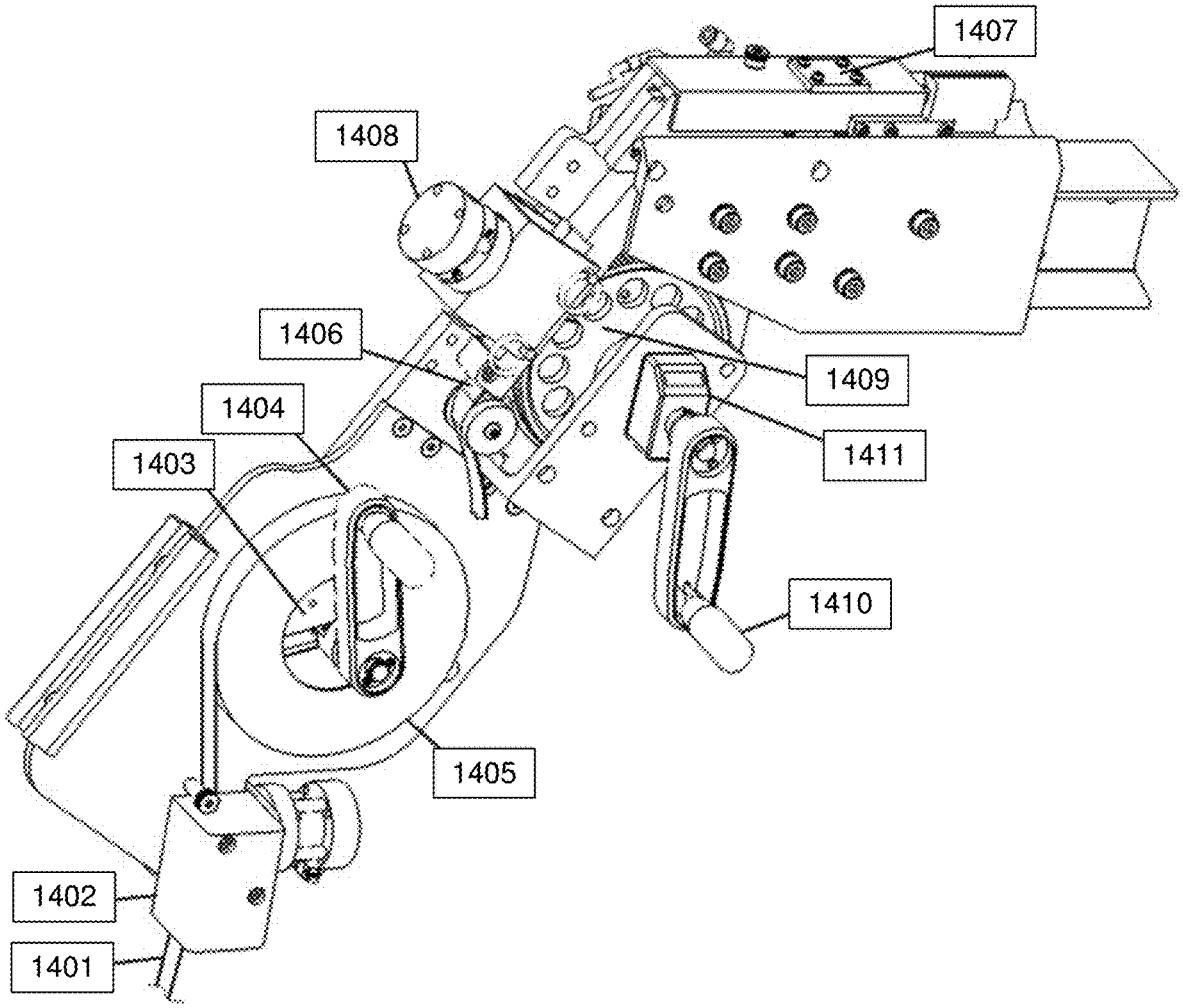
FIG. 14 illustrates a side perspective view of a tape dispensing module according to some embodiments of the invention.
Figure 15:
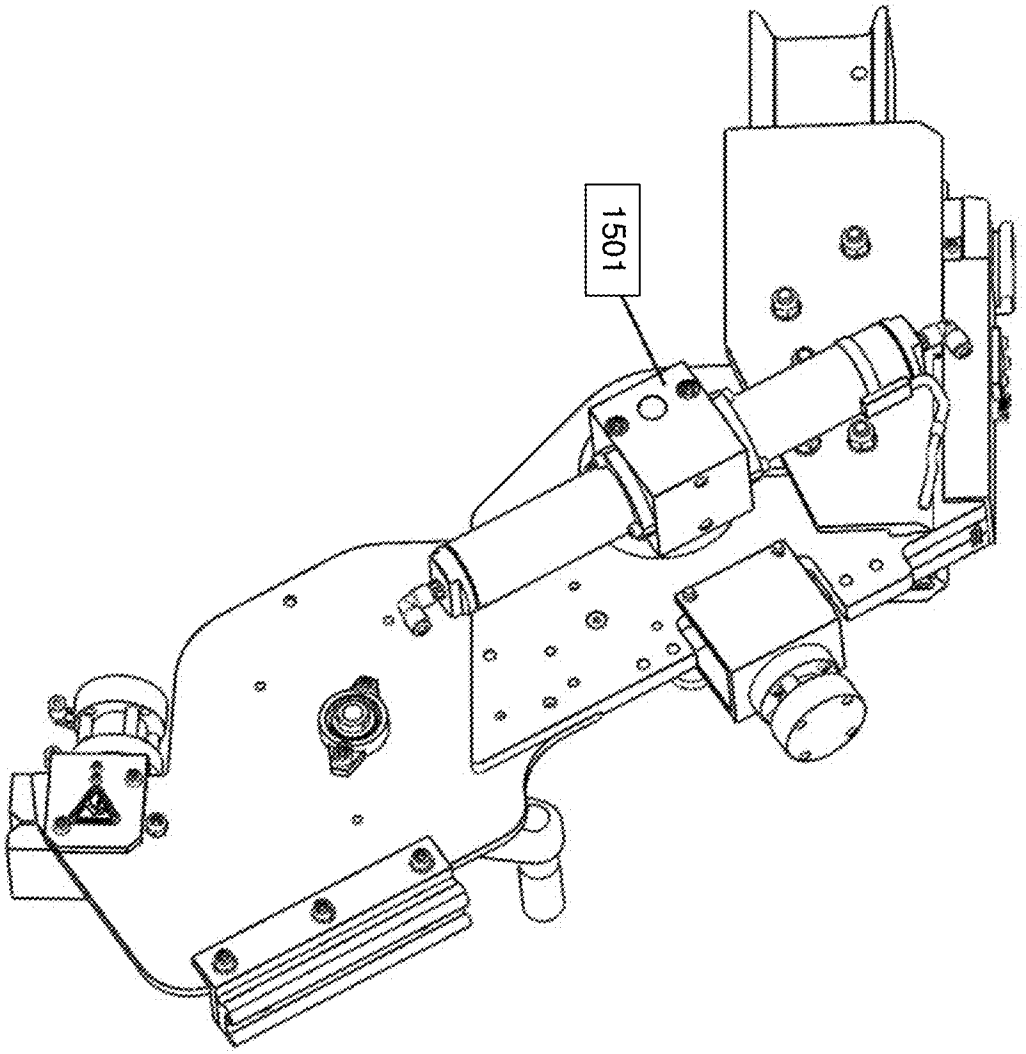
FIG. 15 illustrates a different side perspective view of a tape dispensing module according to some embodiments of the invention.

Referring now to FIG. 14 and FIG. 15 examples of a manual module with a hand-powered winder, a cutting mechanism, a hand-cranked drive wheel, and a mechanical counter are illustrated. Paper band 1401 is threaded through cutting mechanism 1402; the end is inserted into a slot in winding hub 1403 of a manual unicharger. Hand crank 1404 may then be engaged into the winding hub 1403 and turned to wind a desired length of paper band into coil 1405; thereafter, the cutting mechanism 1402 may be cycled by a switch on a control panel. A length of adhesive may be applied to the free end of paper band 1401. The paper band may be inserted into the module's track through inlet 1406. The operator may then push the paper band 1401 as far as view port 1407 in the track to establish a reliable starting point for subsequent length-based functions. The operator may then enable a nip cylinder 1408, such as by a switch on a control panel, to pinch the paper band 1401 against drive wheel 1409. Crank 1410 may be operable to turn drive wheel 1409 to push the paper band 1401 across the paper machine through the cross-machine track until mechanical counter 1411 registers a prescribed length of paper band staged for the subsequent turn-up. The operator may then activate feed mechanism 1501 (See FIG. 15), such as by actuating a switch on a control panel, to cause the drive wheel to push the paper band into the nip point between the drum and empty spool. In a timed sequence, a brake (not shown) may be engaged to apply the necessary tension to effect the turn up by tearing the paper and binding it to the new spool. The system may also be configured to respond to signals from a mechanism of the paper machine or a dispenser control system to initiate the feed into the nip point. In a timed sequence, a brake mounted along the cross-machine track may be actuated by the paper machine or control system to facilitate the turn-up. In some embodiments, a feed mechanism (e.g., a pneumatic, hydraulic, or magnetic feed mechanism) in the manual dispenser module is triggered by the paper machine and in turn actuates the brake. Another optional feature in the manual module is a mechanical counter.

Figure 16:
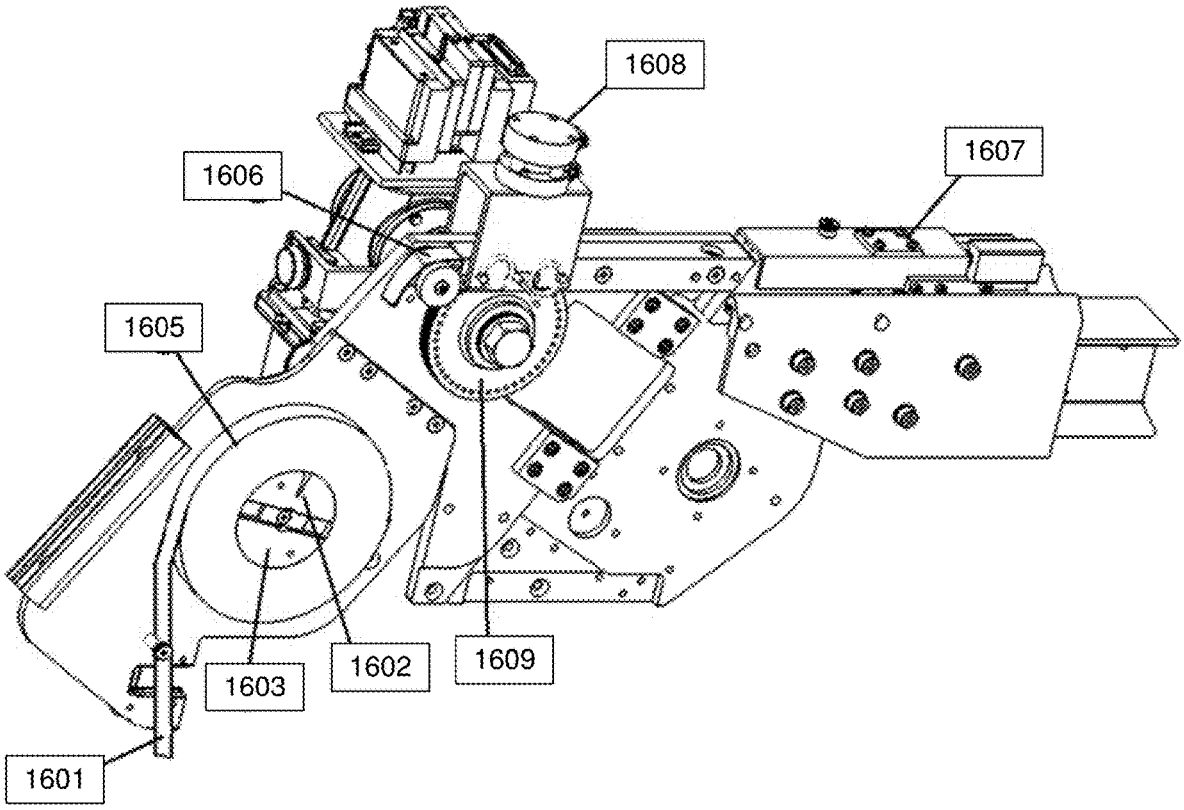
FIG. 16 illustrates a side perspective view of an automated tape dispensing module according to a particular embodiment of the invention.
Figure 16A:
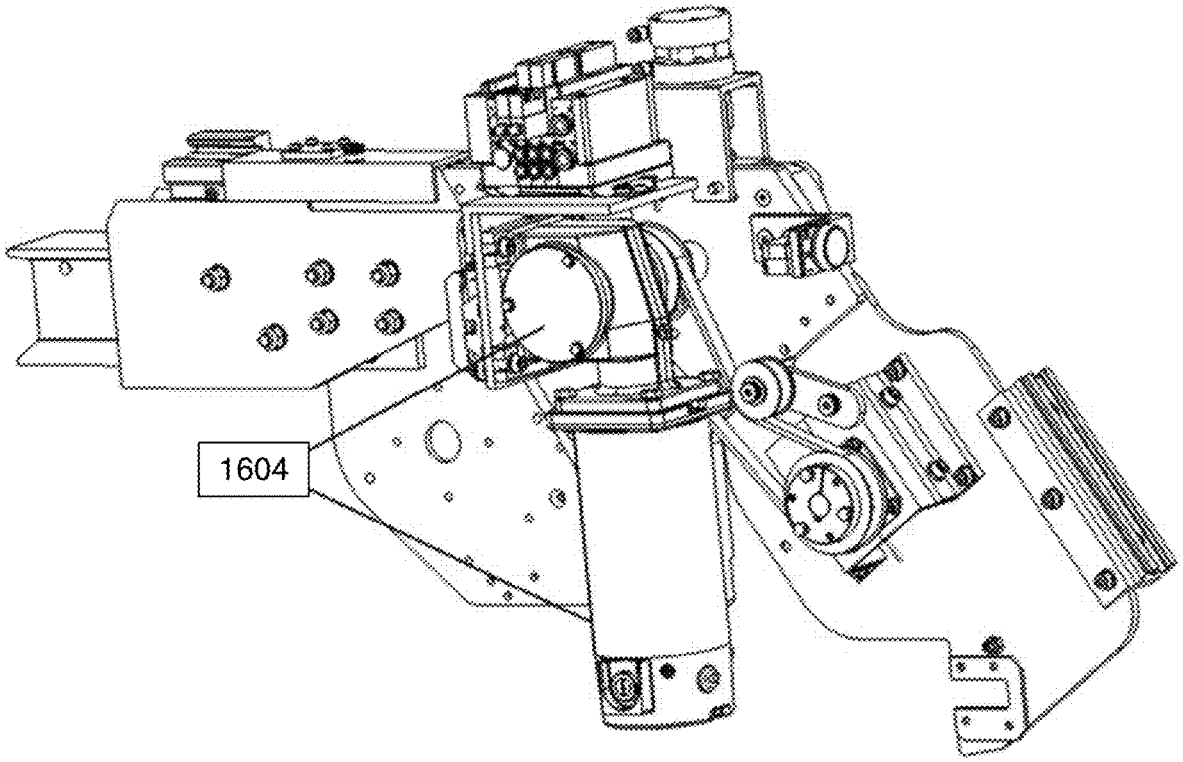
FIG. 16A illustrates a different side perspective view of the automated tape dispensing module in FIG. 16.

Referring now to FIGS. 16 and 16A, an automated module with a powered winding hub and spool (an automated unicharger) and a powered drive wheel is illustrated. While the automated module may use hand or manual spooled paper band, or a single use paper band dispensing box, in some embodiments, an automated unicharger may be included. The end of a supply of paper band 1601 is inserted into a slot 1602 in a winding hub 1603 of the unicharger. Motor 1604 (See FIG. 16A) may be actuated by, for example, sequencing push-button on a control panel to wind a coil of paper band 1605 to a predetermined length. The coil of paper band 1605 may be cut from the supply of paper band 1601. An adhesive-treated end of the paper band may be inserted into the automated module's track by inlet 1606 and may be pushed as far as view port 1607 in the track to establish a reliable starting point for subsequent length-based functions. Nip cylinder 1608 may then be enabled by, for example, a sequencing push-button on a control panel to pinch the paper band against drive wheel 1609. When an operator desires to initiate a turn-up, a motor may be actuated that rotates drive wheel 1609. The motor may drive the unicharger and drive wheel independently by, for example, clutches. Drive wheel 1609 may push the paper band through the cross-machine track across a prescribed distance to a desired position in readiness for the turn-up. When a signal is received from the paper machine or a control system, the automated drive wheel may rotate further, feeding the adhesive-laden end of the paper band into a nip between the paper machine's empty spool and its drum, which initiates the turn-up.

In a timed sequence, a brake (not shown) may be engaged to apply the necessary tension to effectuate the turn up by tearing the paper and binding it to the new spool. Finally, the system may be reset for the next turn-up cycle by, for example, pressing a sequencing button on a control panel. The automated module may also optionally include a cutting device.

Figure 17:
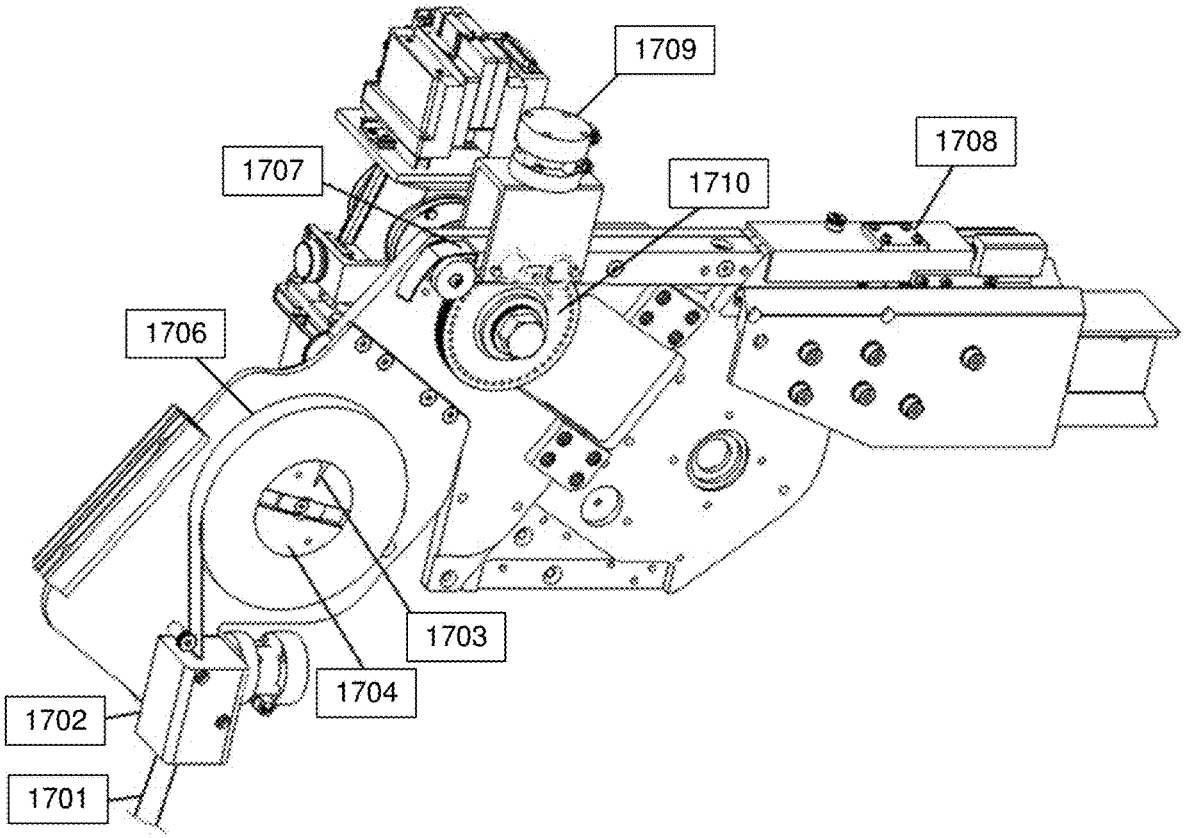
FIG. 17 illustrates a side perspective view of an automated tape dispensing module according to a particular embodiment of the invention.
Figure 17A:
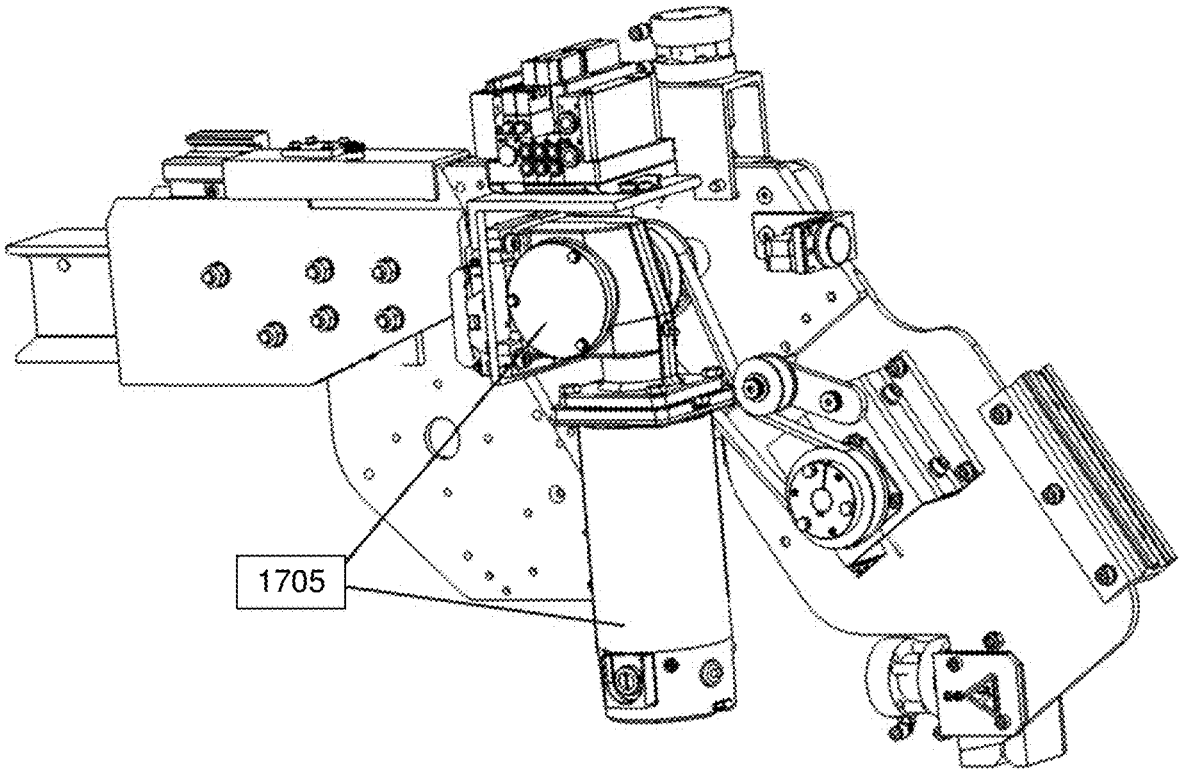
FIG. 17A illustrates a different side perspective view of the automated tape dispensing module in FIG. 17.

Referring now to FIGS. 17 and 17A, an automated module with an automated unicharger, powered drive wheel, and cutting device is illustrated. A supply of paper band 1701 may be threaded through cutter 1702 into slot 1703 in winding hub 1704. A motor 1705 (See FIG. 17A) may then be actuated by, for example, sequencing push-button on a control panel to wind a coil of paper band 1706 to a predetermined length in the unicharger. The cutter 1702 may then cut the coil of paper band 1706 from the paper band 1701 automatically. A length of adhesive may then be applied to the end of the wound paper band. This adhesive-treated end of the paper band may be inserted into the automated module's track by inlet 1707 and, in some embodiments, pushed as far as view port 1708 to establish a reliable starting point for subsequent length-based functions.

Nip cylinder 1709 may be enabled, in some embodiments by sequencing push-button on a control panel, to pinch the paper band against drive wheel 1710. To initiate a turn up, the motor 1705 may be actuated by, for example, sequencing push-button on a control panel. Motor 1705 may drive the winder and drive wheel independently by means of, for example, clutches. Drive wheel 1710 may push the paper band through a cross-machine track across a prescribed distance to a desired position to prepare for the turn-up. When a signal is received from the paper machine or a control system, the automated drive wheel may rotate further, feeding the adhesive-laden end of the paper band into a nip between the paper machine's empty spool and its drum, which initiates the turn-up. In a timed sequence, a brake (not shown) may be engaged to apply the necessary tension to effect the turn up by tearing the paper and binding it to the new spool. Finally, the system may be reset for the next turn-up cycle by, for example, pressing a sequencing button on a control panel.

Figure 18:
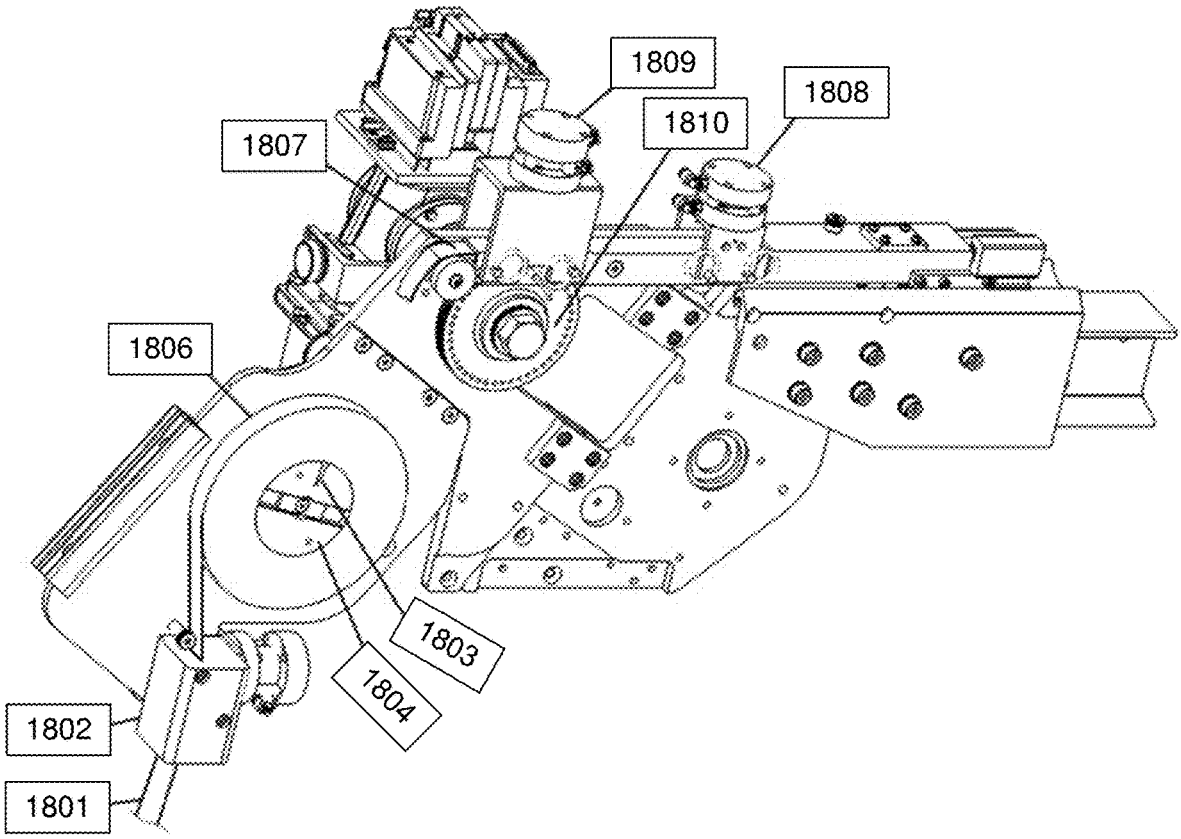
FIG. 18 illustrates a side perspective view of an automated tape dispensing module according to a particular embodiment of the invention.
Figure 18A:
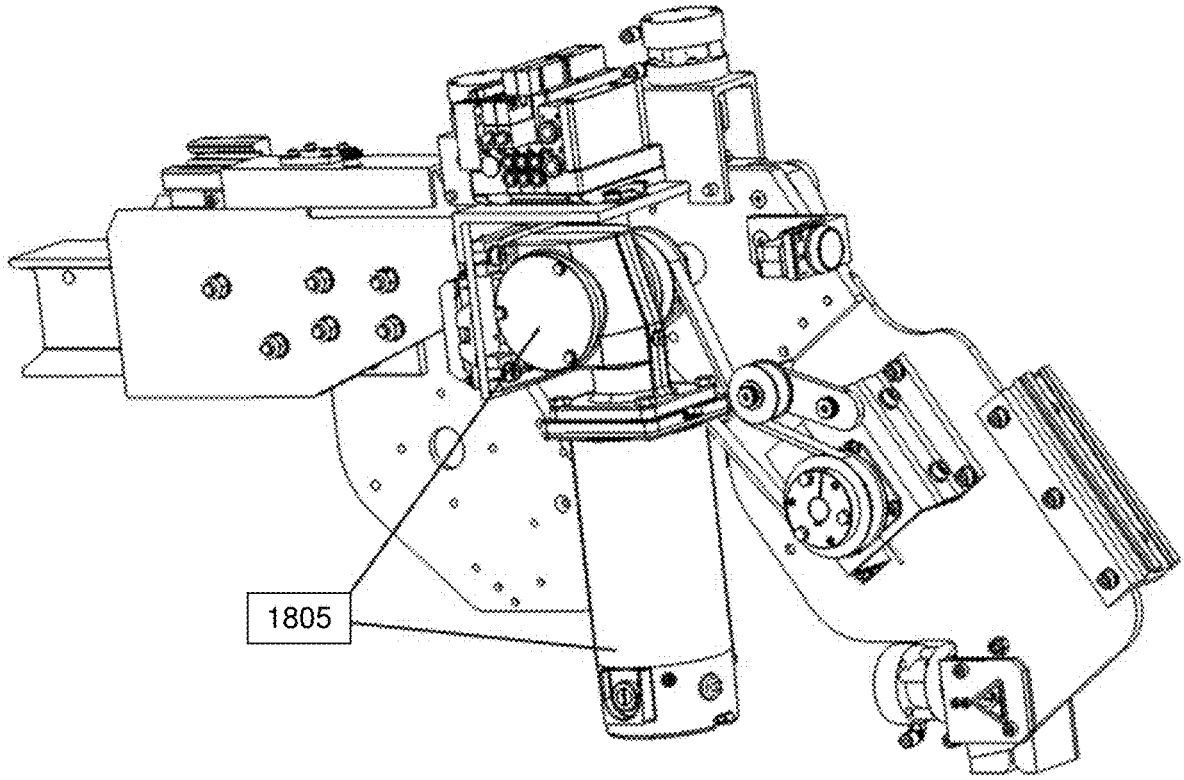
FIG. 18A illustrates a different side perspective view of the automated tape dispensing module in FIG. 18.

Referring now to FIGS. 18 and 18A, an example of an automated module with an automated unicharger, powered drive wheel, and retractable stop is shown. The end of a supply of paper band 1801 may be threaded through cutter 1802 into slot 1803 in winding hub 1804 of the unicharger. A motor 1805 (See FIG. 18A) may then be actuated by, for example, sequencing push-button on a control panel to wind a coil of paper band 1806 to a predetermined length. The module may then cut the coil of paper band 1806 from the paper band 1801 automatically. A length of adhesive may then be applied to the end of the wound paper band. This adhesive-treated end of the paper band may be inserted into the automated module's track by inlet 1807 and, in some embodiments, pushed as far as retractable stop 1808 to establish a reliable starting point for subsequent length-based functions.

In some embodiments, nip cylinder 1809 may be enabled by sequencing push-button on a control panel, to pinch the paper band against drive wheel 1810. The retractable stop 1808 may be removed from the paper band path approximately simultaneously. To initiate a turn up, the motor 1805 may be actuated by, for example, sequencing push-button on a control panel. Motor 1805 may drive the unicharger and drive wheel independently by means of, for example, clutches. Drive wheel 1810 may rotate to push the paper band through a cross-machine track across a prescribed distance to a desired position to prepare for the turn-up.

Based upon a signal received from the paper machine or a control system, the automated drive wheel may rotate further, feeding the adhesive-laden end of the paper band into a nip between the paper machine's empty spool and its drum, which initiates the turn-up. In a timed sequence, a brake (not shown) may be engaged to apply the necessary tension to effect the turn up by tearing the paper and binding it to the new spool. Finally, the system may be reset for the next turn-up cycle by, for example, pressing a sequencing button on a control panel.

As discussed above, different combinations of manual and automated modules may be used to form paper band dispensers of the invention. One example is an apparatus wherein the automated module includes a unicharger but the manual module does not. In such cases, the automated module may wind and create a paper band spool that can be transferred to the manual module before winding an additional unicharger spool for the automated module. Alternatively, the manual and automated modules may instead use a single use paper band dispensing box or a paper band that has been spooled by another method known in the art.

Figure 19:
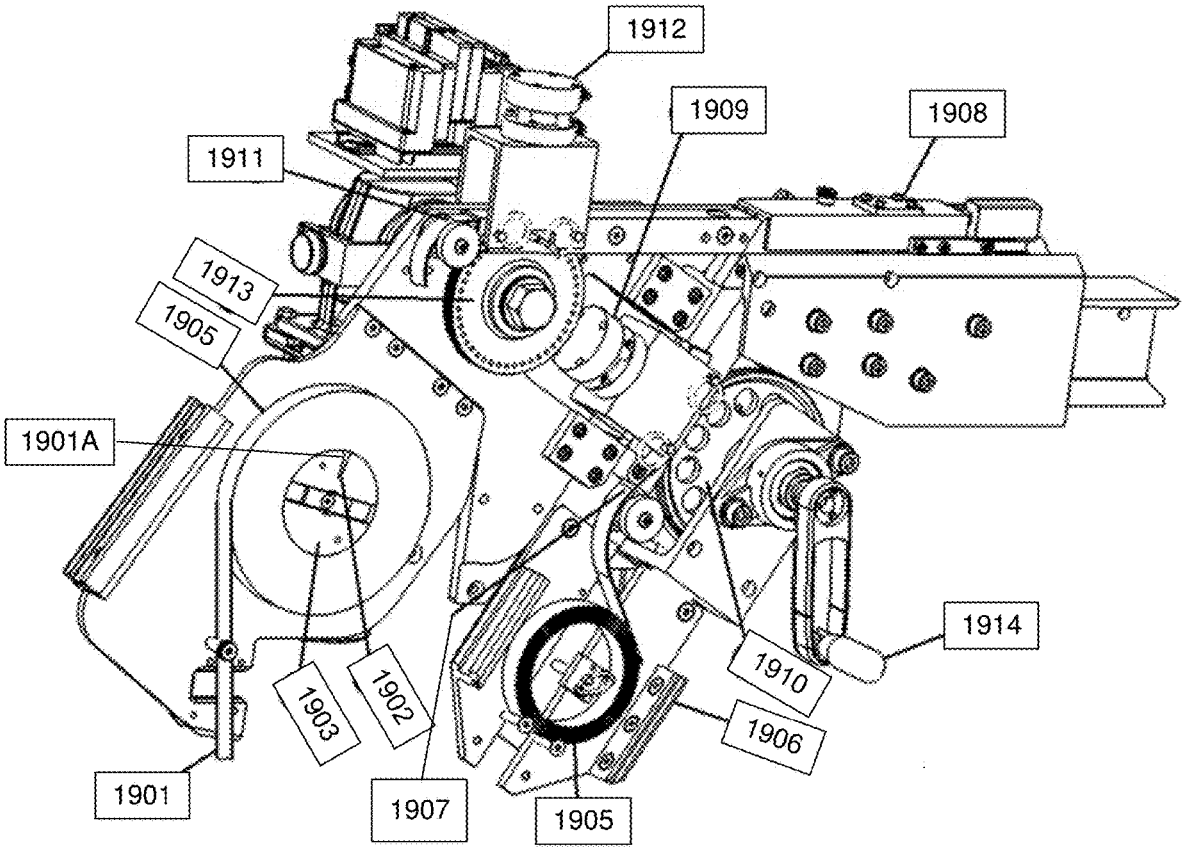
FIG. 19 illustrates a side perspective view of a paper band dispenser including an automated tape dispensing module and a manual tape dispensing module according to a particular embodiment of the invention.
Figure 19A:
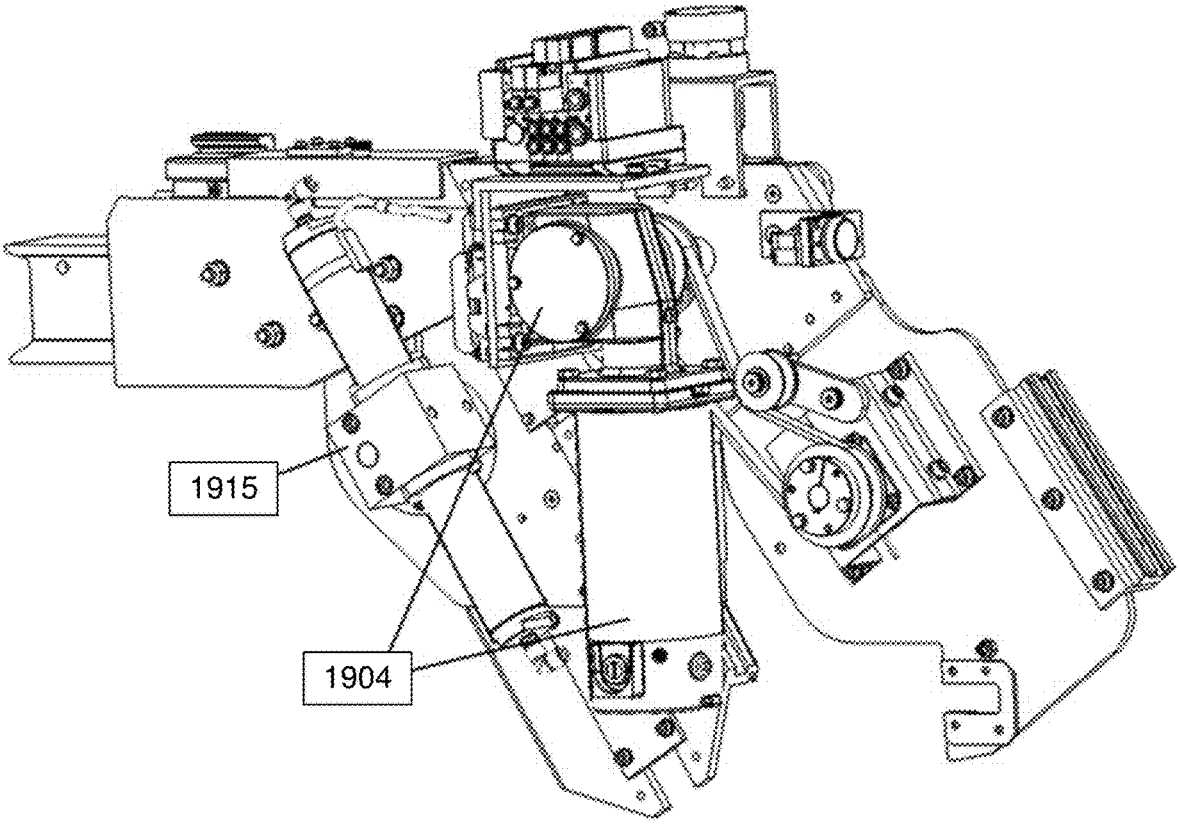
FIG. 19A illustrates a different side perspective view of the paper band dispenser in FIG. 19.

Referring ow to FIGS. 19 and 19A, a combination turn-up paper band dispenser apparatus with automated and manual modules is illustrated. FIGS. 19 and 19A show a dispenser including a powered winder, a reservoir, a powered drive wheel, a manual drive wheel, a manual view port, a manual nip cylinder, and an automated nip cylinder. A leading end 1901A of a supply of paper band 1901 may be inserted into slot 1902 in winding hub 1903. A motor 1904 (See FIG. 19A) may then be actuated by, for example, sequencing push-button on a control panel to wind a coil of paper band 1905 to a predetermined length. The coiled paper band may then be cut using a hand tool or other cutting means. The coiled paper band may then be removed from the powered hub and placed into reservoir 1906 for the manual module; in some embodiments, these steps may be repeated but the coil of paper band may be left on the winding hub of the automated module. A length of adhesive may then be applied to the ends of both coils of paper band 1903-1905. The end of the paper band from the manual module reservoir may be inserted into the inlet 1907 of the manual module track, in some embodiments as far as view port 1908, and nip cylinder 1909 may be actuated by, for example, pressing a sequencing button on a control panel to pinch the paper band against the manual module's drive wheel 1910. A feed mechanism 1915 may be used to guide the paper band.

The end of the paper band from the automated module may be inserted into the automated module track inlet 1911 and pushed as far as view port 1908. Nip cylinder 1912 may be actuated by, for example, pressing a sequencing button on a control panel to pinch the paper band against the automated module's drive wheel 1913. In some embodiments, the module may also be configured to respond to signals from the module to initiate loading through a cross-machine track across a prescribed distance to a desired position to prepare for the turn-up. Similarly, if an operator wishes to perform a turn-up with the manual module, the operator may turn hand crank 1914 of the manual module's drive wheel to load the paper band across the paper machine through a cross-machine track to a prescribed position by, for example, pressing a sequencing button on a control panel. The procedures described above for effecting turn-up with automatic or manual paper band dispensing modules may be used, as applicable, with the paper band dispensers in this embodiment.

Figure 20:
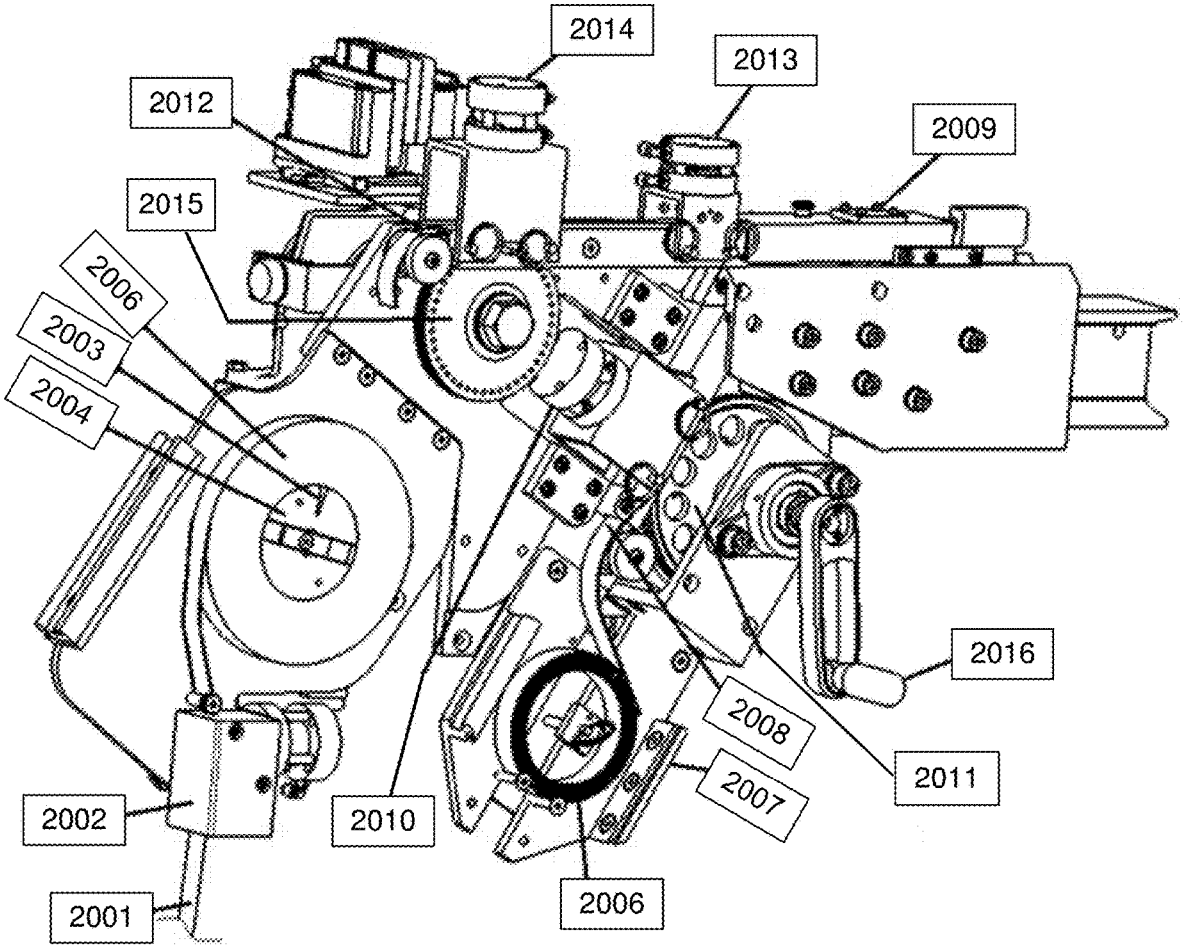
FIG. 20 illustrates a side perspective view of a paper band dispenser including an automated tape dispensing module and a manual tape dispensing module according to a particular embodiment of the invention.
Figure 20A:
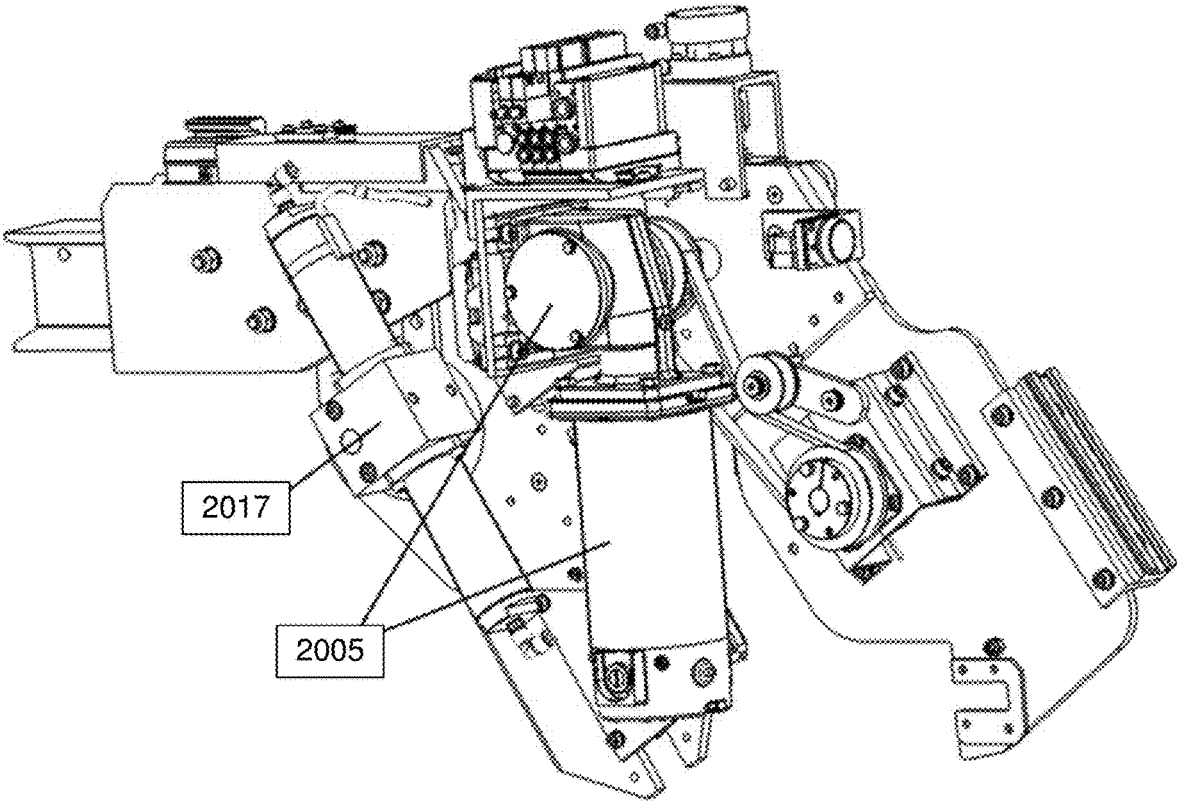
FIG. 20A illustrates a different side perspective view of the paper band dispenser in FIG. 20.

Referring now to FIGS. 20 and 20A a dispenser is illustrated with an automated unicharger, a reservoir, powered and manual drive wheels, a retractable stop, and a cutter. An optional component of a paper band dispenser including both manual and automated modules is a cutting device, such as the illustrated cutting mechanism 2002. The end of a supply of paper band 2001 may be inserted through a cutting mechanism 2002 (e.g., a pneumatic cutter) and into slot 2003 in winding hub 2004 of the automated unicharger. A motor 2005 (e.g., a DC motor; see FIG. 20A) may then be actuated by, for example, sequencing push-button on a control panel to wind a coil of paper band 2006 to a predetermined length. The coiled paper band may then be cut using the cutting mechanism 2002. The coiled paper band may then be removed from the powered hub and placed into reservoir 2007 for the manual module; in some embodiments, these steps may be repeated but the coil of paper band may be left on the winding hub of the automated module. A length of adhesive may then be applied to the ends of both coils of paper band. The end of the paper band from the manual module reservoir may be inserted into the inlet 2008 of the manual module track, in some embodiments as far as view port 2009, and nip cylinder 2010 may be actuated by, for example, pressing a sequencing button on a control panel to pinch the paper band against the manual module's drive wheel 2011.

Similarly, an end of the paper band from the automated module may be inserted into the automated module track inlet 2012 and pushed as far as retractable stop 2013. Nip cylinder 2014 may be actuated by, for example, pressing a sequencing button on a control panel to pinch the paper band against the automated module's drive wheel 2015. The retractable stop may be withdrawn, e.g., approximately simultaneously, upon actuation of the automated module's nip cylinder 2014. The automated module motor may then be actuated to rotate the automated module's drive wheel 2015 to push the paper band across the paper machine through a cross-machine track to a prescribed position. Similarly, if an operator wishes to perform a turn-up with the manual module, the operator may turn hand crank 2016 of the manual module's drive wheel 2011 to push the paper band across the paper machine through a cross-machine track to a prescribed position. The procedures described above for effecting turn-up with automatic or manual paper band dispensing modules may be used, as applicable, with the paper band dispensers in this embodiment. A feed mechanism 2017 may be used to guide the paper band.

Figure 21:
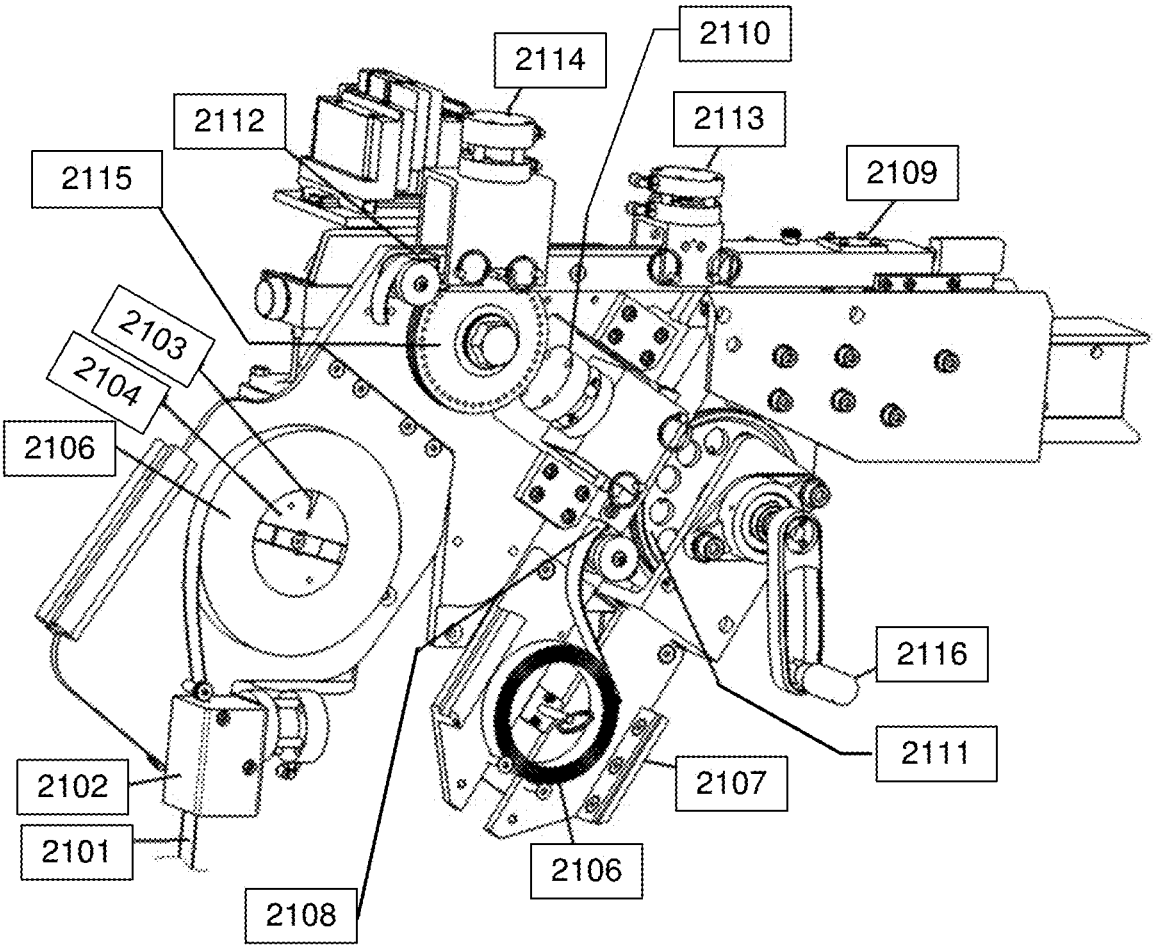
FIG. 21 illustrates a side perspective view of a paper band dispenser including an automated tape dispensing module and a manual tape dispensing module according to a particular embodiment of the invention.
Figure 21A:
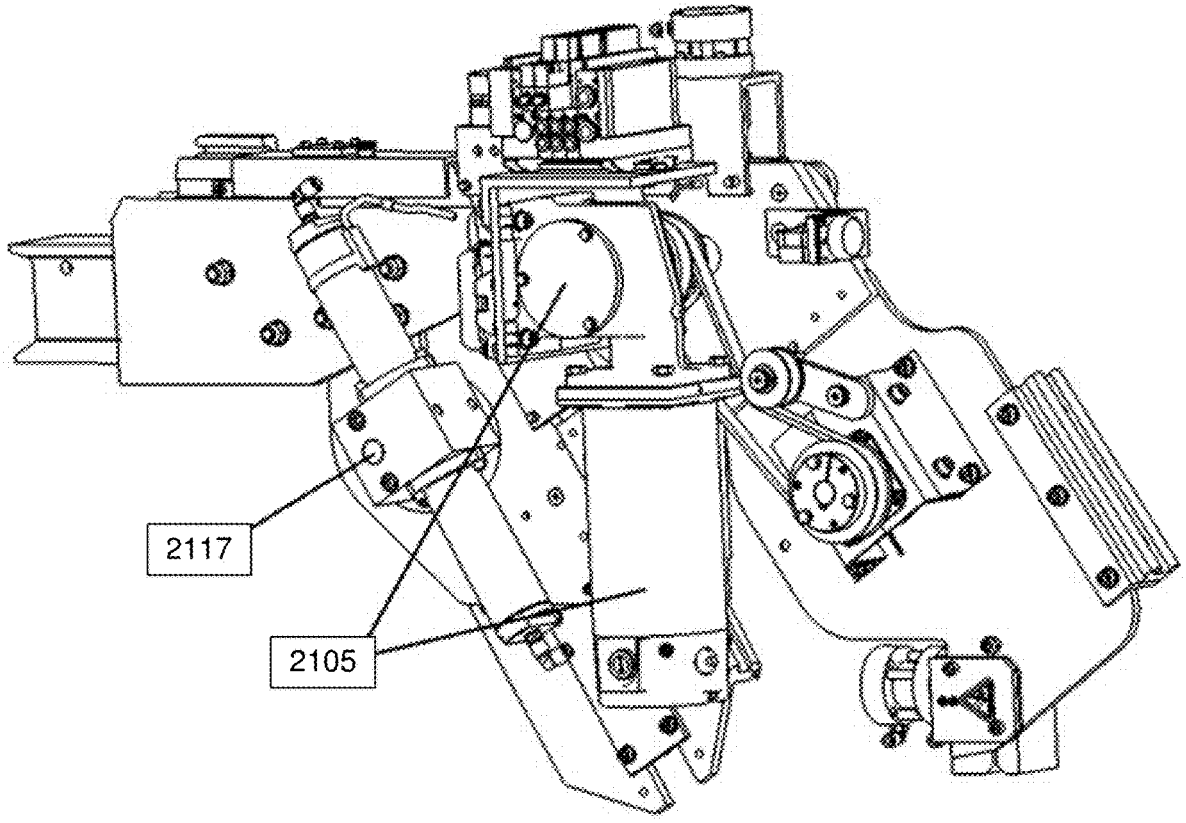
FIG. 21A illustrates a different side perspective view of the paper band dispenser in FIG. 21.

FIGS. 21 and 21A illustrate another example of a turn-up paper band dispenser apparatus with automated and manual modules. Specifically, the paper band dispenser comprises an automated unicharger, a reservoir, a cutting mechanism, manual and powered drive wheels, and a retractable stop. The end of a supply of paper band 2101 may be inserted through a cutting mechanism 2102 and into slot 2103 in winding hub 2104. A motor 2105 (FIG. 21A) may then be actuated by, for example, sequencing push-button on a control panel to wind a coil of paper band 2106 to a predetermined length. The coiled paper band may then be cut using cutting mechanism 2102. The coiled paper band may then be removed from the powered hub and placed into reservoir 2107 for the manual module; in some embodiments, these steps may be repeated but the coil of paper band may be left on the winding hub of the automated module. A length of adhesive may then be applied to the ends of both coils of paper band.

An end of the paper band from the manual module reservoir may be inserted into the inlet 2108 of the manual module track, in some embodiments as far as view port 2109, and nip cylinder 2110 may be actuated by, for example, pressing a sequencing button on a control panel to pinch the paper band against the manual module's drive wheel 2111. Similarly, an end of the paper band from the automated module may be inserted into the automated module track inlet 2112 and pushed as far as retractable stop 2113. A second nip cylinder 2114 may be actuated by, for example, pressing a sequencing button on a control panel to pinch the paper band against the automated module's drive wheel 2115. The retractable stop may be withdrawn approximately simultaneously upon actuation of the second nip cylinder 2114. The automated module's motor may then be actuated to rotate the automated module's drive wheel to load the paper band across the paper machine through a cross-machine track to a prescribed position.

If an operator wishes to perform a turn-up with the manual module, the operator may turn hand crank 2116 of the manual module's drive wheel to load the paper band across the paper machine through a cross-machine track to a prescribed position. The procedures described above for effecting turn-up with automatic or manual paper band dispensing modules may be used, as applicable, with the paper band dispensers in this embodiment. A feed mechanism 2017 may be used to guide the paper band.

Figure 22:
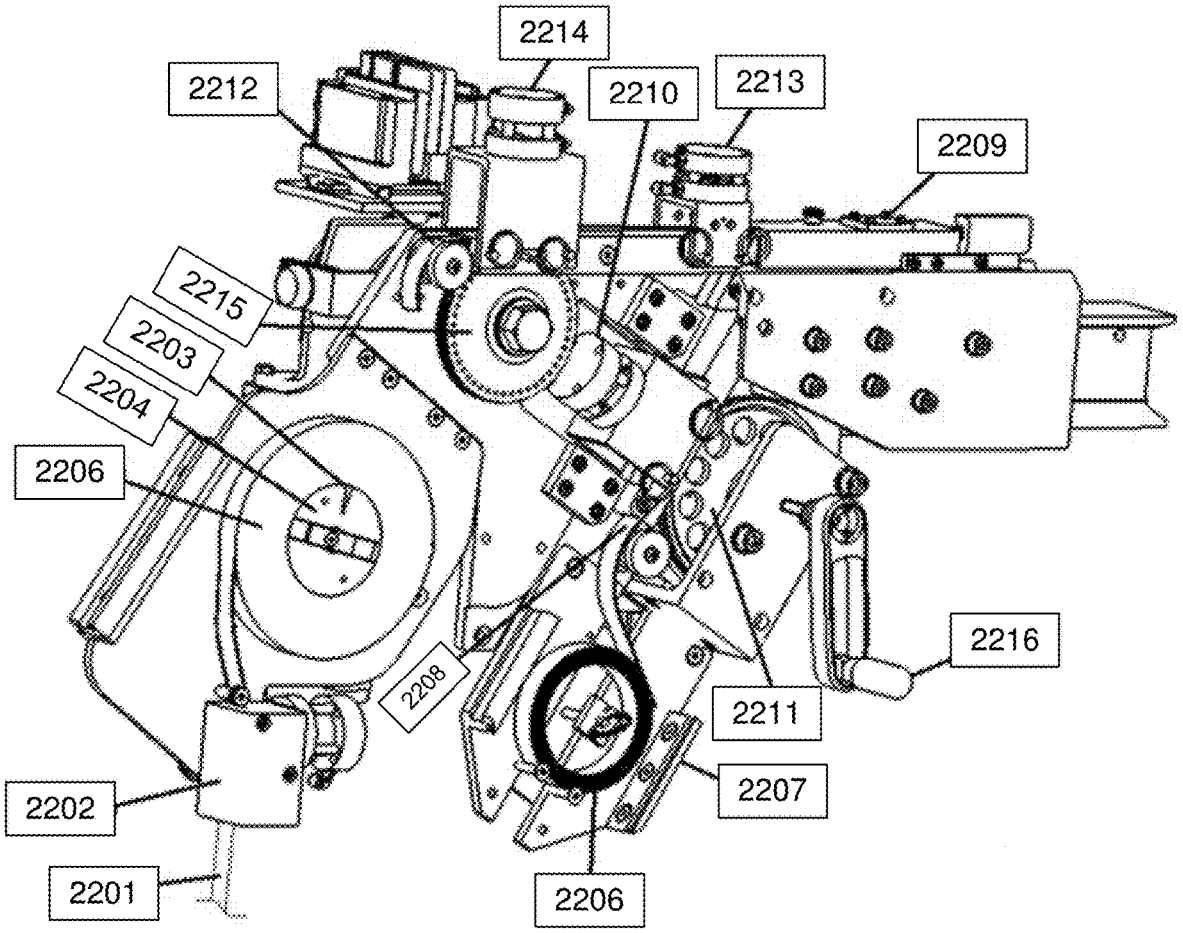
FIG. 22 illustrates a side perspective view of a paper band dispenser including an automated tape dispensing module and a manual tape dispensing module according to a particular embodiment of the invention.
Figure 22A:
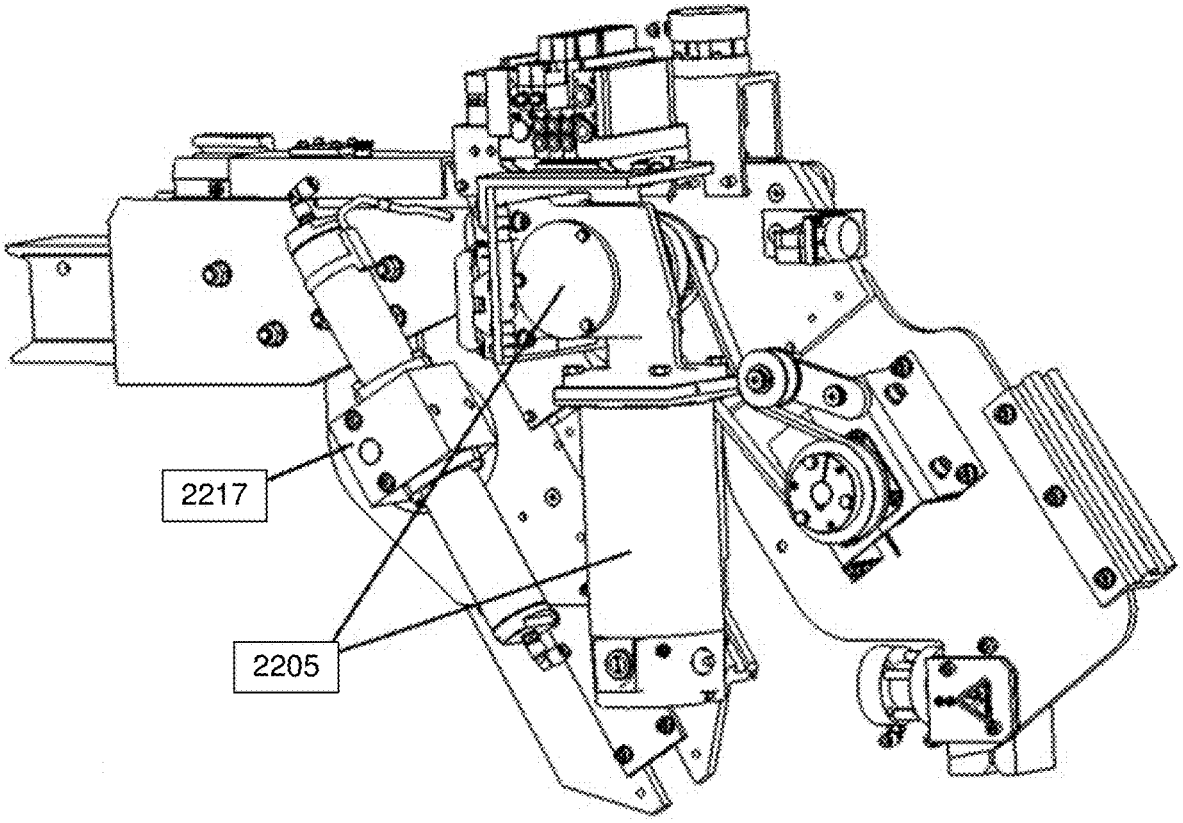
FIG. 22A illustrates a different side perspective view of the paper band dispenser in FIG. 22.

FIGS. 22 and 22A show an additional model of a turn-up paper band dispenser apparatus with automated and manual modules that includes optional features such as a mechanical counter. Specifically, the automated/manual apparatus comprises an automated unicharger, a reservoir, a cutting mechanism, powered and manual drive wheels, a retractable stop, and a mechanical counter. The end of a supply of paper band 2201 may be inserted through a cutting mechanism 2202 and into slot 2203 in winding hub 2204 of the unicharger. A motor 2205 (See FIG. 22A) may then be actuated by, for example, sequencing push-button on a control panel to wind a coil of paper band 2206 to a predetermined length. The coiled paper band may then be cut using cutting mechanism 2202. The coiled paper band may then be removed from the powered hub and placed into reservoir 2207 for the manual module; in some embodiments, these steps may be repeated but the coil of paper band may be left on the winding hub of the automated module. A length of adhesive may then be applied to the ends of both coils of paper band. The end of the paper band from the manual module reservoir may be inserted into the inlet 2208 of the manual module track, in some embodiments as far as view port 2209, and nip cylinder 2210 may be actuated by, for example, pressing a sequencing button on a control panel to pinch the paper band against the manual module's drive wheel 2211. Similarly, an end of the paper band from the automated module may be inserted into the automated module track inlet 2212 and pushed as far as retractable stop 2213. Nip cylinder 2214 may be actuated by, for example, pressing a sequencing button on a control panel to pinch the paper band against the automated module's drive wheel 2215. The retractable stop may be withdrawn approximately simultaneously upon actuation of the second nip cylinder 2214. The automated module's motor may then be actuated to rotate the automated module's drive wheel 2215 to load the paper band across the paper machine through a cross-machine track to a prescribed position.

If an operator wishes to perform a turn-up with the manual module, the operator may turn hand crank 2216 of the manual module's drive wheel 2211 to load the paper band across the paper machine through a cross-machine track to a prescribed position. The procedures described above for effecting turn-up with automatic or manual paper band dispensing modules may be used, as applicable, with the paper band dispensers in this embodiment. A feed mechanism 2217 may be used to guide the paper band.

Figure 23:
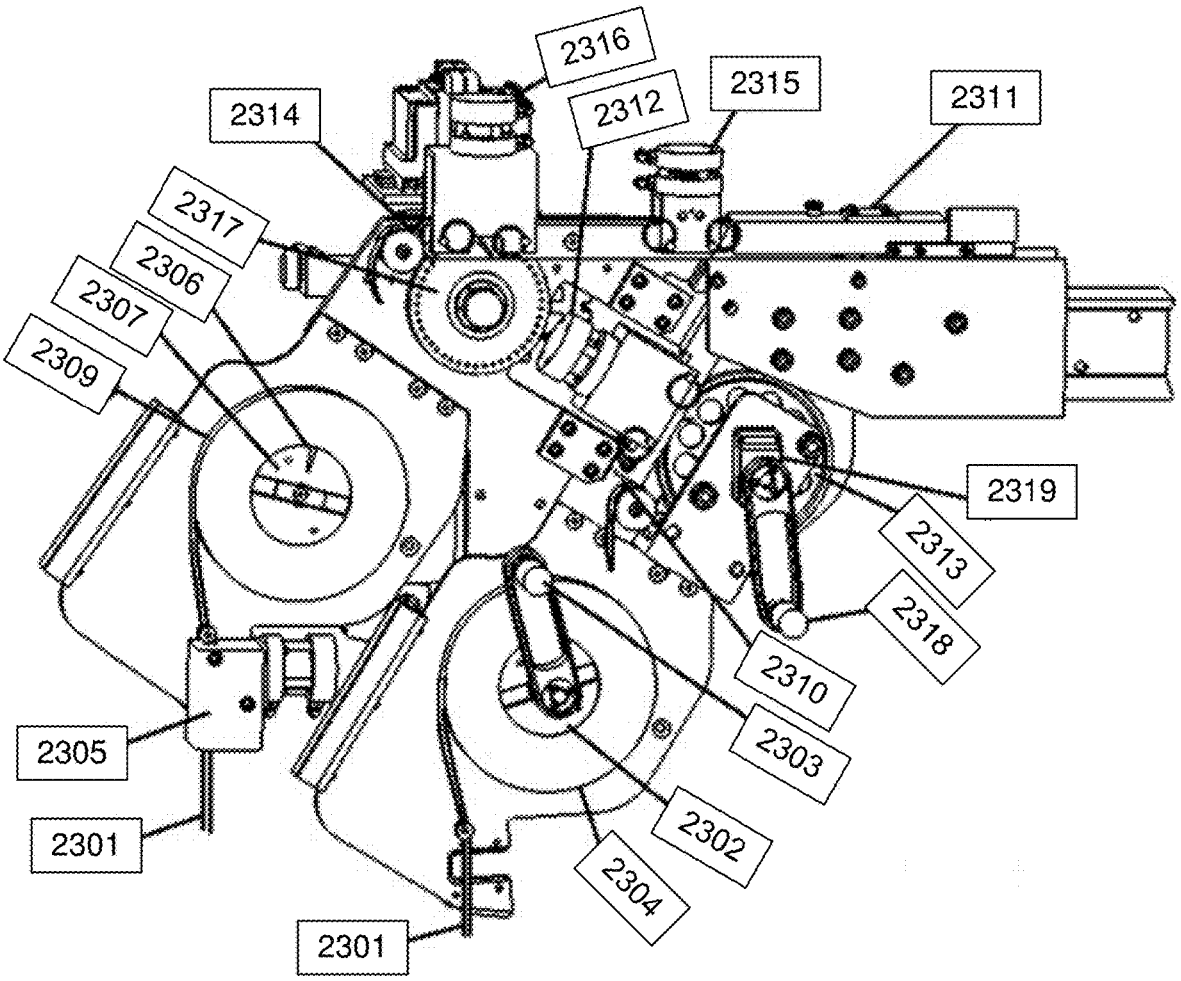
FIG. 23 illustrates a side perspective view of a paper band dispenser including an automated tape dispensing module and a manual tape dispensing module according to a particular embodiment of the invention.
Figure 23A:
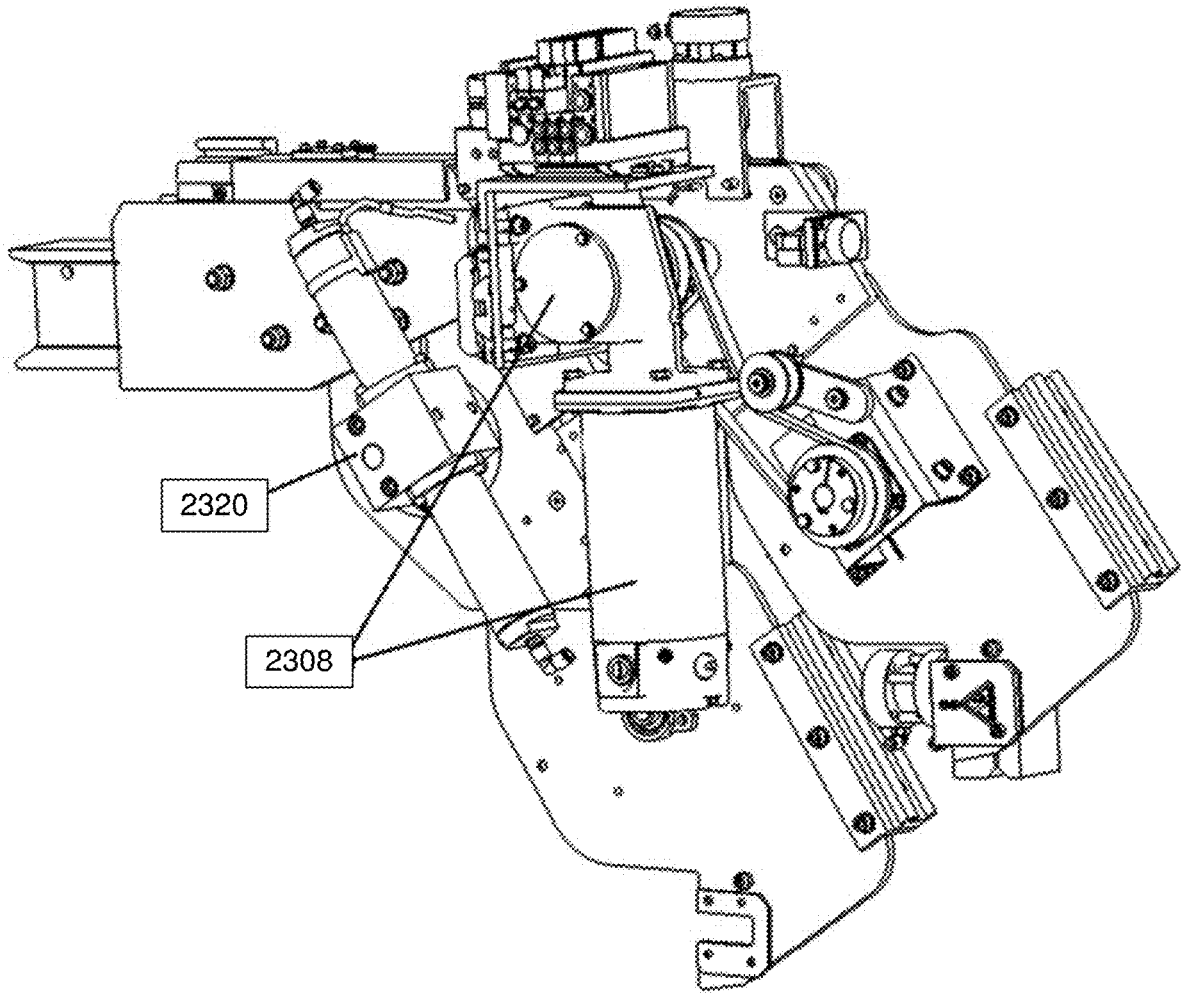
FIG. 23A illustrates a different side perspective view of the paper band dispenser in FIG. 23.

FIGS. 23 and 23A show another configuration of a turn-up paper band dispenser apparatus having automated and manual modules. Specifically, the paper band dispensing apparatus comprises an automated unicharger, a manual unicharger, a cutting mechanism, powered and manual drive wheels, and a retractable stop. The end of a supply of paper band 2301 may be inserted into a slot in the manual module's winding hub 2302 of the unicharger. Hand crank 2303 may be engaged into the winding hub of the manual unicharger and turned to wind a desired length of paper band into a coil 2304; the paper band may then be cut with a hand tool. The paper band may then be threaded through cutter 2305 into slot 2306 of powered winding hub 2307.

A motor 2308 (See FIG. 23A) may then be actuated by, for example, sequencing push-button on a control panel to wind a coil of paper band 2309 to a predetermined length. The coiled paper band may then be automatically cut by cycling the cutting mechanism. A length of adhesive may then be applied to the ends of both coils of paper band. The end of the paper band from the manual module reservoir may be inserted into the inlet 2310 of the manual module track, in some embodiments as far as view port 2311, and nip cylinder 2312 may be actuated by, for example, pressing a sequencing button on a control panel to pinch the paper band against the manual module's drive wheel 2313.

The end of the paper band from the automated module may be inserted into the automated module track inlet 2314 and pushed as far as retractable stop 2315. Nip cylinder 2316 may be actuated by, for example, pressing a sequencing button on a control panel to pinch the paper band against the automated module's drive wheel 2317. The retractable stop may be withdrawn approximately simultaneously upon actuation of the automated module's nip cylinder 2316. The automated module's motor may then be actuated to rotate the automated module drive wheel 2317 to load the paper band across the paper machine through a cross-machine track to a prescribed position.

If an operator wishes to perform a turn-up with the manual module, the operator may turn hand crank 2318 of the manual module's drive wheel 2313 to load the paper band across the paper machine through a cross-machine track to a prescribed position. The procedures described above for effecting turn-up with automatic or manual paper band dispensing modules may be used, as applicable, with the paper band dispensers in this embodiment. A feed mechanism 2320 may be used to guide the paper band. A brake mechanism 2319 may prevent free spinning of a handle 2318 during a turn up which may be hazardous to an operator.

Figure 24:
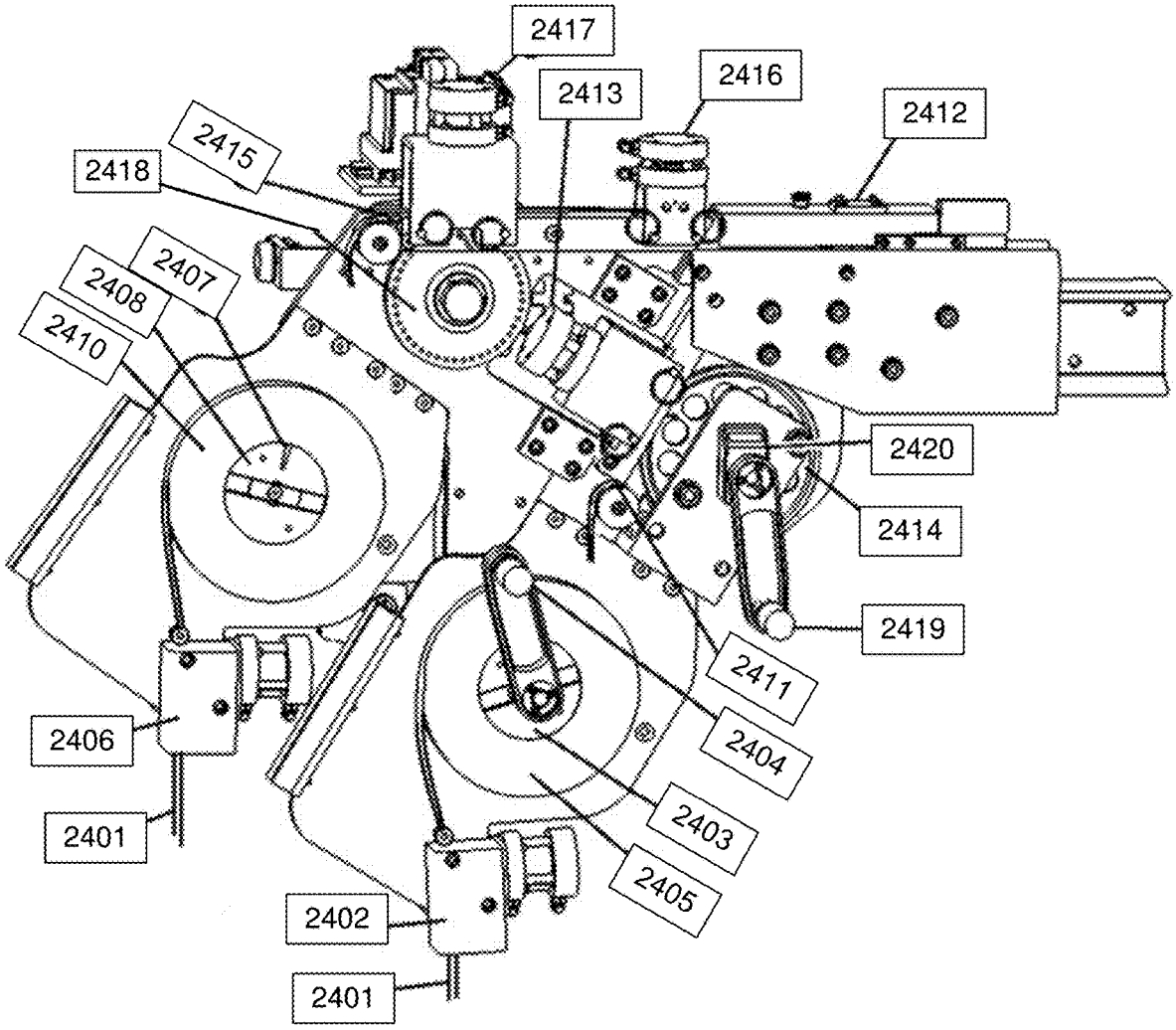
FIG. 24 a side perspective view of a paper band dispenser including an automated tape dispensing module and a manual tape dispensing module according to a particular embodiment of the invention.
Figure 24A:
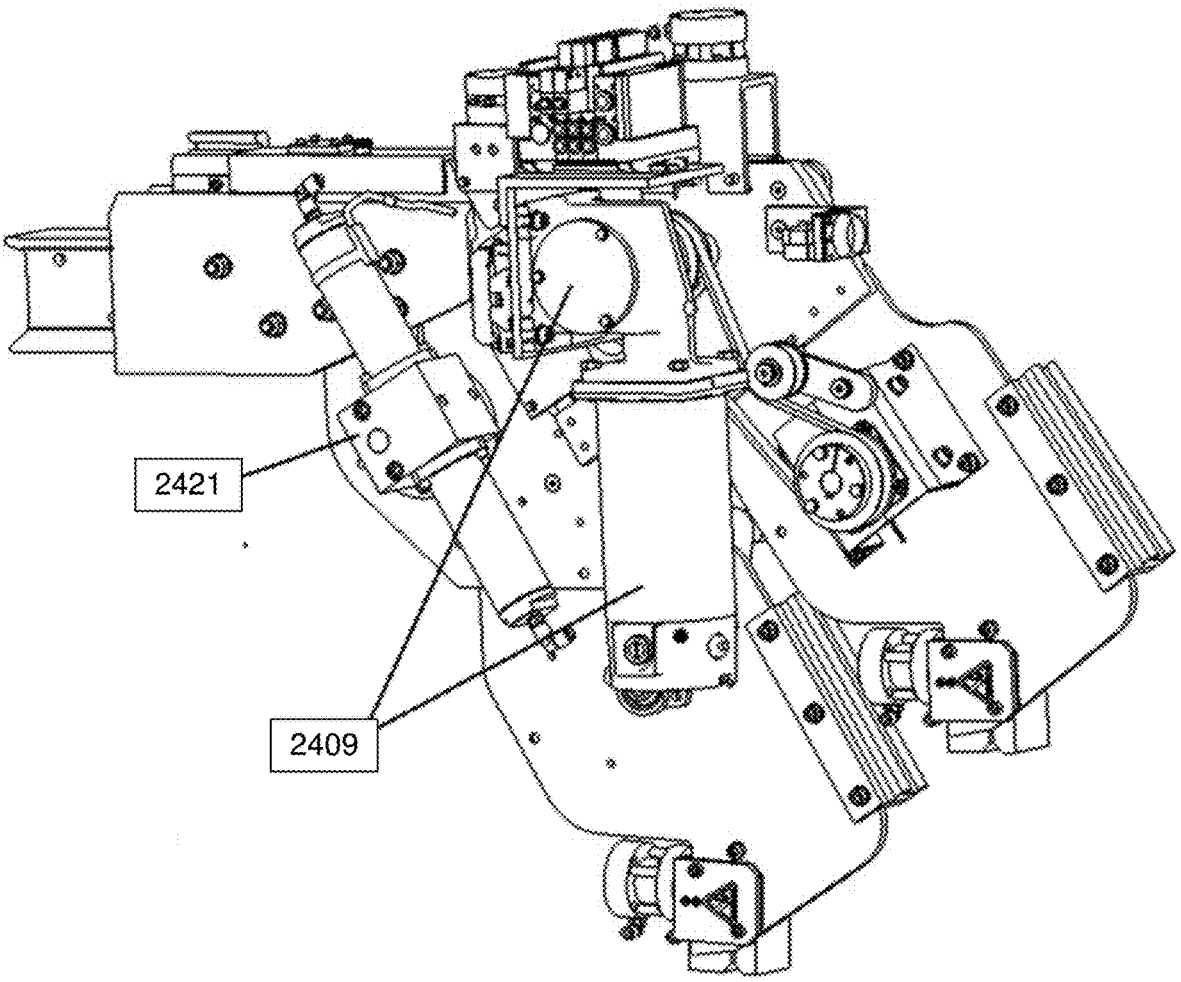
FIG. 24A illustrates a different side perspective view of the paper band dispenser in FIG. 24.

Finally, FIGS. 24 and 24A illustrate an alternative model of a turn-up paper band dispenser with automated and manual modules. Specifically, the dispenser comprises an automated unicharger, a manual unicharger, cutting mechanisms, powered and a manual drive wheels, and a retractable stop. The end of a supply of paper band 2401 may be inserted through cutting mechanism 2402 and into a slot in the module's winding hub 2403. Hand crank 2404 may be engaged into the winding hub and turned to wind a desired length of paper band into a coil 2405; the paper band may then be cut by actuating cutting mechanism 2402 for the manual module by, for example, pressing a sequencing button on a control panel. The paper band may then be threaded through a cutter associated with the automated module 2406 and inserted into slot 2407 of powered winding hub 2408. A motor 2409 (See FIG. 24A) may then be actuated by, for example, sequencing push-button on a control panel to wind a coil of paper band 2410 to a predetermined length. The coiled paper band may then be automatically cut by cycling the cutting mechanism. A length of adhesive may then be applied to the ends of both coils of paper band. The end of the paper band from the manual module reservoir may be inserted into the inlet 2411 of the manual module track, in some embodiments as far as view port 2412, and nip cylinder 2413 may be actuated by, for example, pressing a sequencing button on a control panel to pinch the paper band against the manual module's drive wheel 2414.

The end of the paper band from the automated module may be inserted into the automated module track inlet 2415 and pushed as far as retractable stop 2416. An automated module's 2417 may be actuated by, for example, pressing a sequencing button on a control panel to pinch the paper band against the automated module's drive wheel 2418. The retractable stop may be withdrawn approximately simultaneously upon actuation of the automated module's nip cylinder 2417. The automated module's motor may then be actuated to rotate the automated module drive wheel 2418 to load the paper band across the paper machine through a cross-machine track to a prescribed position.

If an operator wishes to perform a turn-up with the manual module of the machine, the operator may turn hand crank 2419 of the manual module's drive wheel 2414 to load the paper band across the paper machine through a cross-machine track to a prescribed position. The procedures described above for effecting turn-up with automatic or manual paper band dispensing modules may be used, as applicable, with the paper band dispensers in this embodiment. A feed mechanism 2421 may be used to guide the paper band. A brake mechanism 2420 may prevent free spinning of a handle 2318 during a turn up which may be hazardous to an operator.

Figure 25:
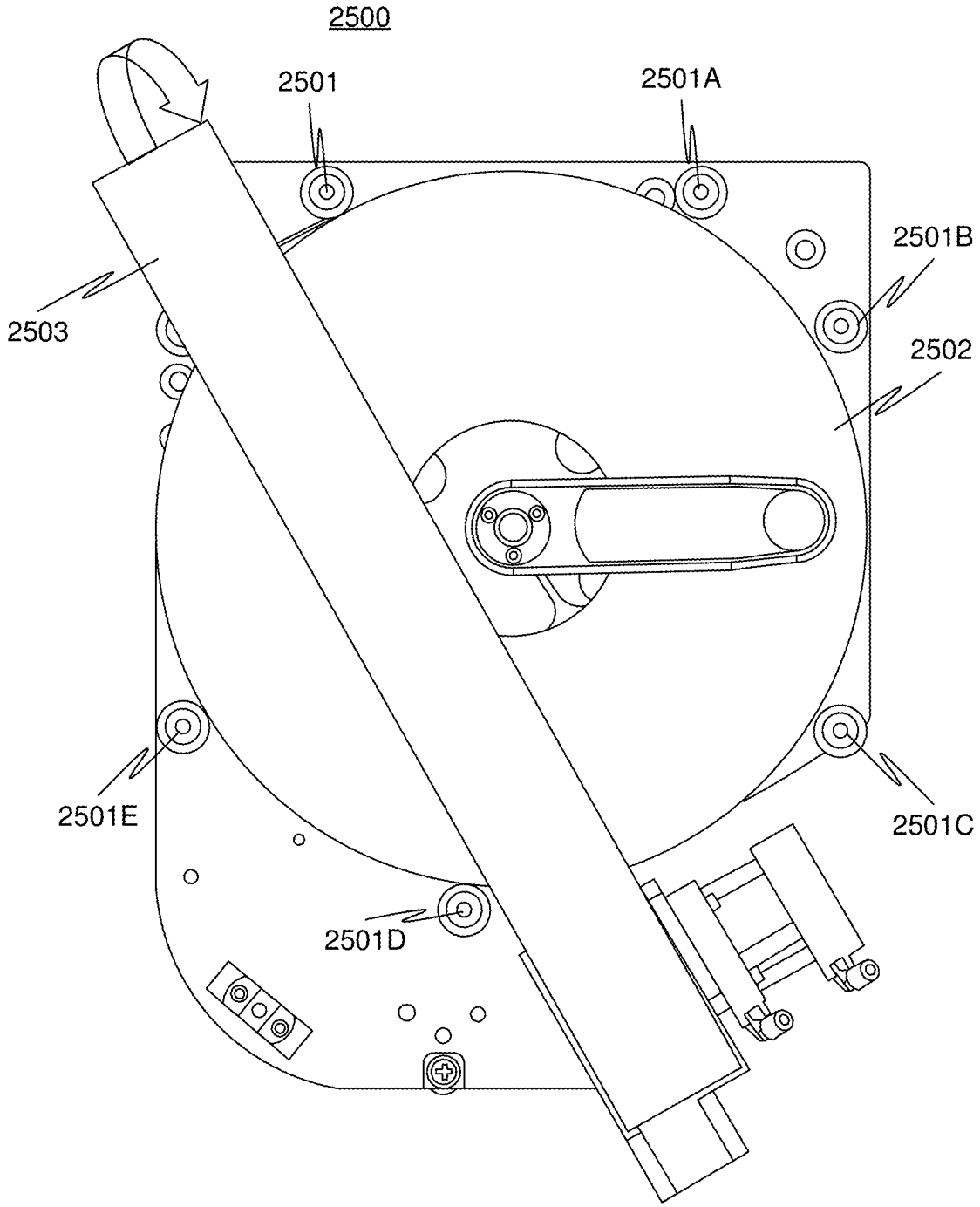
FIG. 25 illustrates a paper band coil keeper according to a particular embodiment of the invention.
Figure 25A:
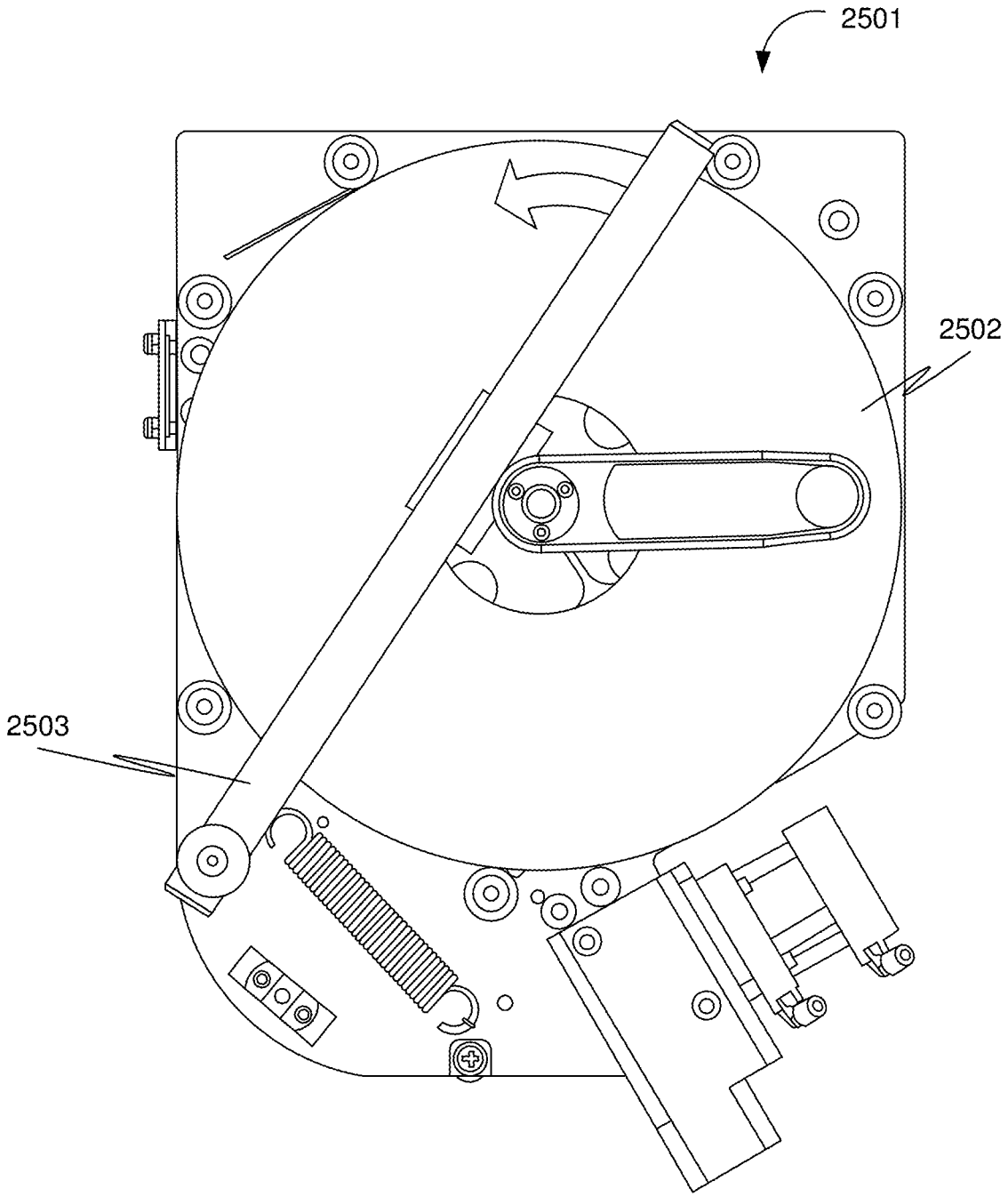
FIG. 25A illustrates a paper band coil keeper according to another embodiment of the invention.

Referring to FIGS. 25 and 25A, paper band reservoir or keeper is illustrated. A reservoir 2500 (as illustrated the reservoir is part of a manual unicharger) is suitable to contain paper band coil 2502 within a series of paper band coil rests 2501-2501E. The paper band rests 2501-2501E provide physical support for the paper band coil 2502 and allow for rotational movement of the paper band coil 2502. In some embodiments, the paper band rests 2501-2501E include rollers, bearings, wheels, or other low friction device to assist in rotational movement of the paper band coil 2502. A plurality of paper band rests 2501-2501E may be optimized for freedom of rotational movement during deployment of the paper band coil 2502 into a track across the paper machine prior to a turn up process.

In order to ensure that the paper band coil 2502 remains on the unicharger winding hub, a strap or bar, also referred to as a paper band coil keeper 2503, may be secured across at least part of the paper band coil 2502. The paper band coil keeper 2503 may or may not touch a portion of the paper band coil 2502. The paper band coil keeper 2503 may be configured to be released or removed to allow for removal of a paper band coil 2502. As shown in FIG. 25A, in one example, the paper band coil keeper 2503 is removed by bending the paper band coil keeper 2503 toward the user to allow for room to remove the paper band coil 2502. As shown in FIG. 25A, in other cases, the paper band coil keeper 2503 may be rotated or pivoted (in this case counterclockwise) to allow for room to remove the paper band coil 2502. The paper band coil keeper 2503 may be made of any suitable shape or material including metal, fabric, and the like.

Figure 26:
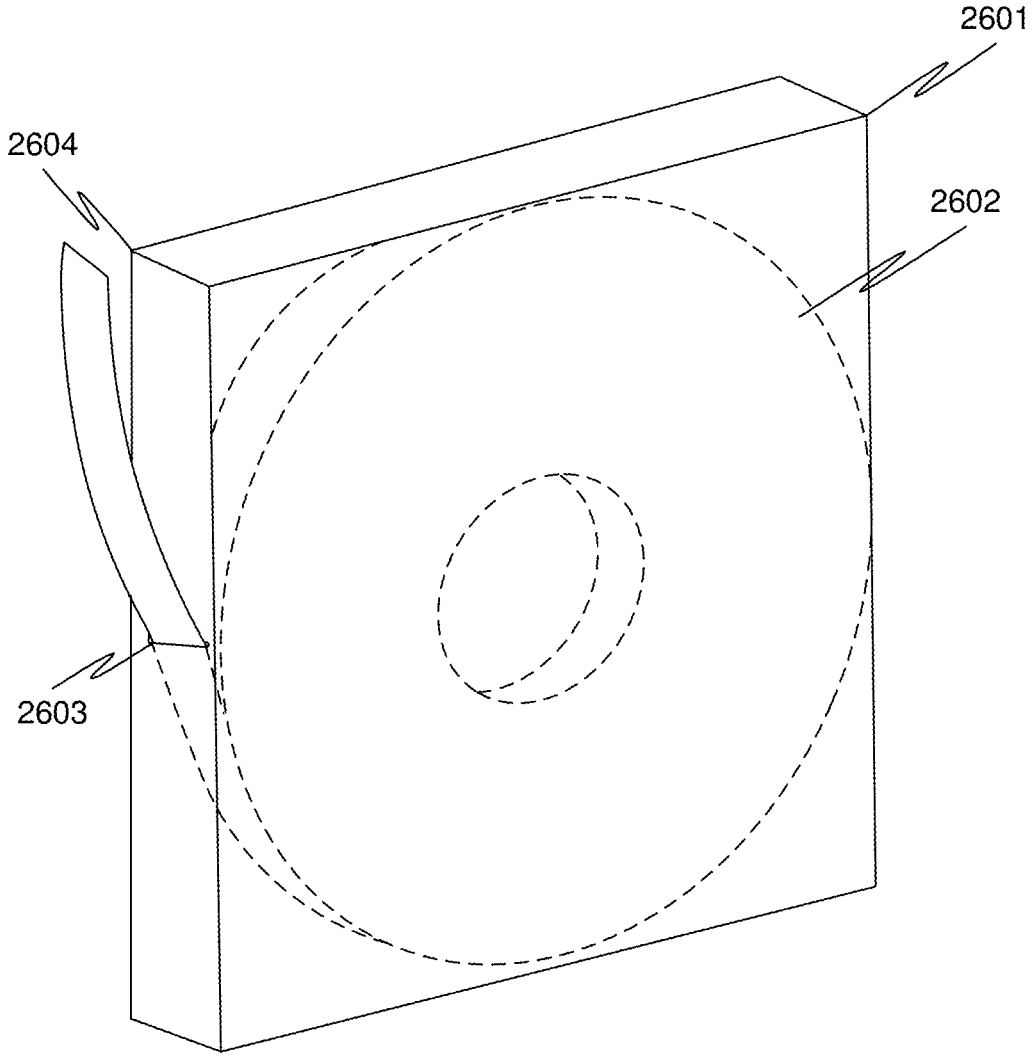
FIG. 26 illustrates a single use paper band dispenser box according to an embodiment of the invention.

Referring now to FIG. 26, some embodiments of a single-use paper band dispensing box is illustrated. The single-use paper band dispensing boxes, and such single-use paper band dispensing boxes may be used with an automatic or manual module described herein. Such single-use boxes include a length of paper band sufficient to perform one turn-up cycle in a paper-web turn-up procedure. In some embodiments of the invention, the box includes a hollow cavity; a coil of paper band housed within the hollow cavity, the paper band including a first face and a second face and a predetermined length suitable for a single turn-up procedure for slicing a paper roll on a paper machine, the paper band further including a proximal end and a distal end; and a slot on the box through which an proximal end of the coil of paper band may be fed to allow the end to pass outside the box.

A single-use box 2601 is proportioned to enclose paper band coil 2602 in a hollow cavity within single-use box 2601. In particular embodiments, paper band coil 2602 is a flat, ribbon-wound coil. Moreover, in some embodiments, the base length of single-use box 2601 (i.e., the distance between its sidewalls) is slightly longer (e.g., less than 2%, 5% or 10% longer) than the width of the paper band coil 2602 to prevent the paper band coil 2602 from telescoping or tangling in transit, storage, and use.

Single-use box 2601 may include slot 2603 through which the paper band coming off paper band coil 2602 may exit. This may allow access to the paper band without opening single-use box 2601. The slot 2603 may be at any suitable position on the sidewall including the top, bottom, or substantially at the midpoint of the sidewall as shown. In some embodiments, single-use box 2601 may further include a door or some other mechanism to allow for retrieval of an end of paper band coil 2602 in case an end is no longer accessible outside slot 2603. This end of paper band coil 2602 may be secured against snagging or unintentional pulling out from the box by tucking it into box edge 2604 or other similar means. The end may also be secured to the outside of the box by an adhesive, pin, band, or other securing means.

The hollow cavity in single-use box 2601 may take any desirable shape. For example, in some embodiments, the hollow cavity may be a quadrilateral of sufficient size to inscribe paper band coil 2602 within it. The hollow cavity may have space around its corners that is unoccupied by paper band coil 2602 to allow pins, nails, or other securing means to pass through the hollow cavity. The hollow cavity may include a lubricant, an adhesive applicator, or other useful apparatus. In some embodiments, single-use box 2601 may include a means of ingress into the hollow cavity for quality control purposes with respect to issues that may arise with the dispensing of paper band coil 2602.

Figure 27:
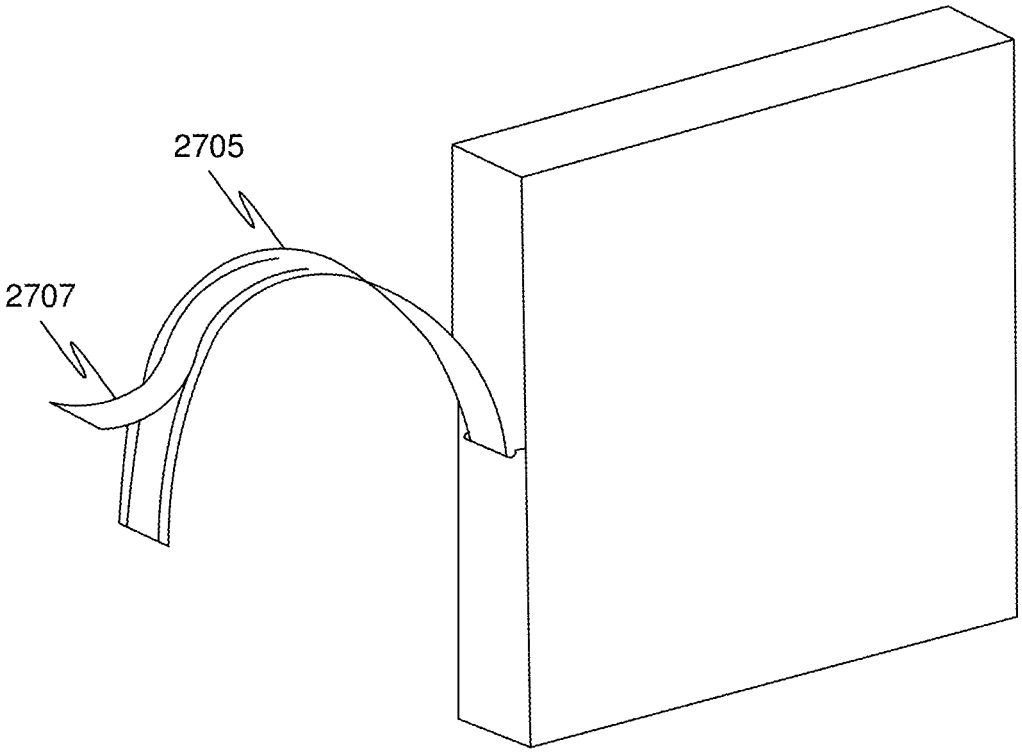
FIGS. 27 and 27A illustrate that adhesive may be applied to either side of the paper band in a single use tape dispenser box according to an embodiment of the invention.
Figure 27A:
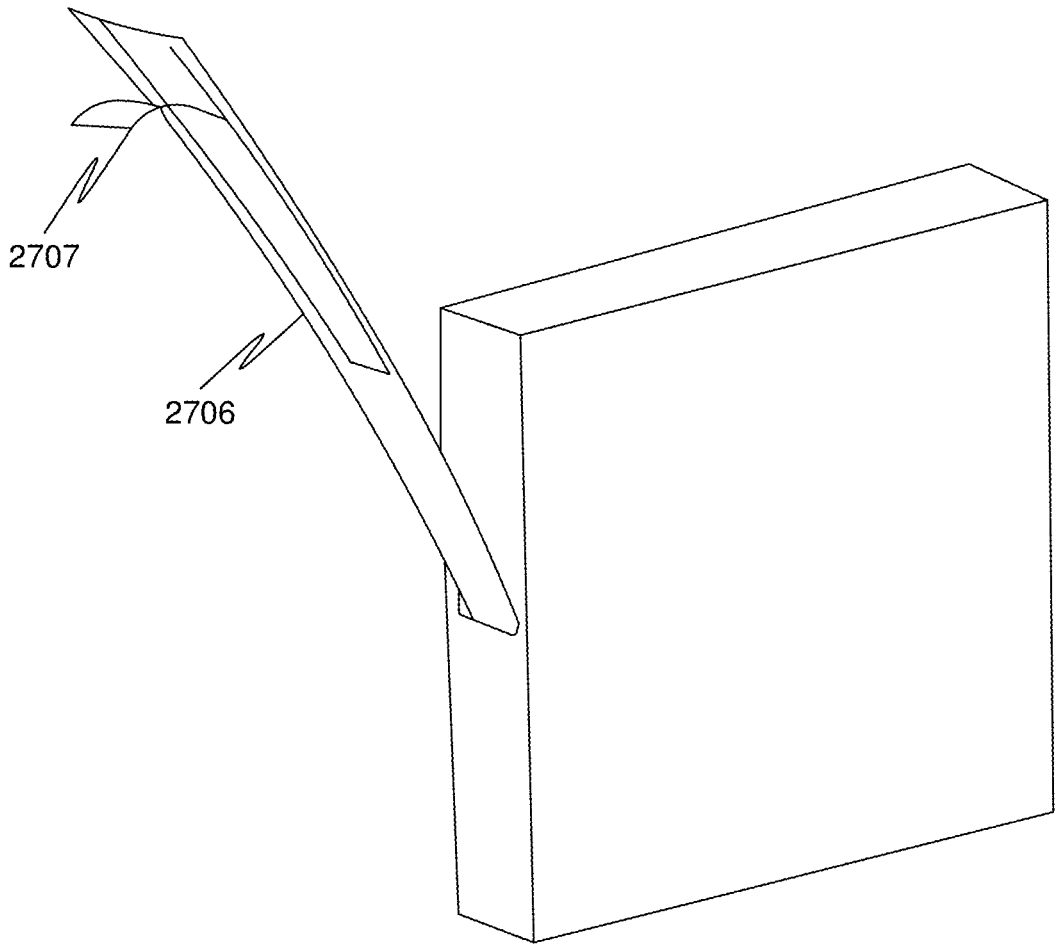

Referring now to FIGS. 27 and 27A, particular adhesive application methodologies are shown. The method of applying adhesive may vary depending on the configuration of the paper band dispensing apparatus used. Adhesive may be applied to the exposed inner face 2705 or outer face 2706 of the paper band. The face on which the adhesive may be applied may be based on the configuration of a particular module. In some embodiments, no adhesive liner 2707 is used. Furthermore, in some embodiments, the adhesive discussed in connection with FIGS. 27A and 27A need not be pre-applied—it can be applied by an operator on site. In other embodiments, adhesive liner 2707 may be removably attached from the proximal end of the paper band to allow for easier shipping of paper band coil. Once removed on site, the adhesive liner 2707 may leave behind an appropriate amount of adhesive on the paper band.

Figure 28:
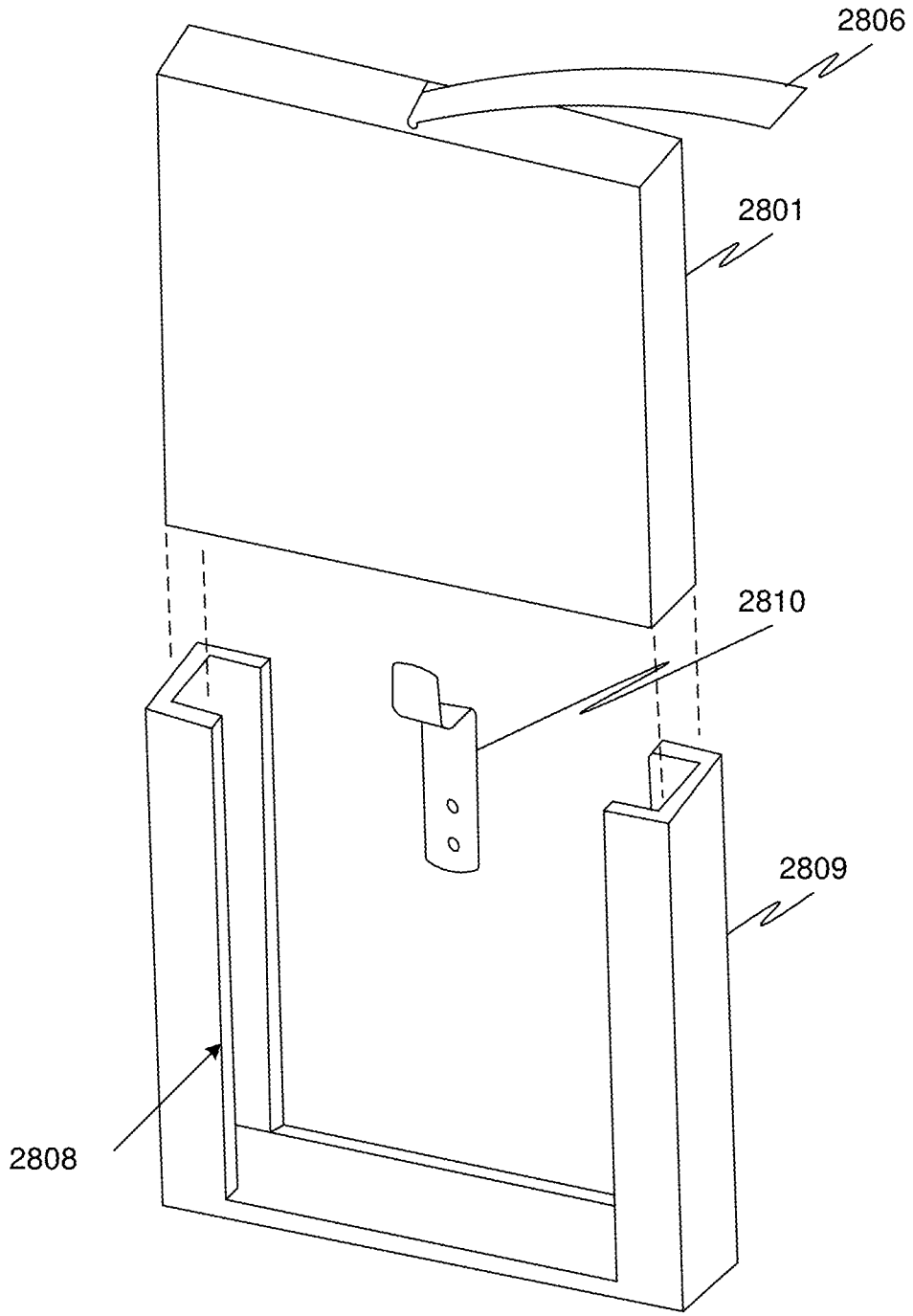
FIG. 28 illustrates an example of a single use tape dispenser box holder configuration.

Referring now to FIG. 28, an embodiment of the single-use box 2801 in use with a holder 2809 is shown. The holder 2809 may be proximate to, or present within, a paper web paper band dispensing system. Doing so allows an operator to free the exposed end 2806 of the paper band. After freeing exposed end 2806, the operator may remove the liner (not shown) from the adhesive strip and insert exposed end 2806 into a nip cylinder/drive mechanism of a paper band dispensing module. In some embodiments, holder 2809 may be fixedly or removably attached to a reservoir of a paper band dispensing module by a securing means including, but not limited to, screws, protrusions, hinges, clips, magnets, adhesive, and the like.

In some embodiments, holder 2809 may comprise one or more channels 2808 in which the narrow edges of single-use box 2801 may slide. In some embodiments, holder 2809 may further comprise clips 2810 to secure single-use box 2801 in holder 2809 by, for example, a clip across the opening of the receiver. In some embodiments, channels 2808 may comprise magnetic strips or other similar temporary-adhesion means to secure single-use box 2801 in holder 2809 temporarily. In some embodiments, channels 2808 may include additional sealing mechanisms, such as slidable stops to prevent single-use box 2801 from moving in holder 2809 after being placed in holder 2809.

Figure 29:
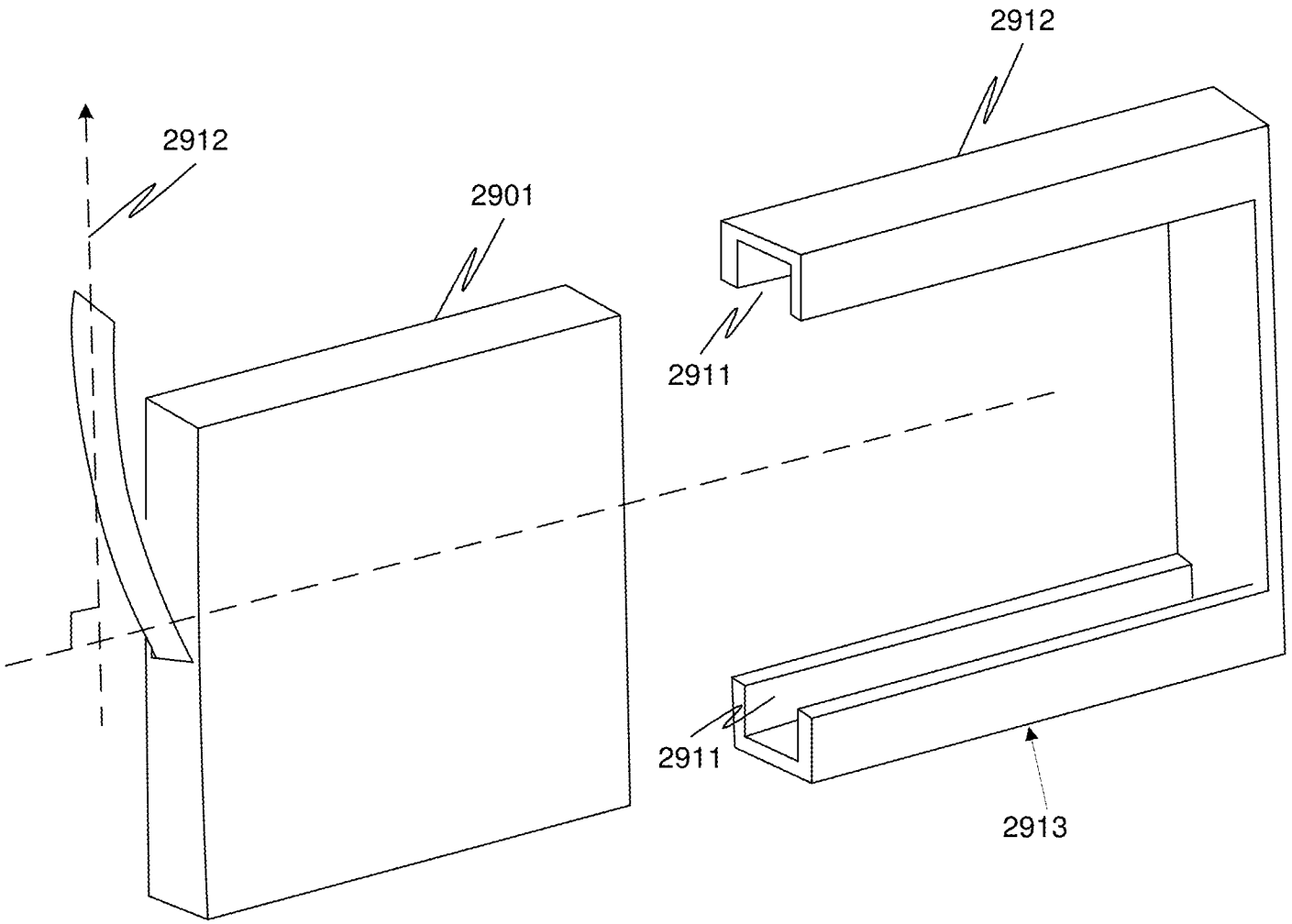
FIG. 29 illustrates another example of a single use tape dispenser box holder configuration.

Another configuration of a holder is illustrated in FIG. 29. Channels 2911 may be oriented in the reservoir perpendicularly to the principle direction of motion 2912 of the paper band. In this way, as the turn-up machine exerts a force on single-use box 2901 in the principle direction of motion 2912, holder 2913 may resist such motion. In some embodiments, an additional securing means, as described above, may be used to further attach the holder to the paper band dispensing apparatus to assist in resisting spurious forces parallel to the principle direction of motion 2912 of the paper band.

Figure 30:
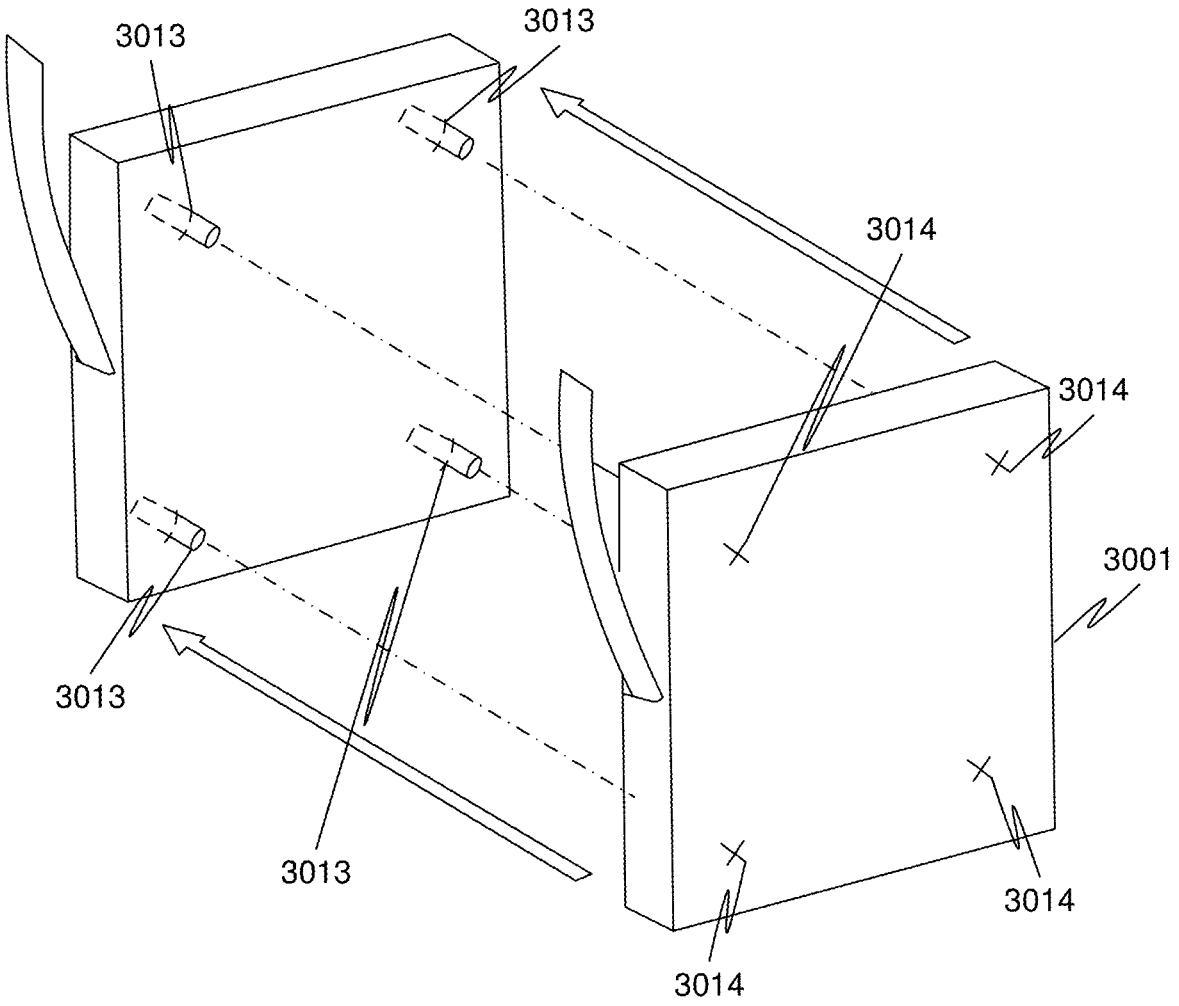
FIG. 30 illustrates another example of a single use tape dispenser box holder configuration.

Another paper band dispensing box securing mechanism is illustrated in FIG. 30. Single-use box 3001 may be impaled on two or more pins 3013 in the reservoir that may be aligned with piercings 3014 in the front and back faces of single-use box 3001, such that the pins hold single-use box 3001 securely and enforce the correct orientation when seating the box in the turn-up mechanism by virtue of an asymmetrical arrangement of the pins, or by markings on the box itself. In some embodiments, pins 3013 may be fixedly attached to a portion of the turn-up mechanism, and single-use box 3001 may be impaled thereupon. In other embodiments, pins 3013 may be fixedly or pierced attached to single-use box 3001 and may interconnect with receiving portions on the turn-up mechanism or the holder.

Figure 31:
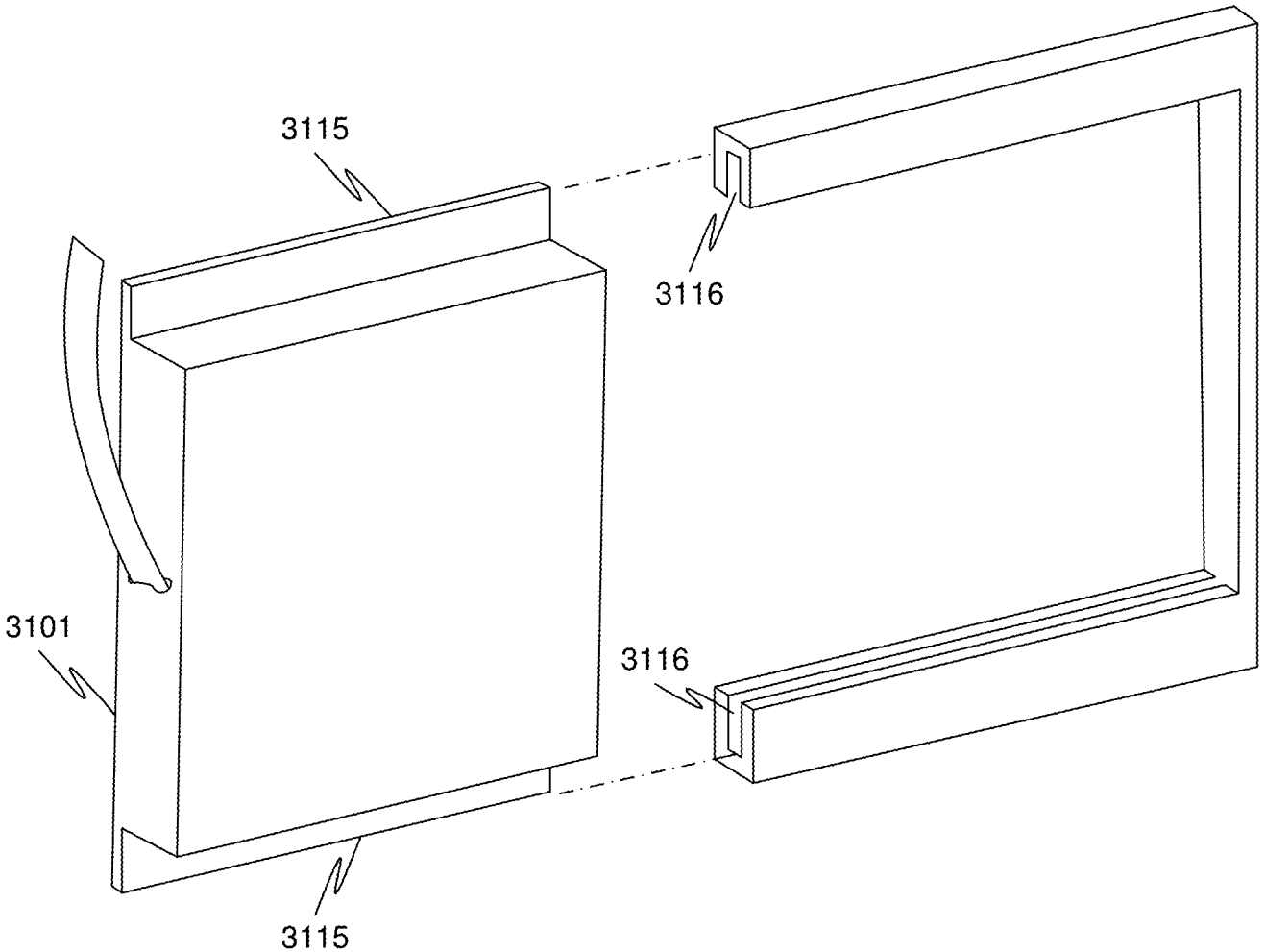
FIG. 31 illustrates another example of a single use tape dispenser box holder configuration.

Another paper band dispensing box holder configuration is illustrated in FIG. 31. In this embodiment, wings 3115 may extend from at least two sides of single-use box 3011 to engage narrow channels 3116. Depending on the configuration of the turn-up mechanism, qualities of the paper, and the like, this embodiment may be preferable to the channel embodiment shown in FIG. 28. In some embodiments, the width of wings 3115 may be adjustable by, for example, sliders. This may allow the same single-use box 3011 to fit a variety of holders. In some embodiments, wings 3115 may have securing means (e.g., a clip, a slot, an adhesive) to which the proximal end of the paper band coil may be temporarily attached to prevent the paper band coil from telescoping or tangling during transit.

The single use paper band dispensing boxes may be used with the paper band dispensing apparatus described herein or with any suitable known or later invented paper band dispensing apparatus and methods. In embodiments wherein the proximal end of the paper band has adhesive pre-applied, methods of using a single-use paper band dispensing box generally include releasing a proximal end of a coil of paper band in the box for use, such as by threading the proximal end through a slot in the sidewall of the box, or by releasing the proximal end of the paper band from a position secured outside the box; removing an adhesive liner from an adhesive on the proximal end of the paper band; and inserting the proximal end of the paper band into a track inlet of the paper band dispensing apparatus. Some methods further include placing the single-use dispensing box proximate to a paper band dispensing apparatus, such as in a holder in a reservoir of the paper band dispensing apparatus. This may be performed before or after the proximal end of the coil of paper band is released from the box. After the paper band has been inserted into the track inlet of a paper dispensing apparatus, any of the paper web turn up methods described herein may be used.

Figure 32:
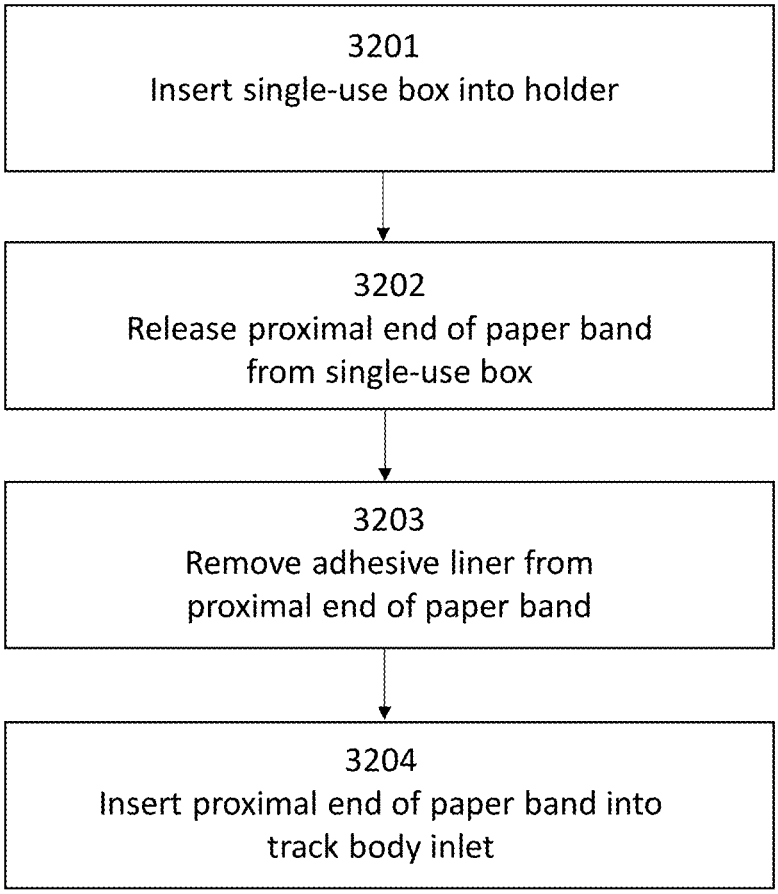
FIG. 32 provides a flow chart for method steps related to certain aspects of the invention.

Referring to FIG. 32, some embodiments of the invention include: inserting a single-use paper band dispensing box into a holder 3201, such as a holder in a reservoir of a paper band-dispensing apparatus; releasing a proximal end of the paper band from the single-use box 3202; removing an adhesive liner from the proximate end of the paper band 3203; and inserting the proximal end of paper band into a track body inlet of a paper band dispensing apparatus 3204. As noted above, in some embodiments, step 3021 may be performed after step 3022, or even after step 3023. After insertion of the paper band into the paper band dispensing apparatus, the turn-up paper band may be loaded into the cross-machine track and then used to perform one turn-up cycle, whereby the paper band effects the sever and transfer of a paper web from a rotating full spool onto an empty spool.

In some embodiments of the invention, the paper band does not have pre-applied adhesive. As such, in these embodiments, methods of using a single-use paper band dispensing box generally include releasing a proximal end of a coil of paper band in the box for use, such as by threading the proximal end through a slot in the sidewall of the box, or by releasing the proximal end of the paper band from a position secured outside the box; applying an adhesive to the proximal end of the paper band; and inserting the proximal end of the paper band into a track inlet of a paper band dispensing apparatus.

Some methods further include placing the single-use dispensing box proximate to a paper band dispensing apparatus, such as in a reservoir of the paper band dispensing apparatus. This may be performed before or after the proximal end of the coil of paper band is released from the box. After the paper band has been inserted into the track inlet, any of the paper web turn up methods described herein may be used.

Figure 33:
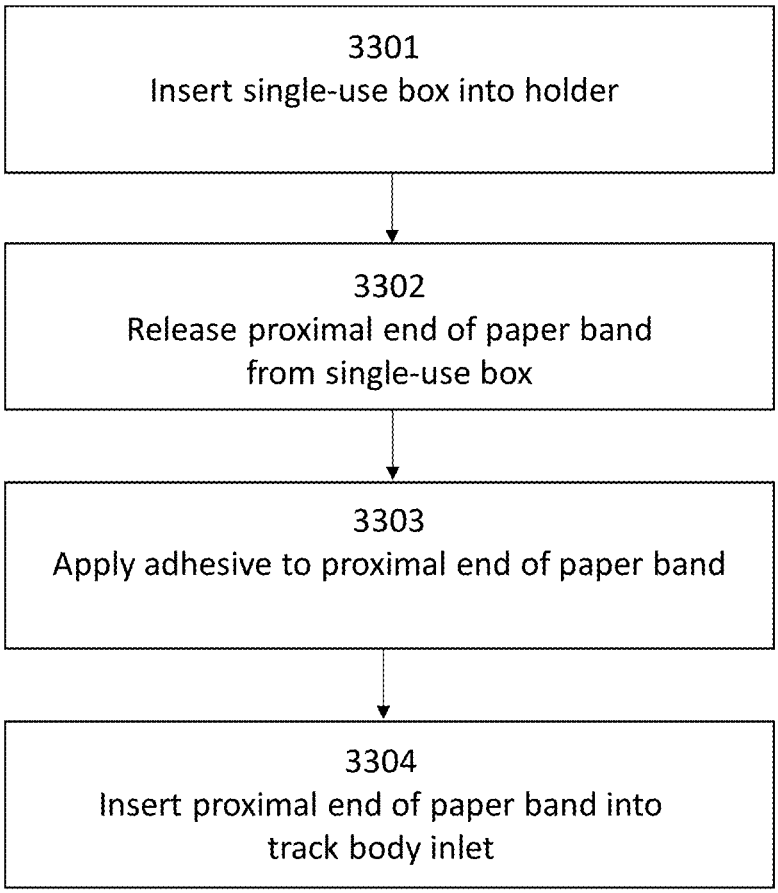
FIG. 33 provides a flow chart for method steps related to certain aspects of the invention.

Referring to FIG. 33, some embodiments of the invention include: inserting a single-use paper band dispensing box according to the invention into a holder 3301, such as a holder in a reservoir of a paper band-dispensing apparatus; releasing a proximal end of the paper band from the single-use box 3302; applying an adhesive to the proximate end of the paper band 3303) and inserting the proximal end of paper band into a track body inlet of a paper band dispensing apparatus 3304. As noted above, in some embodiments, step 3031 may be performed after step 3032, or even after step 3033.

After insertion of the paper band into the paper band dispensing apparatus, the turn-up paper band may be loaded into the cross-machine track and then used to perform one turn-up cycle, whereby the paper band effects the sever and transfer of a paper web from a rotating full spool onto an empty spool. In the methods described herein, any of the single-use paper band dispensing boxes of the invention may be used. Furthermore, the position proximate to the paper band dispensing apparatus may be within the apparatus (e.g., in a reservoir), and may be secured by any means, including a holder or other means described herein.

It is understood that equivalents and substitutions for elements or steps described above may be obvious to those of skill in the art, and therefore the true scope and definition of the invention is to be as set forth in the following claims.

A number of embodiments of the present disclosure have been described. While this specification contains many specific implementation details, they should not be construed as limitations on the scope of any disclosures or of what may be claimed, but rather as descriptions of features specific to particular embodiments of the present disclosure. While embodiments of the present disclosure are described herein by way of example using several illustrative drawings, those skilled in the art will recognize the present disclosure is not limited to the embodiments or drawings described. It should be understood the drawings and the detailed description thereto are not intended to limit the present disclosure to the form disclosed, but to the contrary, the present disclosure is to cover all modification, equivalents and alternatives falling within the spirit and scope of embodiments of the present disclosure as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the Figs.

As used in the description of the invention and the appended claims, singular forms "a," "an" and "the" are intended to include the plural forms as well, unless the context clearly indicates otherwise.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while method steps may be depicted in the drawings in a particular order, this should not be understood as requiring that such operations be performed in the particular order shown or in a sequential order, or that all illustrated operations be performed, to achieve desirable results.

What is claimed is:

1. A method of performing a turn up routine as used in paper production, the method comprising the steps of:

forming a first coil of paper band for a single turn up routine on a secondary coiled paper band dispensing module;

determining that the turn up process involving a primary coiled paper band dispensing module has failed;

inserting an end of the first coil of paper band into the secondary coiled band dispensing module's track through an inlet;

pushing the paper band to a view port in the secondary coiled band dispensing module's track;

enable a nip cylinder to pinch the paper band against a drive wheel;

cranking a hand crank to turn the drive wheel to push the paper band; and via the cranking of the drive wheel, conveying the paper band through the secondary coiled band dispensing module's track until an end reaches a point for proper staging of the turn up routine.

* * * * *